US011344935B2

(12) United States Patent
Obe et al.

(10) Patent No.: US 11,344,935 B2
(45) Date of Patent: May 31, 2022

(54) PIERCING MACHINE, MANDREL BAR, AND METHOD FOR PRODUCING SEAMLESS METAL PIPE USING THE SAME

(71) Applicant: NIPPON STEEL CORPORATION, Tokyo (JP)

(72) Inventors: Haruka Obe, Tokyo (JP); Akihiro Sakamoto, Tokyo (JP); Yasuhiko Daimon, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 9 days.

(21) Appl. No.: 16/762,241

(22) PCT Filed: Nov. 28, 2018

(86) PCT No.: PCT/JP2018/043858
§ 371 (c)(1),
(2) Date: May 7, 2020

(87) PCT Pub. No.: WO2019/107443
PCT Pub. Date: Jun. 6, 2019

(65) Prior Publication Data

US 2021/0178442 A1 Jun. 17, 2021

(30) Foreign Application Priority Data

Nov. 29, 2017 (JP) ..... JP2017-228499

(51) Int. Cl.
*B21B 19/04* (2006.01)
*B21B 25/04* (2006.01)

(52) U.S. Cl.
CPC ..... *B21B 19/04* (2013.01); *B21B 25/04* (2013.01)

(58) Field of Classification Search
CPC ..... B21B 19/04; B21B 25/04
See application file for complete search history.

(56) References Cited

U.S. PATENT DOCUMENTS 1,910,377 A * 5/1933 Becker ..... B21B 25/00 72/69
2,234,971 A * 3/1941 Kelso ..... B21B 25/04 72/463

(Continued)

FOREIGN PATENT DOCUMENTS

DE 3122443 A1 12/1982
EP 0787542 A2 * 8/1997 ..... B21B 25/04

(Continued)

OTHER PUBLICATIONS

Int'l Search Report issued in PCT/JP2018/043858, dated Jan. 29, 2019.

*Primary Examiner* — Adam J Eiseman
*Assistant Examiner* — P Derek Pressley
(74) *Attorney, Agent, or Firm* — Greer Burns & Crain Ltd.

(57) ABSTRACT

A mandrel bar of a piercing machine includes: a bar body; a coolant channel formed inside the bar body and through which a coolant flows; an inner surface cooling mechanism which is disposed in a cooling zone and is connected to the coolant channel and which, during piercing-rolling or during elongating rolling, ejects the coolant to outside of the bar body to cool an inner surface portion of a hollow shell inside the cooling zone; and an inner surface damming mechanism which is disposed adjacent to the cooling zone on a rearward side of the cooling zone and which, during piercing-rolling or during elongating rolling, suppresses the coolant that is ejected to outside of the bar body from contacting the inner surface portion of the hollow shell that is positioned rearward of the cooling zone.

21 Claims, 40 Drawing Sheets

(56) References Cited

U.S. PATENT DOCUMENTS

| | | | | | |
|---|---|---|---|---|---|
| 3,782,160 | A * | 1/1974 | Kheifets | B21B 25/04 | 72/201 |
| 3,889,507 | A * | 6/1975 | Kranenberg | B21B 45/0224 | 72/201 |
| 4,655,065 | A * | 4/1987 | Sansome | B21C 1/24 | 72/283 |
| 2007/0295048 | A1 * | 12/2007 | Denker | B21B 45/0278 | 72/40 |

FOREIGN PATENT DOCUMENTS

| | | | | |
|---|---|---|---|---|
| JP | 59033010 | A * | 2/1984 | B21B 25/04 |
| JP | 03099708 | A | 4/1991 | |
| JP | 2017013102 | A | 1/2017 | |

* cited by examiner

PIERCING MACHINE, MANDREL BAR, AND METHOD FOR PRODUCING SEAMLESS METAL PIPE USING THE SAME

This is a National Phase Application filed under 35 U.S.C. § 371, of International Application No. PCT/JP2018/043858, filed Nov. 28, 2018, the contents of which are incorporated by reference.

TECHNICAL FIELD

The present invention relates to a piercing machine, a mandrel bar, and a method for producing a seamless metal pipe using the piercing machine and the mandrel bar.

BACKGROUND ART

The Mannesmann process is available as a method for producing a seamless metal pipe that is typified by a steel pipe. According to the Mannesmann process, a solid round billet is subjected to piercing-rolling using a piercing mill to produce a hollow shell. The hollow shell produced by piercing-rolling is then subjected to elongating rolling to provide the hollow shell with a prescribed wall thickness and external diameter. For example, an elongator, a plug mill or a mandrel mill is utilized for the elongating rolling. The hollow shell that underwent elongating rolling is subjected to diameter adjusting rolling using a sizing mill such as a sizer to thereby produce a seamless metal pipe having a desired external diameter.

Among the aforementioned apparatuses for producing a seamless metal pipe, the configurations of the piercing mill and the elongator are similar to each other. The piercing mill and the elongator each include a plurality of skewed rolls, a plug and a mandrel bar. The plurality of skewed rolls are arranged at regular intervals around a pass line along which the material (the material is a round billet in the case of a piercing mill, and the material is a hollow shell in the case of an elongator) passes. The plug is disposed on the pass line, between the plurality of skewed rolls. The plug has a bullet shape, and the external diameter of a fore end portion of the plug is smaller than the external diameter of a rear end portion of the plug. The fore end portion of the plug is disposed facing the material before piercing-rolling or elongating rolling. The fore end of the mandrel bar is connected to a central part of the rear end face of the plug. The mandrel bar is disposed on the pass line, and extends along the pass line.

The piercing mill presses a round billet as the material against the plug while rotating the round billet in the circumferential direction by means of the plurality of skewed rolls, to thereby subject the round billet to piercing-rolling to form a hollow shell. Similarly, the elongator inserts the plug into a hollow shell as the material while rotating the hollow shell in the circumferential direction of the hollow shell by means of the plurality of skewed rolls, and rolls down the hollow shell between the skewed rolls and the plug to perform elongating rolling of the hollow shell.

Hereinafter, in the present description, a rolling apparatus that is equipped with a plurality of skewed rolls, a plug and a mandrel bar, such as a piercing mill or an elongator, is defined as a "piercing machine". Further, in the respective configurations of the piercing machine, the entrance side of the skewed rolls of the piercing machine is defined as "frontward", and the delivery side of the skewed rolls of the piercing machine is defined as "rearward".

Recently, there are demands to increase the strength of seamless metal pipes. For example, in the case of seamless pipes for use in oil wells or gas wells, accompanying the deepening of oil wells and gas wells, there is a demand for such pipes to have high strength. In order to produce such seamless metal pipes that have high strength, for example, a hollow shell is subjected to quenching and tempering after undergoing piercing-rolling and elongating rolling.

If the temperature distribution in the longitudinal direction of the hollow shell before quenching is nonuniform, the micro-structure in the hollow shell after quenching may be nonuniform in the longitudinal direction. If the microstructure is nonuniform in the longitudinal direction, variations may arise in the mechanical properties in the longitudinal direction of the seamless metal pipe that is produced. Accordingly, it is preferable that the occurrence of variations in the temperature distribution in the longitudinal direction of a hollow shell after undergoing piercing-rolling or elongating rolling using a piercing machine can be suppressed. Specifically, it is preferable that the occurrence of a temperature difference between the fore end portion and the rear end portion of a hollow shell after piercing-rolling or after elongating rolling is suppressed.

Techniques for reducing nonuniformity in the temperature distribution of a hollow shell produced using a piercing machine are proposed in Japanese Patent Application Publication No. 3-99708 (Patent Literature 1) and Japanese Patent Application Publication No. 2017-13102 (Patent Literature 2).

In Patent Literature 1, the following matters are described. An objective of Patent Literature 1 is to reduce a temperature difference between the inner surface and outer surface of a high-alloy seamless pipe having high deformation resistance, which is caused by processing-incurred heat that arises during piercing-rolling or elongating rolling. According to Patent Literature 1, a nozzle hole capable of ejecting cooling water in a diagonally rearward direction is formed in a rear portion of a plug. During piercing-rolling, cooling water is ejected from the nozzle hole in the rear portion of the plug toward the inner surface of a hollow shell that is being subjected to piercing-rolling. By this means, the inner surface at which the temperature increased more than the outer surface due to processing-incurred heat is cooled, thereby reducing the temperature difference between the inner and outer surfaces of the hollow shell.

In Patent Literature 2, the following matters are described. In an elongating rolling mill such as an elongator, when a plug is inserted into a hollow shell to perform elongating rolling, the temperature of the plug at the initial stage of elongating rolling is lower than the temperature of the hollow shell. Subsequently, during the elongating rolling, the temperature of the plug increases due to heat of the hollow shell being transferred to the plug. On the other hand, although the temperature of the hollow shell at the initial stage of elongating rolling is high, the temperature of the hollow shell gradually decreases due to heat release during the elongating rolling. In other words, the temperature of the plug and the temperature of the hollow shell each change during the period from the start to the end of elongating rolling. Therefore, there is a problem that the temperature distribution in the longitudinal direction (axial direction) of the hollow shell after elongating rolling is nonuniform (see paragraph [0010] of Patent Literature 2). Therefore, according to Patent Literature 2, a plurality of ejection holes are provided in the rear end face of the plug or in the fore end portion of the mandrel bar. Cooling fluid is sprayed onto the inner surface of the hollow shell that is being subjected to elongating rolling from the ejection holes in the rear end face of the plug or the ejection holes in the fore end portion of the mandrel bar. More specifically, first, the temperature distribution in the axial direction of the hollow shell is acquired in advance with respect to a time when an intermediate hollow shell was subjected to elongating rolling without ejecting cooling fluid from the rear end face of the plug or the fore end portion of the mandrel bar. Then, elongating rolling is performed while adjusting the amount of cooling fluid ejected from the ejection holes of the rear end face of the plug or the ejection holes of the fore end portion of the mandrel bar based on the obtained temperature distribution. Thus, the temperature distribution in the axial direction of the hollow shell after elongating rolling can be made uniform (paragraphs [0020], [0021] and the like).

CITATION LIST

Patent Literature

Patent Literature 1: Japanese Patent Application Publication No. 3-99708

Patent Literature 2: Japanese Patent Application Publication No. 2017-13102

SUMMARY OF INVENTION

Technical Problem

According to the techniques proposed in Patent Literature 1 and Patent Literature 2, a hollow shell is cooled by ejecting a cooling fluid toward the inner surface of the hollow shell from a plug or a mandrel to thereby cool the inner surface of the hollow shell. However, when these techniques are applied, in some cases a temperature difference arises between the fore end portion of the hollow shell that passes through the skewed rolls in an initial stage of rolling and the rear end portion of the hollow shell that passes through the skewed rolls at the end of rolling, and it is difficult for the temperature distribution in the axial direction of the hollow shell after piercing-rolling by a piercing mill or after elongating rolling by an elongator to become uniform.

An objective of the present disclosure is to provide a piercing machine, a mandrel bar that is used in the piercing machine, and a method for producing a seamless metal pipe, which can suppress the occurrence of temperature variations in the longitudinal direction (axial direction) of a hollow shell after piercing-rolling or after elongating rolling.

Solution To Problem

A piercing machine according to the present disclosure is a piercing machine that performs piercing-rolling or elongating rolling of a material to produce a hollow shell, comprising:

a plurality of skewed rolls disposed around a pass line along which the material passes;

a plug disposed on the pass line between a plurality of the skewed rolls; and a mandrel bar extending rearward of the plug along the pass line from a rear end of the plug, wherein:

the mandrel bar includes:

a bar body;

a coolant channel formed inside the bar body, the coolant channel allowing a coolant to pass therein;

an inner surface cooling mechanism disposed inside a cooling zone in the bar body, the cooling zone having a specific length in an axial direction of the mandrel bar and being located at a fore end portion of the mandrel bar, wherein, during piercing-rolling or during elongating rolling, the inner surface cooling mechanism ejects the coolant that is supplied from the coolant channel to outside of the bar body to cool an inner surface of the hollow shell that is advancing within the cooling zone; and an inner surface damming mechanism disposed adjacent to the cooling zone on a rearward side of the cooling zone, wherein, during piercing-rolling or during elongating rolling, the inner surface damming mechanism suppresses contact of the coolant ejected to outside of the bar body with the inner surface of the hollow shell after the hollow shell leaves from the cooling zone.

A mandrel bar according to the present invention is used in the aforementioned piercing machine.

A method for producing a seamless metal pipe according to the present disclosure is a method for producing a seamless metal pipe using the aforementioned piercing machine, comprising:

a rolling process of subjecting the material to piercing-rolling or elongating rolling using the piercing machine to produce a hollow shell, and a process of, during the rolling process, ejecting the coolant to outside of the bar body by means of the inner surface cooling mechanism to cool the inner surface of the hollow shell within the cooling zone, and by means of an inner surface damming mechanism that is disposed adjacent to the cooling zone on a rearward side of the cooling zone, suppressing contact of the coolant ejected to outside of the bar body with the inner surface of the hollow shell after the hollow shell leaves from the cooling zone.

Advantageous Effect of Invention

The piercing machine according to the present invention can suppress the occurrence of temperature variations in the longitudinal direction (axial direction) of a hollow shell after piercing-rolling or after elongating rolling.

DESCRIPTION OF EMBODIMENTS

Figure 1:
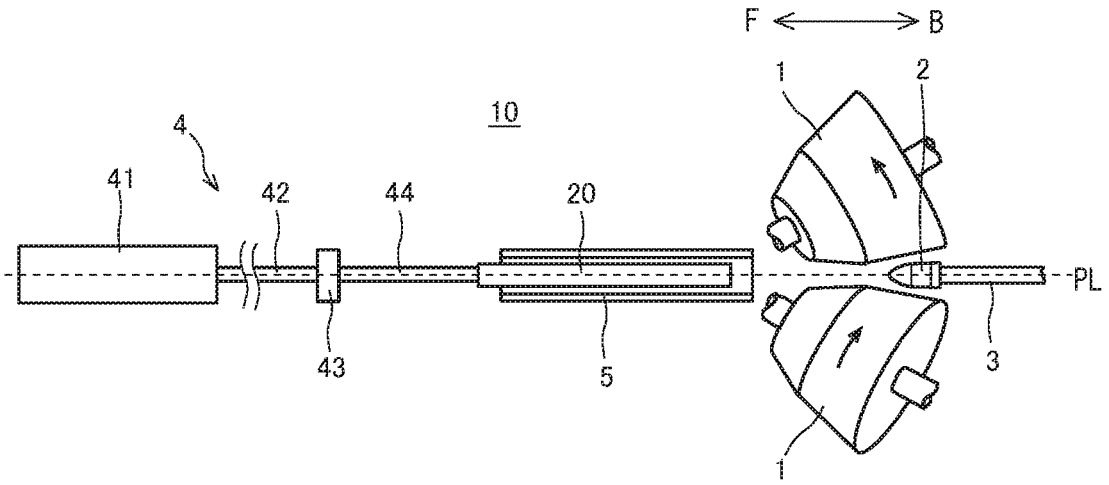
FIG. 1 is a side view of a piercing machine according to a first embodiment.

The present inventors conducted studies and investigations with a view to clarifying the reason why a temperature difference between the fore end portion and the rear end portion in the axial direction (longitudinal direction) of a hollow shell after piercing-rolling or elongating rolling is not reduced sufficiently when the techniques disclosed in Patent Literature 1 and Patent Literature 2 are applied. Here, the term "fore end portion of a hollow shell" means, of the two end portions in the axial direction of the hollow shell, the end portion that first passes the plug during piercing-rolling or elongating rolling. The term "rear end portion of a hollow shell" means the end portion that passes the plug last during piercing-rolling or elongating rolling. Further, in the present description, with regard to the directions of the respective configurations of the piercing machine, the entrance side of the piercing machine is defined as "frontward", and the delivery side of the piercing machine is defined as "rearward".

As the result of the studies and investigations conducted by the present inventors, it has been found that there is a possibility of the following problems occurring when the techniques disclosed in Patent Literatures 1 and 2 are applied. According to Patent Literature 1 and Patent Literature 2, during piercing-rolling or during elongating rolling, cooling water or a cooling fluid is continuously ejected toward the inner surface of a hollow shell from the rear end portion of a plug or the fore end portion of a mandrel bar. In this case, immediately after the inner surface portion of the hollow shell passes the plug, the inner surface portion of the hollow shell is cooled. However, the coolant ejected toward the inner surface of the hollow shell from the plug or the mandrel bar strikes against the inner surface and falls downward. The coolant that has fallen downward is liable to accumulate at an inner surface portion that, with respect to the entire inner surface of the hollow shell that is being subjected to piercing-rolling and elongating rolling, is a portion which is located further downward than the mandrel bar.

In the initial stage of rolling when performing piercing-rolling or elongating rolling, the fore end portion of the rolled hollow shell passes the plug 2. At such time, the fore end portion of the hollow shell is an open space, while on the other hand, of the entire hollow shell, a portion at which the plug 2 is located is a closed space. As rolling proceeds, the distance from the rear end portion of the plug 2 that is a closed space to the fore end (open space) of the hollow shell lengthens. As the distance to the open space lengthens, the aforementioned accumulation of coolant accumulates over a longer distance (more widely) in the longitudinal direction of the hollow shell. Although the inner surface portion at which the coolant is accumulating is cooled, the area in which the coolant accumulates changes as the rolling proceeds. Therefore, differences with regard to the length of the cooling time period arise at each position in the longitudinal direction of the hollow shell.

Specifically, the fore end portion of the hollow shell is liable to be cooled for a long time period by accumulated coolant, and consequently the temperature thereof decreases. On the other hand, obviously the inner surface of the hollow shell does not exist to the rear of the rear end portion of the hollow shell. Therefore, when the rear end portion of the hollow shell passes the plug, coolant does not accumulate, and coolant flows to the outside of the hollow shell. As a result, the cooling time period of the inner surface of the rear end portion of the hollow shell is shorter than the cooling time period of the inner surface of the fore end portion of the hollow shell. Consequently, a temperature difference arises between the fore end portion and the rear end portion of the hollow shell.

Based on the novel findings described above, the present inventors conducted studies regarding methods for suppressing the occurrence of a temperature difference between the fore end portion and the rear end portion of a hollow shell.

First, in the case of performing piercing-rolling or elongating rolling using a plug, immediately after the material (round billet or hollow shell) passes the plug, the rolling down (piercing-rolling or elongating rolling) is completed. Therefore, new processing-incurred heat does not arise in the hollow shell that passed the plug. Thus, the inner surface portion of the hollow shell that has a high temperature due to processing-incurred heat is preferably cooled immediately after the hollow shell passes the plug.

Here, in the mandrel bar, a zone which has a specific length in the axial direction (longitudinal direction) of the mandrel bar and which is located at a fore end portion of the mandrel bar and is adjacent to the rear end of the plug is defined as a "cooling zone". By providing an inner surface cooling mechanism within the cooling zone and ejecting a coolant from the cooling zone, an inner surface portion of the hollow shell that passes through the coolant is cooled. In addition, an inner surface damming mechanism is provided at a portion of the mandrel bar that is adjacent to the cooling zone on a rearward side of the cooling zone. The inner surface damming mechanism suppresses contact of coolant ejected in the cooling zone by the cooling mechanism with the inner surface portion of the hollow shell that is positioned rearward of the cooling zone. By means of the mechanisms described above, a zone in which the hollow shell is cooled by the coolant during piercing-rolling or during elongating rolling is limited to the cooling zone. Therefore, the time period of cooling by the coolant is constant for each position in the longitudinal direction of the inner surface of the hollow shell. As a result, during piercing-rolling or elongating rolling, the occurrence of a temperature difference between the fore end portion and the rear end portion of the hollow shell is suppressed.

As described in the foregoing, the present invention is an invention that has been completed based on a technical idea that is completely different from the conventional technical ideas, and the configuration of the present invention is as described in the following.

A piercing machine according to a configuration of (1) is a piercing machine that performs piercing-rolling or elongating rolling of a material to produce a hollow shell, comprising:

a plurality of skewed rolls disposed around a pass line along which the material passes;

a plug disposed on the pass line between the plurality of the skewed rolls; and a mandrel bar extending rearward of the plug along the pass line from a rear end of the plug, wherein:

the mandrel bar includes:

a bar body;

a coolant channel formed inside the bar body, the coolant channel allowing a coolant to pass therein;

an inner surface cooling mechanism disposed inside a cooling zone in the bar body, the cooling zone having a specific length in an axial direction of the mandrel bar and being located at a fore end portion of the mandrel bar, wherein, during piercing-rolling or during elongating rolling, the inner surface cooling mechanism ejects the coolant that is supplied from the coolant channel to outside of the bar body to cool an inner surface of the hollow shell that is advancing within the cooling zone; and an inner surface damming mechanism which is disposed adjacent to the cooling zone on a rearward side of the cooling zone, and which, during piercing-rolling or during elongating rolling, suppresses contact of the coolant ejected to outside of the bar body with the inner surface of the hollow shell after the hollow shell leaves from the cooling zone.

In the piercing machine according to the configuration of (1), with respect to the hollow shell that passed the plug after piercing-rolling or after elongating rolling, the inner surface cooling mechanism cools the inner surface of the hollow shell that is advancing through a cooling zone of a specific length. In addition, the inner surface damming mechanism that is disposed adjacent to the cooling zone on a rearward side of the cooling zone suppresses contact of the coolant that cooled the inner surface of the hollow shell within the cooling zone with the inner surface of the hollow shell after the hollow shell leaves from the cooling zone. Therefore, although the inner surface of the hollow shell is subjected to cooling by the coolant within the cooling zone, it is difficult for the inner surface of the hollow shell to be subjected to cooling by the coolant at a position that is further rearward than the cooling zone. Therefore, when piercing-rolling or elongating rolling is performed using the piercing machine according to the configuration of (1), the hollow shell is stably cooled in a fixed zone (cooling zone). As a result, fluctuations in the cooling time periods in the axial direction of the hollow shell can be suppressed, temperature variations in the axial direction of the hollow shell can be reduced, and in particular, a temperature difference between the fore end portion and rear end portion of the hollow shell can be reduced.

A piercing machine according to a configuration of (2) is in accordance with the piercing machine described in (1), wherein:

the inner surface damming mechanism dams the coolant ejected to outside of the bar body, and accumulates the coolant between the bar body and the inner surface of the hollow shell within the cooling zone.

In the piercing machine according to the configuration of (2), because the inner surface damming mechanism dams the coolant, the coolant accumulates in a clearance between the bar body and the inner surface of the hollow shell in the cooling zone. Therefore, the hollow shell can be further cooled in the cooling zone.

A piercing machine according to a configuration of (3) is in accordance with the piercing machine described in (1) or (2), the mandrel bar further including:

a compressed gas channel that is formed inside the bar body and through which compressed gas passes;

wherein the inner surface damming mechanism:

during piercing-rolling or during elongating rolling, by ejecting the compressed gas that is supplied from the compressed gas channel to outside of the bar body, suppresses contact of the coolant ejected to outside of the bar body with the inner surface of the hollow shell after the hollow shell leaves from the cooling zone.

In the piercing machine according to the configuration of (3), the inner surface damming mechanism ejects compressed gas to outside of the bar body at a position that is rearward of the cooling zone. By this means, if the coolant ejected inside the cooling zone attempts to flow to rearward of the cooling zone, the compressed gas blows away the coolant and thereby suppresses contact of the coolant with the inner surface of the hollow shell after the hollow shell leaves from the cooling zone. By this means, after the hollow shell undergoes piercing-rolling or elongating rolling and passes the plug, the hollow shell is stably cooled in a fixed zone (cooling zone). As a result, fluctuations in the cooling time periods in the axial direction of the hollow shell can be suppressed, temperature variations in the axial direction of the hollow shell can be reduced, and in particular, a temperature difference between the fore end portion and rear end portion of the hollow shell can be reduced.

A piercing machine according to a configuration of (4) is in accordance with the piercing machine described in (3), wherein:

the inner surface damming mechanism:

dams the coolant ejected to outside of the bar body, by means of the compressed gas ejected to outside of the bar body, and accumulates the coolant between the bar body and the inner surface of the hollow shell within the cooling zone.

In the piercing machine according to the configuration of (4), compressed gas that the inner surface damming mechanism ejects serves as a dam, and dams the coolant. Therefore, the coolant accumulates in a clearance between the bar body and the inner surface of the hollow shell in the cooling zone. As a result, the hollow shell can be further cooled.

A piercing machine according to a configuration of (5) is in accordance with the piercing machine described in (1) or (2), wherein:

the inner surface damming mechanism:

includes an inner surface damming member which is disposed adjacent to the cooling zone on a rearward side of the cooling zone, and which extends in a circumferential direction of the bar body, and a height of the inner surface damming member is lower than a differential value between a maximum radius of the plug and a radius of the bar body at the position at which the inner surface damming member is disposed.

In the piercing machine according to a configuration of (5), an inner surface damming member is disposed adjacent to the rear end of the cooling zone. The inner surface damming member acts as a dam, and suppresses contact of the coolant ejected to outside of the bar body with the inner surface of the hollow shell after the hollow shell leaves from the cooling zone.

Note that, the height of the inner surface damming member is lower than a differential value between the maximum radius of the plug and the radius of the bar body at the position at which the inner surface damming member is disposed. Therefore, during piercing-rolling or during elongating rolling, the inner surface damming member does not contact the inner surface of the hollow shell that passed the plug, and does not roll down the inner surface of the hollow shell.

A piercing machine according to a configuration of (6) is in accordance with the piercing machine described in (5), wherein:

the inner surface damming mechanism:

dams the coolant ejected to outside of the bar body, by means of the inner surface damming member, and accumulates the coolant between the bar body and the inner surface of the hollow shell within the cooling zone.

In the piercing machine according to the configuration of (6), the inner surface damming member serves as a dam, and dams the coolant. Therefore, within the cooling zone, the coolant accumulates in a clearance between the bar body and the inner surface of the hollow shell. As a result, the hollow shell can be cooled further.

A piercing machine according to a configuration of (7) is in accordance with the piercing machine described in any one of (1) to (6), wherein:

the mandrel bar further includes:

a drainage channel that is formed within the bar body and in which the coolant ejected to outside of the bar body flows, and one or more drainage holes that is disposed within the cooling zone in the bar body, and is connected to the drainage channel and recovers the coolant ejected to outside of the bar body.

In the piercing machine according to the configuration of (7), coolant utilized to cool the hollow shell within the cooling zone is collected by the drainage holes that is disposed within the cooling zone. Therefore, new coolant can be successively supplied into the cooling zone, and thus the cooling efficiency can be increased.

A piercing machine according to a configuration of (8) is in accordance with the piercing machine described in any one of (1) to (7), wherein:

the inner surface cooling mechanism includes:

within the cooling zone, a plurality of coolant ejection holes which are arrayed in a circumferential direction of the bar body or in a circumferential direction and an axial direction of the bar body and which eject the coolant.

In the piercing machine according to the configuration of (8), a plurality of coolant ejection holes are arrayed in at least the circumferential direction. Therefore, it is easy to uniformly cool the inner surface of the hollow shell in the circumferential direction.

A piercing machine according to a configuration of (9) is in accordance with the piercing machine described in (8), wherein:

as seen from an advancing direction of the hollow shell, a plurality of the coolant ejection holes face in the circumferential direction of the bar body, and the outer surface cooling mechanism causes the coolant in the cooling zone to swirl around the bar body, by ejecting the coolant in the circumferential direction of the bar body from the plurality of the coolant ejection holes.

In the piercing machine according to the configuration of (9), coolant is ejected in the circumferential direction of the bar body from the plurality of the coolant ejection holes. By this means, in the cooling zone, the coolant forms a swirl flow that swirls around the bar body. By means of the swirl flow, variations in the flow of the coolant in the circumferential direction of the bar body can be suppressed. As a result, the occurrence of cooling nonuniformity in the circumferential direction at the inner surface of the hollow shell can be suppressed.

A piercing machine according to a configuration of (10) is in accordance with the piercing machine described in (9), wherein:

the plurality of the coolant ejection holes face in the circumferential direction of the bar body and rearward of the bar body, and the inner surface cooling mechanism causes the coolant in the cooling zone to swirl around the bar body by ejecting the coolant in the circumferential direction of the bar body and rearward of the bar body from the plurality of the coolant ejection holes.

In the piercing machine according to the configuration of (10), the coolant forms a swirl flow that flows in the circumferential direction and in the rearward direction of the bar body. Therefore, variations in the flow of the coolant can be further suppressed, and the occurrence of cooling nonuniformity in the circumferential direction at the inner surface of the hollow shell can be suppressed.

A piercing machine according to a configuration of (11) is in accordance with the piercing machine described in (3) or (4), wherein:

the inner surface cooling mechanism includes:

within the cooling zone, a plurality of coolant ejection holes which are arrayed in a circumferential direction of the bar body or in a circumferential direction and an axial direction of the bar body and which eject the coolant; and the inner surface damming mechanism includes:

a plurality of compressed gas ejection holes which are arrayed in the circumferential direction of the bar body or in the circumferential direction and the axial direction of the bar body in a contact suppression zone that is disposed adjacent to the cooling zone on a rearward side of the cooling zone, and which eject compressed gas.

In the piercing machine according to the configuration of (11), in the cooling zone the plurality of coolant ejection holes are arrayed at least in the circumferential direction, and furthermore, in the contact suppression zone the plurality of compressed gas ejection holes are arrayed in at least the circumferential direction. Therefore, cooling nonuniformity in the circumferential direction at the inner surface of the hollow shell can be further suppressed.

A piercing machine according to a configuration of (12) is in accordance with the piercing machine described in (11), wherein:

as seen from an advancing direction of the hollow shell, the plurality of the compressed gas ejection holes face in the circumferential direction of the bar body, and the inner surface damming mechanism causes the compressed gas in the contact suppression zone to swirl around the bar body, by ejecting the compressed gas in the circumferential direction of the bar body from the compressed gas ejection holes.

In the piercing machine according to the configuration of (12), not only does coolant form a swirl flow in the cooling zone, but furthermore, in a contact suppression zone that is disposed adjacent to the cooling zone on a rearward side of the cooling zone, compressed gas that the inner surface damming mechanism ejects also forms a swirl flow. The swirl flow of the compressed gas quickly blows away coolant that enters the contact suppression zone. Therefore, while suppressing the occurrence of cooling nonuniformity in the circumferential direction at the inner surface of the hollow shell within the cooling zone, contact of coolant with the inner surface of the hollow shell after the hollow shell leaves from the cooling zone can also be suppressed.

A piercing machine according to a configuration of (13) is in accordance with the piercing machine described in (12), wherein:

the plurality of the compressed gas ejection holes face in the circumferential direction of the bar body and rearward of the bar body, and the inner surface damming mechanism causes the compressed gas in the contact suppression zone to swirl around the bar body, by ejecting the compressed gas in the circumferential direction of the bar body and rearward of the bar body from the compressed gas ejection holes.

In the piercing machine according to the configuration of (13), compressed gas forms a swirl flow that flows in the circumferential direction and in the rearward direction of the bar body. Therefore, the swirl flow of compressed gas quickly blows coolant that enters the contact suppression zone away in the rearward direction of the bar body. Therefore, while suppressing the occurrence of cooling nonuniformity in the circumferential direction at the inner surface of the hollow shell within the cooling zone, contact of coolant with the inner surface of the hollow shell after the hollow shell leaves from the cooling zone can be further suppressed.

A piercing machine according to a configuration of (14) is in accordance with the piercing machine described in (13), wherein:

as seen from an advancing direction of the hollow shell, a swirling direction of the coolant ejected from a plurality of the coolant ejection holes is clockwise or counterclockwise, as seen from the advancing direction of the hollow shell, a swirling direction of the compressed gas ejected from the plurality of the compressed gas ejection holes is clockwise or counterclockwise, and the inner surface damming mechanism ejects the compressed gas so that the swirling direction of the compressed gas becomes the same as the swirling direction of the coolant.

In the piercing machine according to the configuration of (14), the swirling direction of the swirl flow of the compressed gas is the same as the swirling direction of the swirl flow of the coolant. In this case, the occurrence of an eddy flow caused by a collision between fluids (coolant and compressed gas) can be suppressed at the boundary between the cooling zone and the contact suppression zone. Therefore, the occurrence of a situation in which coolant stays at the boundary between the cooling zone and the contact suppression zone can be suppressed, and coolant entering the contact suppression zone can be quickly blown away by the swirl flow of the compressed gas.

A piercing machine according to a configuration of (15) is in accordance with the piercing machine described in any one of (12) to (14), wherein:

the inner surface cooling mechanism includes:

a plurality of annularly arranged coolant-ejection-hole groups that are arrayed in the axial direction of the bar body in the cooling zone of the bar body, the annularly arranged coolant-ejection-hole group includes:

a plurality of the coolant ejection holes that are arrayed in the circumferential direction at a same position in the axial direction of the bar body, and in the inner surface cooling mechanism:

when a distance in the axial direction of the bar body that the swirl flow of the coolant advances until completing one rotation around the bar body is defined as "one swirl period distance", in the axial direction of the bar body, a distance between the annularly arranged coolant-ejection-hole groups that are adjacent is the same as the one swirl period distance.

Here the term "the same as the one swirl period distance" means that the distance between the adjacent annularly arranged coolant-ejection-hole groups is within a range of the one swirl period distance ±50%. Preferably, the distance between the adjacent annularly arranged coolant-ejection-hole groups is within a range of the one swirl period distance ±20%, and more preferably is within a range of the one swirl period distance ±10%.

In the piercing machine according to the configuration of (15), when the swirl flow of the coolant advances by a distance that is equivalent to one swirl period distance, new coolant is supplied from the annularly arranged coolant-ejection-hole group in the next row in the rearward direction. Therefore, it is more difficult for an eddy flow to arise in the swirl flow of the coolant in comparison to a case where new coolant is supplied from the annularly arranged coolant-ejection-hole group in the next row before the swirl flow of the coolant reaches the one swirl period distance. Thus, the occurrence of cooling nonuniformity in the circumferential direction at the inner surface of the hollow shell can be further suppressed.

A piercing machine according to a configuration of (16) is in accordance with the piercing machine described in any one of (1) to (15), further comprising:

an outer surface cooling mechanism disposed around the mandrel bar, at a position that is rearward of the plug, wherein, with respect to the outer surface of the hollow shell that is advancing through the cooling zone, as seen from an advancing direction of the hollow shell, the outer surface cooling mechanism ejects a cooling fluid toward an upper part of the outer surface, a lower part of the outer surface, a left part of the outer surface and a right part of the outer surface to cool the hollow shell inside the cooling zone.

In the piercing machine according to the configuration of (16), at the position that is rearward of the plug, the upper part of the outer surface, the lower part of the outer surface, the left part of the outer surface, and the right part of the outer surface of the hollow shell subjected to piercing-rolling or elongating rolling are cooled within the cooling zone of a specific length. In this case, after a cooling fluid that is used for cooling is ejected toward the upper part of the outer surface, the lower part of the outer surface, the left part of the outer surface and the right part of the outer surface of the hollow shell inside the cooling zone to cool the hollow shell, the cooling fluid flows down to below the hollow shell and does not stay on the hollow shell. Therefore, the hollow shell is cooled by the cooling fluid inside the cooling zone, and it is difficult for the hollow shell to be subjected to cooling by the cooling fluid in a zone other than the cooling zone. Consequently, the time periods of cooling by the cooling fluid at respective locations in the axial direction of the hollow shell are uniform to a certain extent. Thus, the occurrence of a situation in which a temperature difference between the fore end portion and the rear end portion of a hollow shell is large due to cooling fluid accumulating at the inner surface of the hollow shell, which occurs when using the conventional technology, can be suppressed, and a temperature variation in the axial direction of the hollow shell can be reduced.

A piercing machine according to a configuration of (17) is in accordance with the piercing machine described in (16), wherein:

the outer surface cooling mechanism includes:

an outer surface cooling upper member disposed above the mandrel bar as seen from an advancing direction of the hollow shell, the outer surface cooling upper member including a plurality of cooling fluid upper-part ejection holes which eject the cooling fluid toward the upper part of the outer surface of the hollow shell in the cooling zone;

an outer surface cooling lower member disposed below the mandrel bar as seen from the advancing direction of the hollow shell, the outer surface cooling lower member including a plurality of cooling fluid lower-part ejection holes which eject the cooling fluid toward the lower part of the outer surface of the hollow shell in the cooling zone;

an outer surface cooling left member disposed leftward of the mandrel bar as seen from the advancing direction of the hollow shell, the outer surface cooling left member including a plurality of cooling fluid left-part ejection holes which eject the cooling fluid toward the left part of the outer surface of the hollow shell in the cooling zone; and an outer surface cooling right member disposed rightward of the mandrel bar as seen from the advancing direction of the hollow shell the outer surface cooling right member, including a plurality of cooling fluid right-part ejection holes which eject the cooling fluid toward the right part of the outer surface of the hollow shell in the cooling zone.

In the piercing machine according to the configuration of (17), the outer surface cooling mechanism ejects the cooling fluid toward the upper part of the outer surface of the hollow shell from an outer surface cooling upper member, ejects the cooling fluid toward the lower part of the outer surface of the hollow shell from an outer surface cooling lower member, ejects the cooling fluid toward the left part of the outer surface of the hollow shell from an outer surface cooling left member, and ejects the cooling fluid toward the right part of the hollow shell from an outer surface cooling right member, with the outer surface cooling upper member, the outer surface cooling lower member, the outer surface cooling left member and the outer surface cooling right member being disposed around the mandrel bar. By this means, with respect to the outer surface of the hollow shell that is inside the cooling zone, the upper part of the outer surface, the lower part of the outer surface, the left part of the outer surface and the right part of the outer surface of the hollow shell that are inside the cooling zone can be cooled. Further, it is easy for the cooling fluid ejected toward the upper part of the outer surface, the lower part of the outer surface, the left part of the outer surface and the right part of the outer surface of the hollow shell in the cooling zone to drop down naturally under the force of gravity, and it is difficult for the cooling fluid to flow out to the outside of the cooling zone. Therefore, the occurrence of a situation in which the upper part of the outer surface, the lower part of the outer surface, the left part of the outer surface or the right part of the outer surface of the hollow shell that is in a zone other than the cooling zone is cooled by cooling fluid ejected inside the cooling zone can be suppressed. As a result, temperature variations in the axial direction of the hollow shell can be reduced.

Note that, the outer surface cooling upper member, the outer surface cooling lower member, the outer surface cooling left member, and the outer surface cooling right member may each be a separate and independent member or may be integrally connected to each other. For example, as seen from the advancing direction of the hollow shell, a left edge of the outer surface cooling upper member and an upper edge of the outer surface cooling left member may be connected, and a right edge of the outer surface cooling upper member and an upper edge of the outer surface cooling right member may be connected. Further, as seen from the advancing direction of the hollow shell, a left edge of the outer surface cooling lower member and a lower edge of the outer surface cooling left member may be connected, and a right edge of the outer surface cooling lower member and a lower edge of the outer surface cooling right member may be connected. Furthermore, the outer surface cooling upper member may include a plurality of members that are separate and independent, the outer surface cooling lower member may include a plurality of members that are separate and independent, the outer surface cooling left member may include a plurality of members that are separate and independent, and the outer surface cooling right member may include a plurality of members that are separate and independent.

A piercing machine according to a configuration of (18) is in accordance with the piercing machine described in (16) to (17), further comprising:

a frontward damming mechanism that is disposed around the mandrel bar at a position that is rearward of the plug and is frontward of the outer surface cooling mechanism, wherein:

the frontward damming mechanism comprises a mechanism that, when the outer surface cooling mechanism is cooling the hollow shell in the cooling zone by ejecting the cooling fluid toward the upper part of the outer surface, the lower part of the outer surface, the left part of the outer surface and the right part of the outer surface of the hollow shell, dams the cooling fluid from flowing to the upper part of the outer surface, the lower part of the outer surface, the left part of the outer surface and the right part of the outer surface of the hollow shell before the hollow shell enters the cooling zone.

In the piercing machine according to the configuration of (18), after the cooling fluid ejected toward the upper part of the outer surface, the lower part of the outer surface, the left part of the outer surface and the right part of the outer surface of the hollow shell in the cooling zone comes in contact with the upper part of the outer surface, the lower part of the outer surface, the left part of the outer surface and the right part of the outer surface of the hollow shell, the frontward damming mechanism dams the cooling fluid from flowing to an outer surface portion of the hollow shell that is frontward of the cooling zone. Therefore, it is difficult for the cooling fluid ejected toward the outer surface of the hollow shell inside the cooling zone from the outer surface cooling mechanism to flow out in the frontward direction from inside the cooling zone, and the cooling fluid drops downward under the force of gravity inside the cooling zone. Thus, the occurrence of a temperature difference between the fore end portion and the rear end portion of the hollow shell can be further suppressed. As a result, a temperature variation in the axial direction of the hollow shell can be further reduced.

A piercing machine according to a configuration of (19) is in accordance with the piercing machine described in (18), wherein:

the frontward damming mechanism includes:

a frontward damming upper member including a plurality of frontward damming fluid upper-part ejection holes that is disposed above the mandrel bar as seen from an advancing direction of the hollow shell, and that ejects a frontward damming fluid toward the upper part of the outer surface of the hollow shell that is positioned in a vicinity of an entrance side of the cooling zone and dams the cooling fluid from flowing to the upper part of the outer surface of the hollow shell before the hollow shell enters the cooling zone;

a frontward damming left member including a plurality of frontward damming fluid lower-part ejection holes that is disposed leftward of the mandrel bar as seen from the advancing direction of the hollow shell, and that ejects the frontward damming fluid toward the left part of the outer surface of the hollow shell that is positioned in a vicinity of the entrance side of the cooling zone and dams the cooling fluid from flowing to the left part of the outer surface of the hollow shell before the hollow shell enters the cooling zone; and a frontward damming right member including a plurality of frontward damming fluid right-part ejection holes that is disposed rightward of the mandrel bar as seen from the advancing direction of the hollow shell, and that ejects the frontward damming fluid toward the right part of the outer surface of the hollow shell that is positioned in a vicinity of the entrance side of the cooling zone and dams the cooling fluid from flowing to the right part of the outer surface of the hollow shell before the hollow shell enters the cooling zone.

In the piercing machine according to the configuration of (19), the frontward damming upper member dams the cooling fluid that contacts the upper part of the outer surface of the hollow shell within the cooling zone and rebounds therefrom and attempts to fly out to a zone that is frontward of the cooling zone, by means of the frontward damming fluid that the frontward damming upper member ejects in the vicinity of the entrance side of the cooling zone. The frontward damming left member dams the cooling fluid that contacts the left part of the outer surface of the hollow shell within the cooling zone and rebounds therefrom and attempts to fly out to the zone that is frontward of the cooling zone, by means of the frontward damming fluid that the frontward damming left member ejects in the vicinity of the entrance side of the cooling zone. The frontward damming right member dams the cooling fluid that contacts the right part of the outer surface of the hollow shell within the cooling zone and rebounds therefrom and attempts to fly out to the zone that is frontward of the cooling zone, by means of the frontward damming fluid that the frontward damming right member ejects in the vicinity of the entrance side of the cooling zone. Therefore, the frontward damming fluid ejected from the frontward damming upper member, the frontward damming fluid ejected from the frontward damming left member, and the frontward damming fluid ejected from the frontward damming right member act as dams (protective walls). Thus, contact of the cooling fluid with the outer surface portion of the hollow shell that is frontward of the cooling zone can be suppressed, and a temperature variation in the axial direction of the hollow shell can be reduced. Note that, the cooling fluid ejected toward the lower part of the outer surface of the hollow shell inside the cooling zone from the outer surface cooling mechanism easily drops down naturally to below the hollow shell under the force of gravity after contacting the lower part of the outer surface of the hollow shell. Therefore, the piercing machine according to the configuration of (19) need not include a frontward damming lower member.

Note that the phrase "vicinity of the entrance side of the cooling zone" means the vicinity of the fore end of the cooling zone. Although the range of the vicinity of the entrance side of the cooling zone is not particularly limited, for example, the phrase means a range within 1000 mm before and after the entrance side (fore end) of the cooling zone, and preferably means a range within 500 mm before and after the entrance side (fore end) of the cooling zone.

A piercing machine according to a configuration of (20) is in accordance with the piercing machine described in (19), wherein:

the frontward damming upper member ejects the frontward damming fluid diagonally rearward toward the upper part of the outer surface of the hollow shell that is positioned in a vicinity of the entrance side of the cooling zone from a plurality of the frontward damming fluid upper-part ejection holes;

the frontward damming left member ejects the frontward damming fluid diagonally rearward toward the left part of the outer surface of the hollow shell that is positioned in a vicinity of the entrance side of the cooling zone from a plurality of the frontward damming fluid left-part ejection holes; and the frontward damming right member ejects the frontward damming fluid diagonally rearward toward the right part of the outer surface of the hollow shell that is positioned in a vicinity of the entrance side of the cooling zone from a plurality of the frontward damming fluid right-part ejection holes.

In the piercing machine according to the configuration of (20), the frontward damming upper member ejects the frontward damming fluid diagonally rearward toward the upper part of the outer surface of the hollow shell in the vicinity of the entrance side of the cooling zone from the frontward damming fluid upper-part ejection holes. Therefore, the frontward damming upper member forms a dam (protective wall) of frontward damming fluid that extends diagonally rearward toward the upper part of the outer surface of the hollow shell from above. Similarly, the frontward damming left member ejects the frontward damming fluid diagonally rearward toward the left part of the outer surface of the hollow shell in the vicinity of the entrance side of the cooling zone from the frontward damming fluid left-part ejection holes. Therefore, the frontward damming left member forms a dam (protective wall) of frontward damming fluid that extends diagonally rearward toward the left part of the outer surface of the hollow shell from the left direction. Similarly, the frontward damming right member ejects the frontward damming fluid diagonally rearward toward the right part of the outer surface of the hollow shell in the vicinity of the entrance side of the cooling zone from the frontward damming fluid right-part ejection holes. Therefore, the frontward damming right member forms a dam (protective wall) of frontward damming fluid that extends diagonally rearward toward the right part of the outer surface of the hollow shell from the right direction. These dams dam the cooling fluid that contacts the outer surface portion of the hollow shell within the cooling zone and rebounds therefrom and attempts to fly out to the zone that is frontward of the cooling zone. In addition, after the frontward damming fluid constituting the dams contacts the outer surface portion of the hollow shell in the vicinity of the entrance side of the cooling zone, the frontward damming fluid easily flows into the cooling zone. Therefore, the occurrence of a situation in which the frontward damming fluid constituting the dams cools the outer surface portion of the hollow shell that is frontward of the cooling zone can be suppressed.

A piercing machine according to a configuration of (21) is in accordance with the piercing machine described in (19) or (20), wherein:

the frontward damming mechanism further includes:

a frontward damming lower member including a plurality of frontward damming fluid lower-part ejection holes that is disposed below the mandrel bar as seen from the advancing direction of the hollow shell, and that ejects the frontward damming fluid toward the lower part of the outer surface of the hollow shell that is positioned in a vicinity of the entrance side of the cooling zone and dams the cooling fluid from flowing to the lower part of the outer surface of the hollow shell before the hollow shell enters the cooling zone.

In the piercing machine according to the configuration of (21), together with the frontward damming upper member, the frontward damming left member and the frontward damming right member, the frontward damming lower member ejects the frontward damming fluid in the vicinity of the entrance side of the cooling zone and dams the cooling fluid that contacts the lower part of the outer surface of the hollow shell within the cooling zone and rebounds therefrom and attempts to fly out to the zone that is frontward of the cooling zone. Therefore, contact of the cooling fluid with the outer surface portion of the hollow shell that is frontward of the cooling zone can be further suppressed, and a temperature variation in the axial direction of the hollow shell can be further reduced.

Note that, the frontward damming upper member, the frontward damming lower member, the frontward damming left member, and the frontward damming right member may each be a separate and independent member or may be integrally connected to each other. For example, as seen from the advancing direction of the hollow shell, a left edge of the frontward damming upper member and an upper edge of the frontward damming left member may be connected, and a right edge of the frontward damming upper member and an upper edge of the frontward damming right member may be connected. Further, as seen from the advancing direction of the hollow shell, a left edge of the frontward damming lower member and a lower edge of the frontward damming left member may be connected, and a right edge of the frontward damming lower member and a lower edge of the frontward damming right member may be connected. Furthermore, the frontward damming upper member may include a plurality of members that are separate and independent, the frontward damming lower member may include a plurality of members that are separate and independent, the frontward damming left member may include a plurality of members that are separate and independent, and the frontward damming right member may include a plurality of members that are separate and independent.

A piercing machine according to a configuration of (22) is in accordance with the piercing machine according to the configuration of (21), wherein:

the frontward damming lower member ejects the frontward damming fluid diagonally rearward toward the lower part of the outer surface of the hollow shell that is positioned in a vicinity of the entrance side of the cooling zone from a plurality of the frontward damming fluid lower-part ejection holes.

In the piercing machine according to the configuration of (22), together with the frontward damming upper member, the frontward damming left member and the frontward damming right member, the frontward damming lower member ejects the frontward damming fluid diagonally rearward toward the lower part of the outer surface of the hollow shell in the vicinity of the entrance side of the cooling zone from the frontward damming fluid lower-part ejection holes. Therefore, the frontward damming lower member forms a dam (protective wall) of frontward damming fluid that extends diagonally rearward toward the lower part of the outer surface of the hollow shell from below. These dams dam cooling fluid that contacts the outer surface portion of the hollow shell within the cooling zone and rebounds therefrom and attempts to fly out to the zone that is frontward of the cooling zone. In addition, after the frontward damming fluid constituting the dams contacts the outer surface portion of the hollow shell in the vicinity of the entrance side of the cooling zone, the frontward damming fluid easily flows into the cooling zone. Therefore, the occurrence of a situation in which the frontward damming fluid constituting the dams cools the outer surface portion of the hollow shell that is frontward of the cooling zone can be suppressed.

A piercing machine according to a configuration of (23) is in accordance with the piercing machine described in any one of (16) to (22), further comprising:

a rearward damming mechanism that is disposed around the mandrel bar at a position that is rearward of the outer surface cooling mechanism, wherein:

the rearward damming mechanism comprises a mechanism that, when the outer surface cooling mechanism is cooling the hollow shell by ejecting the cooling fluid toward the upper part of the outer surface, the lower part of the outer surface, the left part of the outer surface and the right part of the outer surface of the hollow shell, dams the cooling fluid from flowing to the upper part of the outer surface, the lower part of the outer surface, the left part of the outer surface and the right part of the outer surface of the hollow shell after the hollow shell leaves from the cooling zone.

In the piercing machine according to the configuration of (23), after the cooling fluid ejected toward the upper part of the outer surface, lower part of the outer surface, left part of the outer surface and right part of the outer surface of the hollow shell in the cooling zone comes in contact with the upper part of the outer surface, the lower part of the outer surface, the left part of the outer surface and the right part of the outer surface of the hollow shell, the rearward damming mechanism dams the cooling fluid from flowing to the outer surface portion of the hollow shell after the hollow shell leaves from the cooling zone. Thus, the occurrence of a temperature difference between the fore end portion and the rear end portion of the hollow shell can be further suppressed. As a result, a temperature variation in the axial direction of the hollow shell can be further reduced.

A piercing machine according to a configuration of (24) is in accordance with the piercing machine described in (23), wherein:

the rearward damming mechanism includes:

a rearward damming upper member including a plurality of rearward damming fluid upper-part ejection holes that is disposed above the mandrel bar as seen from the advancing direction of the hollow shell, and that ejects a rearward damming fluid toward the upper part of the outer surface of the hollow shell that is positioned in a vicinity of a delivery side of the cooling zone and dams the cooling fluid from flowing to the upper part of the outer surface of the hollow shell after the hollow shell leaves from the cooling zone;

a rearward damming left member including a plurality of rearward damming fluid left-part ejection holes that is disposed leftward of the mandrel bar as seen from the advancing direction of the hollow shell, and that ejects the rearward damming fluid toward the left part of the outer surface of the hollow shell that is positioned in a vicinity of the delivery side of the cooling zone and dams the cooling fluid from flowing to the left part of the outer surface of the hollow shell after the hollow shell leaves from the cooling zone; and a rearward damming right member including a plurality of rearward damming fluid right-part ejection holes that is disposed rightward of the mandrel bar as seen from the advancing direction of the hollow shell, and that ejects the rearward damming fluid toward the right part of the outer surface of the hollow shell that is positioned in a vicinity of the delivery side of the cooling zone and dams the cooling fluid from flowing to the right part of the outer surface of the hollow shell after the hollow shell leaves from the cooling zone.

In the piercing machine according to the configuration of (24), the rearward damming upper member dams cooling fluid that contacts the upper part of the outer surface of the hollow shell within the cooling zone and rebounds therefrom and attempts to fly out to a zone that is rearward of the cooling zone, by means of the rearward damming fluid that the rearward damming upper member ejects in the vicinity of the delivery side of the cooling zone. The rearward damming left member dams cooling fluid that contacts the left part of the outer surface of the hollow shell within the cooling zone and rebounds therefrom and attempts to fly out to the zone that is rearward of the cooling zone, by means of the rearward damming fluid that the rearward damming left member ejects in the vicinity of the delivery side of the cooling zone. The rearward damming right member dams cooling fluid that contacts the right part of the outer surface of the hollow shell within the cooling zone and rebounds therefrom and attempts to fly out the zone that is rearward of the cooling zone, by means of the rearward damming fluid that the rearward damming right member ejects in the vicinity of the delivery side of the cooling zone. Therefore, the rearward damming fluid ejected from the rearward damming upper member, the rearward damming fluid ejected from the rearward damming left member, and the rearward damming fluid ejected from the rearward damming right member act as dams (protective walls). Thus, contact of the cooling fluid with the outer surface portion of the hollow shell in the zone that is rearward of the cooling zone can be suppressed, and temperature variations in the axial direction of the hollow shell can be reduced. Note that, the cooling fluid ejected toward the lower part of the outer surface of the hollow shell inside the cooling zone from the outer surface cooling mechanism easily drops down naturally to below the hollow shell under the force of gravity after contacting the lower part of the outer surface of the hollow shell. Therefore, the piercing machine according to the configuration of (24) need not include a rearward damming lower member.

Note that the phrase "vicinity of the delivery side of the cooling zone" means the vicinity of the rear end of the cooling zone. Although the range of the vicinity of the delivery side of the cooling zone is not particularly limited, for example, the phrase means a range within 1000 mm before and after the delivery side (rear end) of the cooling zone, and preferably means a range within 500 mm before and after the delivery side (rear end) of the cooling zone.

A piercing machine according to a configuration of (25) is in accordance with the piercing machine described in (24), wherein:

the rearward damming upper member ejects the rearward damming fluid diagonally frontward toward the upper part of the outer surface of the hollow shell that is positioned in a vicinity of the delivery side of the cooling zone from the plurality of the rearward damming fluid upper-part ejection holes;

the rearward damming left member ejects the rearward damming fluid diagonally frontward toward the left part of the outer surface of the hollow shell that is positioned in a vicinity of the delivery side of the cooling zone from the plurality of the rearward damming fluid left-part ejection holes; and the rearward damming right member ejects the rearward damming fluid diagonally frontward toward the right part of the outer surface of the hollow shell that is positioned in a vicinity of the delivery side of the cooling zone from the plurality of the rearward damming fluid right-part ejection holes.

In the piercing machine according to the configuration of (25), the rearward damming upper member ejects the rearward damming fluid diagonally frontward toward the upper part of the outer surface of the hollow shell in the vicinity of the delivery side of the cooling zone from the rearward damming fluid upper-part ejection holes. Therefore, the rearward damming upper member forms a dam (protective wall) of rearward damming fluid that extends diagonally frontward toward the upper part of the outer surface of the hollow shell from above. Similarly, the rearward damming left member ejects the rearward damming fluid diagonally frontward toward the left part of the outer surface of the hollow shell in the vicinity of the delivery side of the cooling zone from the rearward damming fluid left-part ejection holes. Therefore, the rearward damming left member forms a dam (protective wall) of rearward damming fluid that extends diagonally frontward toward the left part of the outer surface of the hollow shell from the left direction. Similarly, the rearward damming right member ejects the rearward damming fluid diagonally frontward toward the right part of the outer surface of the hollow shell in the vicinity of the delivery side of the cooling zone from the rearward damming fluid right-part ejection holes. Therefore, the rearward damming right member forms a dam (protective wall) of rearward damming fluid that extends diagonally frontward toward the right part of the outer surface of the hollow shell from the right direction. These dams of rearward damming fluid dam the cooling fluid that contacts an outer surface portion of the hollow shell within the cooling zone and rebounds therefrom and attempts to fly out to the zone that is rearward of the cooling zone. In addition, after the rearward damming fluid constituting the dams contacts the outer surface portion of the hollow shell in the vicinity of the delivery side of the cooling zone, the rearward damming fluid easily flows into the cooling zone. Therefore, the occurrence of a situation in which the rearward damming fluid constituting the dams cools the outer surface portion of the hollow shell at a position that is rearward of the cooling zone can be suppressed.

A piercing machine according to a configuration of (26) is in accordance with the piercing machine described in (24) or (25), wherein:

the rearward damming mechanism further includes:

a rearward damming lower member including a plurality of rearward damming fluid lower-part ejection holes that is disposed below the mandrel bar as seen from the advancing direction of the hollow shell, and that ejects the rearward damming fluid toward the lower part of the outer surface of the hollow shell that is positioned in a vicinity of the delivery side of the cooling zone and dams the cooling fluid from flowing to the lower part of the outer surface of the hollow shell after the hollow shell leaves from the cooling zone.

In the piercing machine according to the configuration of (26), together with the rearward damming upper member, the rearward damming left member and the rearward damming right member, the rearward damming lower member ejects the rearward damming fluid in the vicinity of the delivery side of the cooling zone and dams the cooling fluid that contacts the lower part of the outer surface of the hollow shell within the cooling zone and rebounds therefrom and attempts to fly out to the zone that is rearward of the cooling zone. Therefore, contact of the cooling fluid with the outer surface portion of the hollow shell at a position that is rearward of the cooling zone can be suppressed, and temperature variations in the axial direction of the hollow shell can be further reduced.

Note that, the rearward damming upper member, the rearward damming lower member, the rearward damming left member and the rearward damming right member may each be a separate and independent member or may be integrally connected to each other. For example, as seen from the advancing direction of the hollow shell, a left edge of the rearward damming upper member and an upper edge of the rearward damming left member may be connected, and a right edge of the rearward damming upper member and an upper edge of the rearward damming right member may be connected. Further, as seen from the advancing direction of the hollow shell, a left edge of the rearward damming lower member and a lower edge of the rearward damming left member may be connected, and a right edge of the rearward damming lower member and the lower edge of the rearward damming right member may be connected. Furthermore, the rearward damming upper member may include a plurality of members that are separate and independent, the rearward damming lower member may include a plurality of members that are separate and independent, the rearward damming left member may include a plurality of members that are separate and independent, and the rearward damming right member may include a plurality of members that are separate and independent.

A piercing machine according to a configuration of (27) is in accordance with the piercing machine according to the configuration of (26), wherein:

the rearward damming lower member ejects the rearward damming fluid diagonally frontward toward the lower part of the outer surface of the hollow shell that is positioned in a vicinity of the delivery side of the cooling zone from the plurality of the rearward damming fluid lower-part ejection holes.

In the piercing machine according to the configuration of (27), together with the rearward damming upper member, the rearward damming left member and the rearward damming right member, the rearward damming lower member ejects the rearward damming fluid diagonally frontward toward the lower part of the outer surface of the hollow shell in the vicinity of the delivery side of the cooling zone from the rearward damming fluid lower-part ejection holes. Therefore, the rearward damming lower member forms a dam (protective wall) of rearward damming fluid that extends diagonally frontward toward the lower part of the outer surface of the hollow shell from below. These dams dam the cooling fluid that contacts the outer surface portion of the hollow shell within the cooling zone and rebounds therefrom and attempts to fly out to the zone that is rearward of the cooling zone. In addition, after the rearward damming fluid constituting the dams contacts the outer surface portion of the hollow shell in the vicinity of the delivery side of the cooling zone, the rearward damming fluid easily flows into the cooling zone. Therefore, the occurrence of a situation in which the rearward damming fluid constituting the dams cools the outer surface portion of the hollow shell at a position that is rearward of the cooling zone can be suppressed.

A mandrel bar according to a configuration of (28) is in accordance with the mandrel bar described in any one of (1) to (27).

A method for producing a seamless metal pipe according to a configuration of (29) is a method for producing a seamless metal pipe using the piercing machine described in any one of (1) to (27), comprising:

a rolling process of subjecting the material to piercing-rolling or elongating rolling using the piercing machine to produce a hollow shell, and a process of, during the rolling process, ejecting the coolant to outside of the bar body by means of the inner surface cooling mechanism to cool the inner surface of the hollow shell within the cooling zone, and by means of an inner surface damming mechanism that is disposed adjacent to the cooling zone on a rearward side of the cooling zone, suppressing contact of the coolant ejected to outside of the bar body with the inner surface of the hollow shell after the hollow shell leaves from the cooling zone.

Hereunder, embodiments of the present invention are described in detail with reference to the accompanying drawings. The same or equivalent portions in the drawings are denoted by the same reference characters, and a description of such portions is not repeated.

First Embodiment

FIG. 1 is a side view of a piercing machine according to a first embodiment. As mentioned above, in the present description the term "piercing machine" means a rolling mill that includes a plug and a plurality of skewed rolls. The piercing machine is, for example, a piercing mill that subjects a round billet to piercing-rolling, or is an elongator that subjects a hollow shell to elongating rolling. In the present description, in a case where the piercing machine is a piercing mill, the material is a round billet. In a case where the piercing machine is an elongator, the material is a hollow shell.

In the present description, a material advances along a pass line from the frontward side to the rearward side of the piercing machine. Therefore, with respect to the piercing machine, the entrance side of the piercing machine corresponds to "frontward", and the delivery side of the piercing machine corresponds to "rearward".

Referring to FIG. 1, a piercing machine 10 includes a plurality of skewed rolls 1, a plug 2 and a mandrel bar 3. In the present description, as illustrated in FIG. 1, the entrance side of the piercing machine 10 is defined as "frontward (F in FIG. 1)," and the delivery side of the piercing machine 10 is defined as "rearward (B in FIG. 1)".

Figure 2:
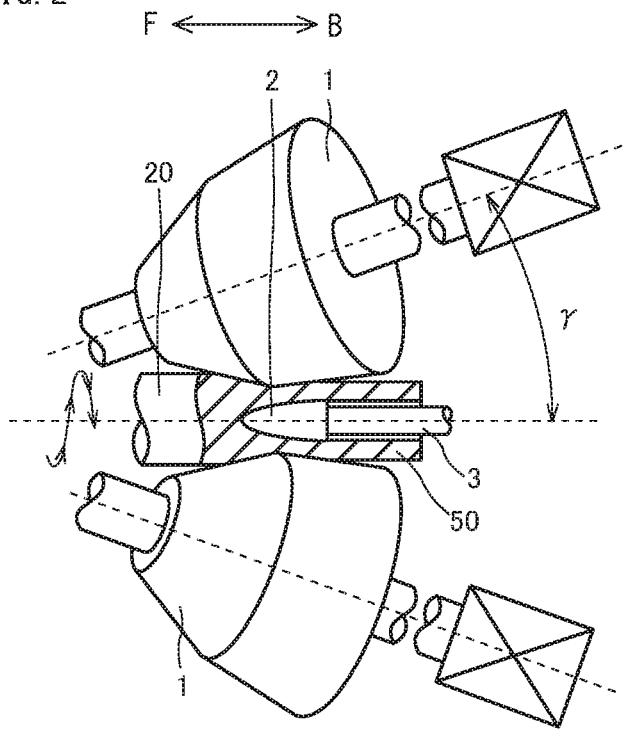
FIG. 2 is an enlarged view of a portion in the vicinity of skewed rolls in FIG. 1.

The plurality of skewed rolls 1 are disposed around a pass line PL. In FIG. 1, the pass line PL is disposed between one pair of the skewed rolls 1. Here, the term "pass line PL" means an imaginary line segment along which the central axis of a material (a round billet in a case where the piercing machine is a piercing mill, and a hollow shell in a case where the piercing machine is an elongator) 20 passes during piercing-rolling or elongating rolling. In FIG. 1, the skewed rolls 1 are cone-shaped skewed rolls. However, the skewed rolls 1 are not limited to the cone-shaped skewed rolls. The skewed rolls 1 may be barrel-type skewed rolls, or may be skewed rolls of another type. Further, although in FIG. 1 two of the skewed rolls 1 are disposed around the pass line PL, three or more of the skewed rolls 1 may be disposed around the pass line PL. Preferably, the plurality of skewed rolls 1 are disposed at regular intervals around the pass line PL, as seen from an advancing direction of the material. For example, in a case where two of the skewed rolls 1 are disposed around the pass line PL, as seen from the advancing direction of the material, the skewed rolls 1 are disposed at intervals of 180° around the pass line PL. In a case where three of the skewed rolls 1 are disposed around the pass line PL, as seen from the advancing direction of the material, the skewed rolls 1 are disposed at intervals of 120° around the pass line PL. Furthermore, referring to FIG. 2 and FIG. 3, each of the skewed rolls 1 has a toe angle $\gamma$ (see FIG. 2) and a feed angle $\beta$ (see FIG. 3) with respect to the pass line PL.

The plug 2 is disposed on the pass line PL, between the plurality of skewed rolls 1. In the present description, the phrase "the plug 2 is disposed on the pass line PL" means that, when seen from the advancing direction of the material, that is, when the piercing machine 10 is seen in the direction from the frontward F side to the rearward B side, the plug 2 overlaps with the pass line PL. More preferably, the central axis of the plug 2 coincides with the pass line PL.

The plug 2 has, for example, a bullet shape. That is, the external diameter of the front part of the plug 2 is smaller than the external diameter of the rear part of the plug 2. Here, the phrase "front part of the plug 2" means a portion that is more frontward than the center position in the longitudinal direction (axial direction) of the plug 2. The phrase "rear part of the plug 2" means a portion that is more rearward than the center position in the front-rear direction of the plug 2. The front part of the plug 2 is disposed on the frontward side (entrance side) of the piercing machine 10, and the rear part of the plug 2 is disposed on the rearward side (delivery side) of the piercing machine 10.

The mandrel bar 3 is disposed on the pass line PL on the rearward side of the piercing machine 10, and extends along the pass line PL. Here, the phrase "the mandrel bar 3 is disposed on the pass line PL" means that, when seen from the advancing direction of the material (that is, when seen in the direction from the entrance side toward the delivery side of the piercing machine 10), the mandrel bar 3 overlaps with the pass line PL. More preferably, the central axis of the mandrel bar 3 coincides with the pass line PL.

The fore end of the mandrel bar 3 is connected to a central part of the rear end face of the plug 2. The connection method is not particularly limited. For example, a screw thread is formed at the central part of the rear end face of the plug 2 and at the fore end of the mandrel bar 3, and the mandrel bar 3 is connected to the plug 2 by these screw threads. The mandrel bar 3 may be connected to the central part of the rear end face of the plug 2 by a method other than a method that uses screw threads. In other words, the method for connecting the mandrel bar 3 and the plug 2 is not particularly limited.

The piercing machine 10 may further include a pusher 4. The pusher 4 is disposed at the frontward side of the piercing machine 10, and is disposed on the pass line PL. The pusher 4 contacts the end face of the material 20, and pushes the material 20 forward toward the plug 2.

The configuration of the pusher 4 is not particularly limited as long as the pusher 4 can push the material 20 forward toward the plug 2. For example, as illustrated in FIG. 1, the pusher 4 includes a cylinder body 41, a cylinder shaft 42, a connection member 43 and a rod 44. The rod 44 is connected to the cylinder shaft 42 by the connection member 43 so as to be rotatable in the circumferential direction. The connection member 43, for example, includes a bearing for making the rod 44 rotatable in the circumferential direction.

The cylinder body 41 is of a hydraulic type or an electric motor-driven type, and causes the cylinder shaft 42 to advance and retreat. The pusher 4 causes the end face of the rod 44 to butt against the end face of the material (round billet or hollow shell) 20, and causes the cylinder shaft 42 and the rod 44 to advance by means of the cylinder body 41. By this means, the pusher 4 pushes the material 20 forward toward the plug 2.

The pusher 4 pushes the material 20 forward along the pass line PL to push the material 20 between the plurality of skewed rolls 1. When the material 20 contacts the plurality of skewed rolls 1, the plurality of skewed rolls 1 press the material 20 against the plug 2 while causing the material 20 to rotate in the circumferential direction. In a case where the piercing machine 10 is a piercing mill, the plurality of skewed rolls 1 press a round billet that is the material 20 against the plug 2 while causing the round billet to rotate in the circumferential direction to thereby perform piercing-rolling to produce a hollow shell. In a case where the piercing machine 10 is an elongator, the plurality of skewed rolls 1 insert the plug 2 into the hollow shell that is the material 20 and perform elongating rolling (expansion rolling) to elongate the hollow shell. Note that the piercing machine 10 need not include the pusher 4.

Figure 3:
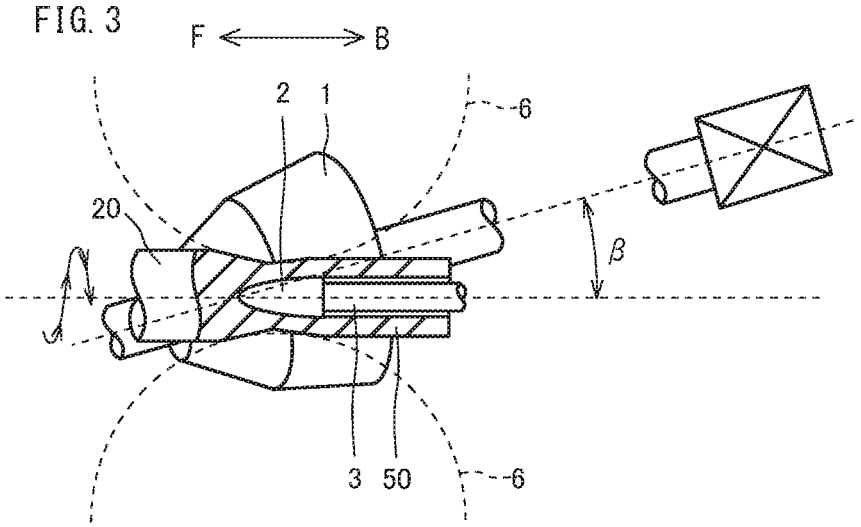
FIG. 3 is an enlarged view of the portion in the vicinity of the skewed rolls in FIG. 1 when seen from a different direction from FIG. 2.

The piercing machine 10 may further include an entry trough 5. The material (round billet or hollow shell) 20 is placed in the entry trough 5 prior to undergoing piercing-rolling. As illustrated in FIG. 3, the piercing machine 10 may also include a plurality of guide rolls 6 around the pass line PL. The plug 2 is disposed between the plurality of guide rolls 6. The guide rolls 6 are disposed between the plurality of skewed rolls 1, around the pass line PL. The guide rolls 6 are, for example, disk rolls. Note that the piercing machine 10 need not include the entry trough 5, and need not include the guide rolls 6.

Figure 4:
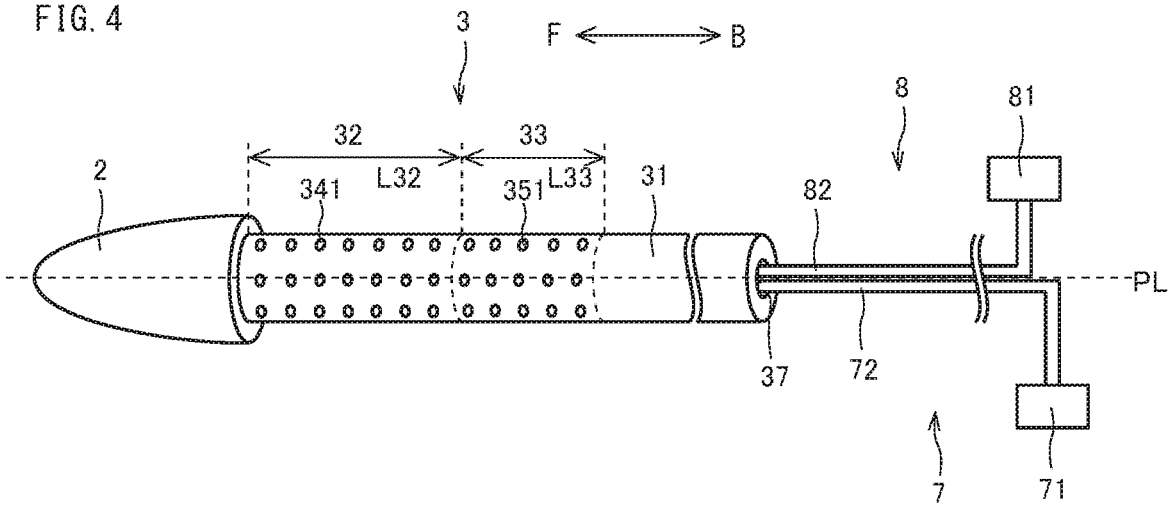
FIG. 4 is an enlarged view of a plug 2 and a mandrel bar 3 illustrated in FIG. 1.

FIG. 4 is an enlarged view of the plug 2 and the mandrel bar 3 shown in FIG. 1. Referring to FIG. 4, the piercing machine 10 receives a supply of coolant from a coolant supply device 7. The coolant supply device 7 supplies coolant for cooling the inner surface of a hollow shell 50 which is being subjected to piercing-rolling or elongating rolling to the mandrel bar 3. The coolant supply device 7 includes a supply machine 71 and a pipe 72. The supply machine 71, for example, includes a storage tank that stores coolant, and a pump that supplies coolant that is inside the storage tank to the pipe 72. The pipe 72 connects the mandrel bar 3 and the supply machine 71. The pipe 72 conveys the coolant that is sent from the supply machine 71 to the mandrel bar 3. The coolant is not particularly limited as long as the coolant is a fluid that is capable of cooling the hollow shell 50. Preferably, the coolant is water.

[Structure of mandrel bar 3]

Referring to FIG. 4, the mandrel bar 3 extends along the pass line PL from the central part of the rear end face of the plug 2. The mandrel bar 3 includes a rod-shaped bar body 31. The sectional shape perpendicular to the axial direction (longitudinal direction, direction corresponding to arrows F and B in FIG. 4) of the bar body 31 is, for example, a circular shape. The bar body 31 includes a cooling zone 32 and a contact suppression zone 33 that extend in the axial direction of the bar body 31.

The cooling zone 32 is disposed at a fore end portion of the bar body 31. Specifically, the cooling zone 32 is an area from the fore end of the bar body 31 (that is, the position at which the bar body 31 connects with the rear end of the plug 2) to a position separated by a specific length therefrom in the rearward direction of the mandrel bar 3. An axial direction length L32 of the cooling zone 32 is not particularly limited. The axial direction length L32 of the cooling zone 32 is, for example, not less than 1/10 and not more than 1/2 of the overall length of the mandrel bar 3. According to another example, in a case where the length of the hollow shell to be produced is 6 m, the axial direction length L32 of the cooling zone 32 is, for example, 2 m.

The contact suppression zone 33 is disposed at a position that is adjacent to the cooling zone 32 on the rearward side of the cooling zone 32 (opposite side to the plug 2). A length L33 of the contact suppression zone 33 is not particularly limited. The length L33 of the contact suppression zone 33 may be the same length as the length L32 of the cooling zone 32, or may be longer than or shorter than the length L32 of the cooling zone 32. The contact suppression zone 33 may also be the portion of the bar body 31 that is other than the cooling zone 32.

Figure 5:
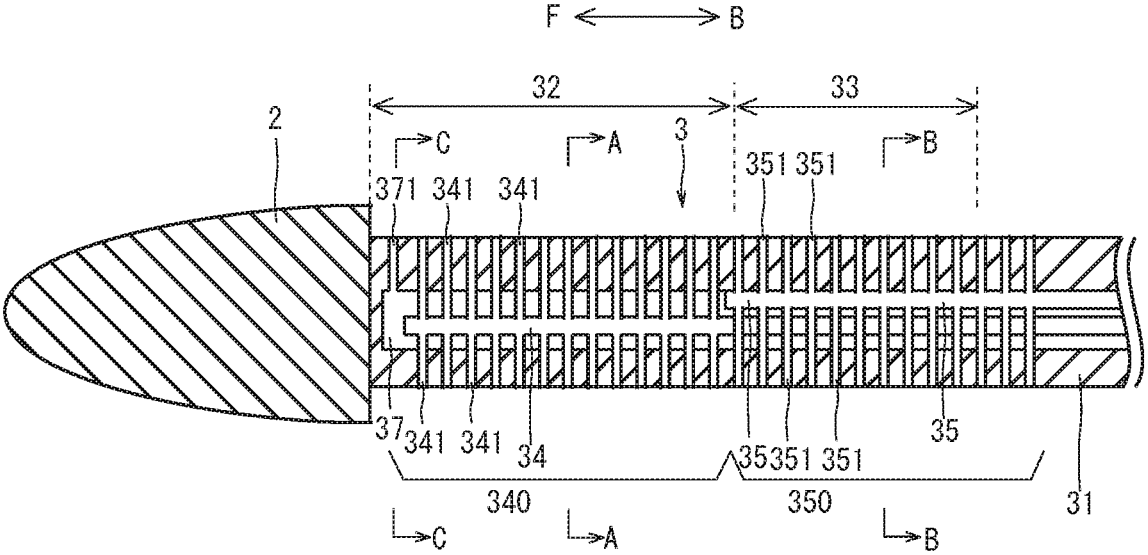
FIG. 5 is a sectional drawing (longitudinal sectional drawing) including a central axis of the plug 2 and the mandrel bar 3 illustrated in FIG. 4.

FIG. 5 is a sectional drawing (longitudinal sectional drawing) that includes the central axes of the plug 2 and the mandrel bar 3 illustrated in FIG. 4. Referring to FIG. 5, the mandrel bar 3 further includes a coolant channel 34 and an inner surface cooling mechanism 340. The coolant channel 34 is formed inside the bar body 31, and allows the coolant that is supplied from the coolant supply device 7 to pass therethrough. The coolant channel 34 extends through the inside of the bar body 31, along the axial direction of the bar body 31. The coolant channel 34 is connected to the pipe 72, and receives a supply of coolant from the pipe 72.

The inner surface cooling mechanism 340 is disposed inside the cooling zone 32 that corresponds to the fore end portion of the bar body 31. In the present example, the inner surface cooling mechanism 340 includes a plurality of coolant ejection holes 341. The plurality of coolant ejection holes 341 are connected to the coolant channel 34, and during piercing-rolling or during elongating rolling, the coolant ejection holes 341 eject the coolant to the outside of the cooling zone 32. In FIG. 4 and FIG. 5, the plurality of coolant ejection holes 341 are arrayed in the circumferential direction and the axial direction of the bar body 31. However, the plurality of coolant ejection holes 341 may be arrayed in the circumferential direction of the bar body 31, or may be arrayed in the circumferential direction and the axial direction of the bar body 31. For example, the plurality of coolant ejection holes 341 may be arrayed in the circumferential direction and need not be arrayed in the axial direction. Preferably, the plurality of coolant ejection holes 341 are arrayed in the circumferential direction and/or the axial direction of the bar body 31. As will be described later, the inner surface cooling mechanism 340 includes a plurality of ejection nozzles, and each ejection nozzle has a coolant ejection hole 341.

The mandrel bar 3 also includes an inner surface damming mechanism 350. The inner surface damming mechanism 350 is disposed within the contact suppression zone 33. During piercing-rolling or during elongating rolling, the inner surface damming mechanism 350 ejects compressed gas from the contact suppression zone 33 to thereby dam and blow away coolant that attempts to flow rearward from the cooling zone 32. By this means, during piercing-rolling or during elongating rolling, contact of coolant with an inner surface portion of the hollow shell that is inside the contact suppression zone 33 is suppressed.

Specifically, as illustrated in FIG. 4, the piercing machine 10 also receives a supply of compressed gas from a gas supply device 8. The gas supply device 8 supplies compressed gas for blowing away coolant, to the bar body 31. The gas supply device 8 includes, for example, an accumulator 81 that accumulates high pressure gas, and a pipe 82. The pipe 82 connects the accumulator 81 and the bar body 31. The pipe 82 conveys compressed gas sent from the accumulator 81, to the bar body 31. The compressed gas may be, for example, compressed air, or may be an inert gas such as argon gas or nitrogen gas. Preferably, the compressed gas is compressed air.

Referring to FIG. 5, the mandrel bar 3 includes a gas channel 35. The gas channel 35 extends through the inside of the bar body 31, along the axial direction of the bar body 31. The gas channel 35 is connected to the pipe 82 (see FIG. 4), and receives a supply of compressed gas from the pipe 82.

The inner surface damming mechanism 350 includes a plurality of compressed gas ejection holes 351. The plurality of compressed gas ejection holes 351 are connected to the gas channel 35, and during piercing-rolling or during elongating rolling, the plurality of compressed gas ejection holes 351 eject compressed gas to the outside of the contact suppression zone 33. In FIG. 4 and FIG. 5, the plurality of compressed gas ejection holes 351 are arrayed in the circumferential direction and the axial direction of the bar body 31. However, the plurality of compressed gas ejection holes 351 may be arrayed in the circumferential direction of the bar body 31, or may be arrayed in the circumferential direction and the axial direction of the bar body 31. Specifically, the plurality of compressed gas ejection holes 351 are arrayed in the circumferential direction, and need not be arrayed in the axial direction. Preferably, the plurality of compressed gas ejection holes 351 are arrayed in the circumferential direction and/or the axial direction of the bar body 31. As will be described later, the inner surface damming mechanism 350 includes a plurality of ejection nozzles, and each ejection nozzle has a compressed gas ejection hole 351.

Figure 6:
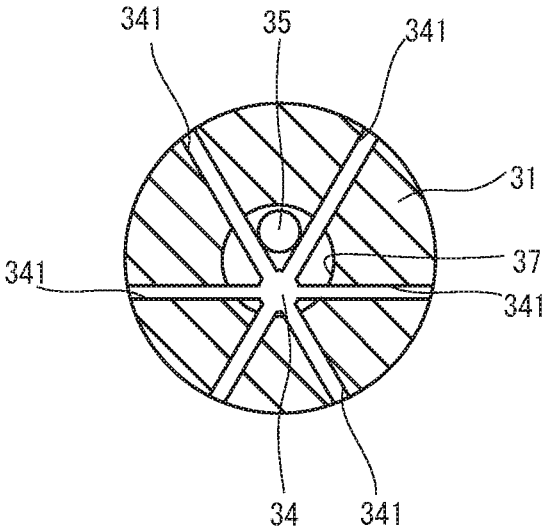
FIG. 6 is a sectional drawing along a line segment A-A in FIG. 5.

FIG. 6 is a sectional drawing along a cross section perpendicular to the axial direction of the mandrel bar 3, which is a sectional drawing along a line segment A-A in the cooling zone 32 shown in FIG. 5. Referring to FIG. 6, the coolant channel 34 is disposed at the center part of the bar body 31, side by side with the gas channel 35. A plurality of the coolant ejection holes 341 are arrayed in the circumferential direction of the bar body 31. The plurality of coolant ejection holes 341 may be arrayed at regular intervals in the circumferential direction of the bar body 31, or may be arrayed irregularly in the circumferential direction thereof. Preferably, the coolant ejection holes 341 are arrayed at regular intervals in the circumferential direction of the bar body 31. Each of the coolant ejection holes 341 is connected to the coolant channel 34. As illustrated in FIG. 5 and FIG. 6, in the present embodiment, inside the cooling zone 32, the plurality of coolant ejection holes 341 are arrayed in the circumferential direction and the axial direction of the bar body 31. However, it suffices that the plurality of coolant ejection holes 341 are arrayed in at least the circumferential direction of the bar body 31.

Figure 7:
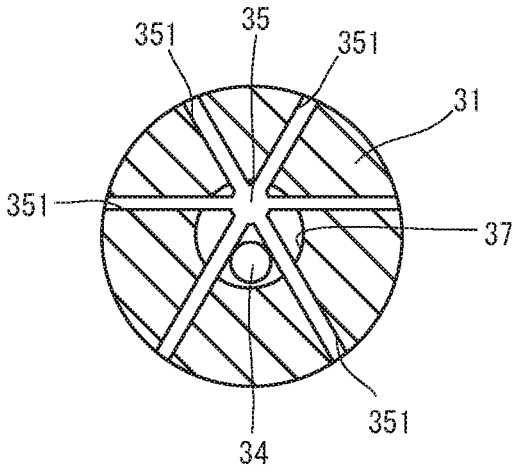
FIG. 7 is a sectional drawing along a line segment B-B in FIG. 5.

FIG. 7 is a sectional drawing along a cross section perpendicular to the axial direction of the mandrel bar 3, which is a sectional drawing along a line segment B-B in the contact suppression zone 33 shown in FIG. 5. Referring to FIG. 7, similarly to the sectional drawing of the inside of the cooling zone 32 (FIG. 6), in the sectional drawing of the inside of the contact suppression zone 33, the gas channel 35 is disposed at the center part of the bar body 31, side by side with the coolant channel 34. A plurality of the compressed gas ejection holes 351 are arrayed in the circumferential direction of the bar body 31. The plurality of compressed gas ejection holes 351 may be arrayed at regular intervals in the circumferential direction of the bar body 31, or may be arrayed irregularly in the circumferential direction thereof. Preferably, the compressed gas ejection holes 351 are arrayed at regular intervals in the circumferential direction of the bar body 31. Each of the compressed gas ejection holes 351 is connected to the gas channel 35. As illustrated in FIG. 5 and FIG. 7, in the present embodiment, inside the contact suppression zone 33, the plurality of compressed gas ejection holes 351 are arrayed in the circumferential direction and the axial direction of the bar body 31. However, it suffices that the plurality of compressed gas ejection holes 351 are arrayed in at least the circumferential direction of the bar body 31.

[Regarding Drainage Mechanism]

Figure 8:
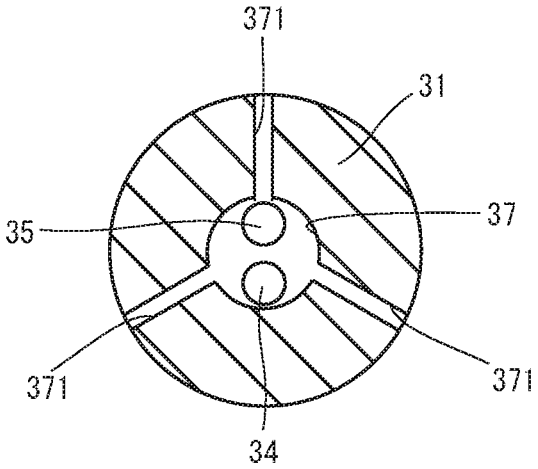
FIG. 8 is a sectional drawing along a line segment C-C in FIG. 5.

Returning to FIG. 5, the mandrel bar 3 may also include a drainage channel 37 inside the bar body 31. The drainage channel 37 extends through the inside of the bar body 31, along the axial direction of the bar body 31. The drainage channel 37 extends as far as the rear end face (end face on the opposite side to the fore end face that is connected to the plug 2) of the bar body 31. FIG. 8 is a sectional drawing along a cross section perpendicular to the axial direction of the mandrel bar, which is a sectional drawing along a line segment C-C in the cooling zone 32. Referring to FIG. 8, the drainage channel 37 is formed at the central part of the bar body 31, and houses the coolant channel 34 and the gas channel 35 therein. However, the drainage channel 37 need not house the coolant channel 34 and the gas channel 35 therein.

The mandrel bar 3 further includes one or more drainage holes 371 within the cooling zone 32. In a case where a plurality of the drainage holes 371 are formed, the plurality of drainage holes 371 may be arrayed in the circumferential direction of the bar body 31 as illustrated in FIG. 8, or although not illustrated in the drawing, may be arrayed in the axial direction of the bar body 31. During piercing-rolling and during elongating rolling, the drainage mechanism that includes the drainage channel 37 and the drainage hole 371 recovers some of the coolant ejected toward the inner surface portion of the hollow shell while the hollow shell passes through the cooling zone 32.

Note that, the mandrel bar 3 of the piercing machine 10 of the present embodiment need not have the drainage channel 37 and the drainage hole 371.

[Regarding method for producing seamless metal pipe using piercing machine 10]

The piercing machine 10 having the above configuration cools the inner surface portion of the hollow shell 50 within the cooling zone 32 of the mandrel bar 3 with coolant during piercing-rolling or elongating rolling, and in the contact suppression zone 33, contact of the coolant with the inner surface portion of the hollow shell 50 is suppressed. In short, although the piercing machine 10 actively cools the inner surface portion of the hollow shell 50 using coolant in the cooling zone 32, the piercing machine 10 is configured so that, in the zone that is rearward of the cooling zone 32, coolant is prevented as much as possible from contacting the inner surface portion of the hollow shell 50. Thus, the occurrence of variations in the cooling time periods (differences in the lengths of the cooling time periods) at each position in the longitudinal direction of the hollow shell 50 are suppressed, and a temperature difference between the fore end portion and the rear end portion of the hollow shell after piercing-rolling or after elongating rolling is reduced. This point is described in detail hereunder.

Figure 9:
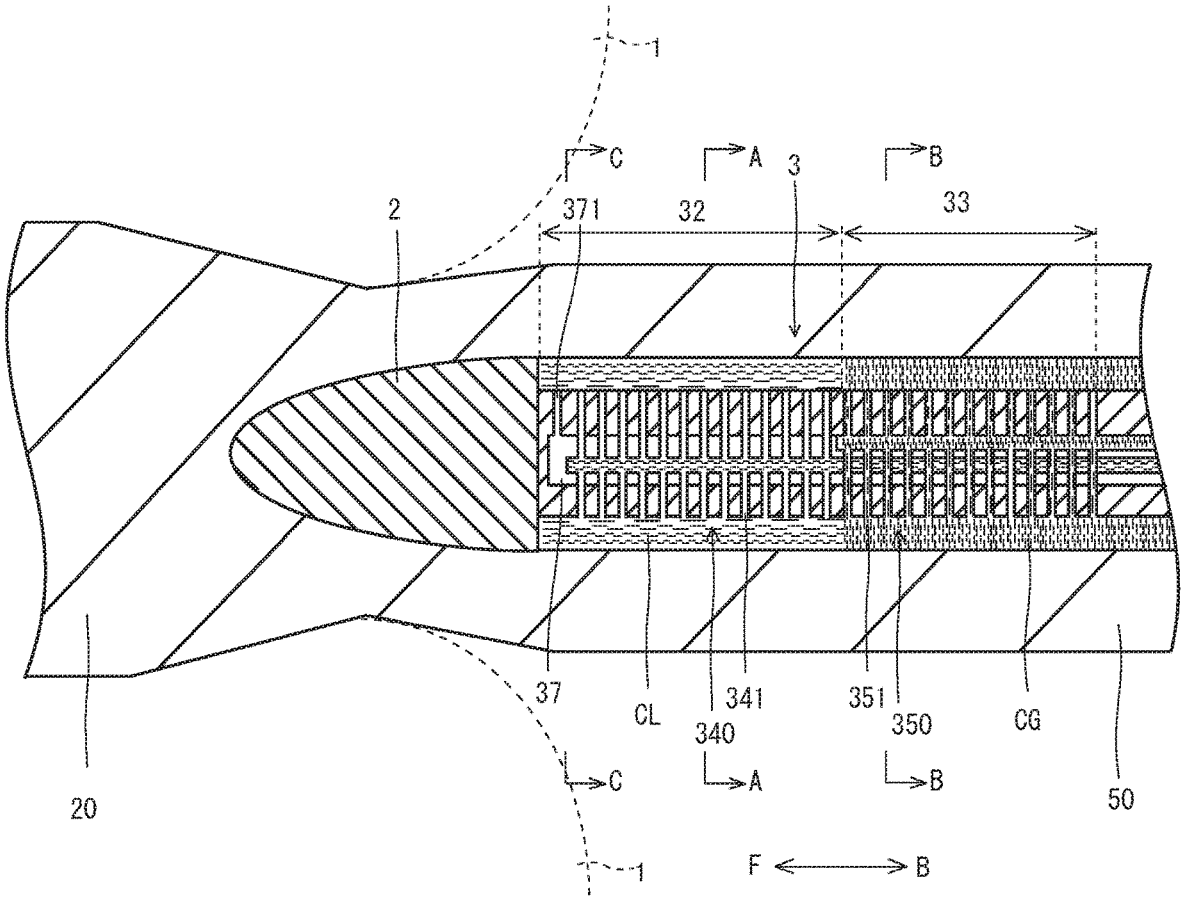
FIG. 9 is a longitudinal sectional drawing of the vicinity of the skewed rolls when a material is subjected to piercing-rolling or elongating rolling by the piercing machine illustrated in FIG. 1.

FIG. 9 is a longitudinal sectional drawing illustrating the hollow shell 50, the plug and the mandrel bar 3 during piercing-rolling or elongating rolling, on the delivery side of the piercing machine 10.

Referring to FIG. 9, during piercing-rolling or during elongating rolling, the inner surface cooling mechanism 340 of the mandrel bar 3 ejects coolant to the outside of the bar body 31 from the coolant ejection holes 341 in the cooling zone 32. Therefore, of the entire inner surface of the hollow shell that is being subjected to piercing-rolling or elongating rolling, the inner surface portion that is inside the cooling zone 32 is cooled by coolant. Here, the phrase "inner surface portion of the hollow shell 50 that is inside the cooling zone 32" means an inner surface portion of the hollow shell 50 that overlaps with the cooling zone 32 when seen in the radial direction of the hollow shell 50 (when seen in a direction perpendicular to the axial direction of the mandrel bar 3).

In addition, during piercing-rolling or during elongating rolling, the inner surface damming mechanism 350 of the mandrel bar 3 ejects compressed gas to outside of the bar body 31 from the compressed gas ejection holes 351 in the contact suppression zone 33. In a case where coolant ejected from the coolant ejection holes 341 of the cooling zone 32 flows further rearward than the cooling zone 32, the coolant is blown away by ejection of the compressed gas. As a result, in the contact suppression zone 33, contact of coolant with the inner surface portion of the hollow shell can be suppressed.

Figure 10:
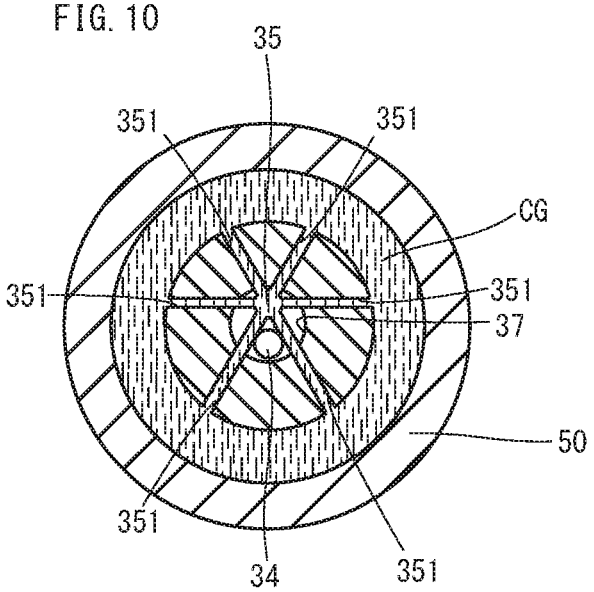
FIG. 10 is a sectional drawing along a line segment B-B in FIG. 9.
Figure 11:
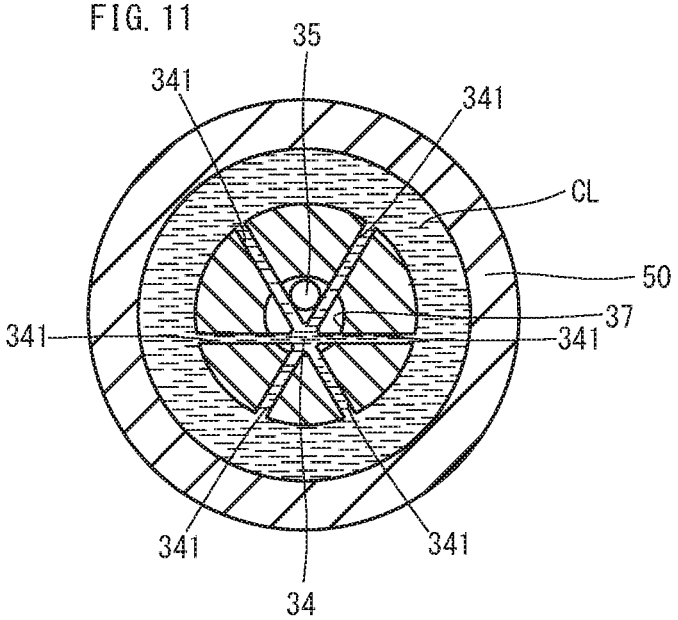
FIG. 11 is a sectional drawing along a line segment A-A in FIG. 9.

The compressed gas ejected from the plurality of compressed gas ejection holes 351 in the contact suppression zone 33 also dams coolant that is inside the cooling zone 32 from advancing further rearward than the cooling zone 32. Specifically, as illustrated in FIG. 10, in the contact suppression zone 33, compressed gas CG ejected from the compressed gas ejection holes 351 is filled into a clearance between the outer surface of the mandrel bar 3 and the inner surface of the hollow shell 50. The compressed gas CG that is filled into the clearance dams the entry of ejected coolant from the cooling zone 32 into the contact suppression zone 33. As a result, as illustrated in FIG. 11, within the cooling zone 32, coolant CL accumulates in the clearance between the outer surface of the mandrel bar 3 and the inner surface of the hollow shell 50. Preferably, the coolant CL fills the clearance between the outer surface of the mandrel bar 3 and the inner surface of the hollow shell 50. Because the coolant CL continues to be ejected from the coolant ejection holes 341 in a state in which the coolant CL is accumulated in the cooling zone 32, the accumulated coolant CL convects. Therefore, during piercing-rolling or during elongating rolling, the inner surface portion of the hollow shell 50 that is inside the cooling zone 32 is cooled.

As described in the foregoing, in the piercing machine 10 of the present embodiment, during piercing-rolling or during elongating rolling, the inner surface portion of the hollow shell 50 is cooled at the cooling zone 32 of the mandrel bar 3, and contact of coolant with the inner surface portion of the hollow shell 50 is suppressed in the contact suppression zone 33.

Figure 12:
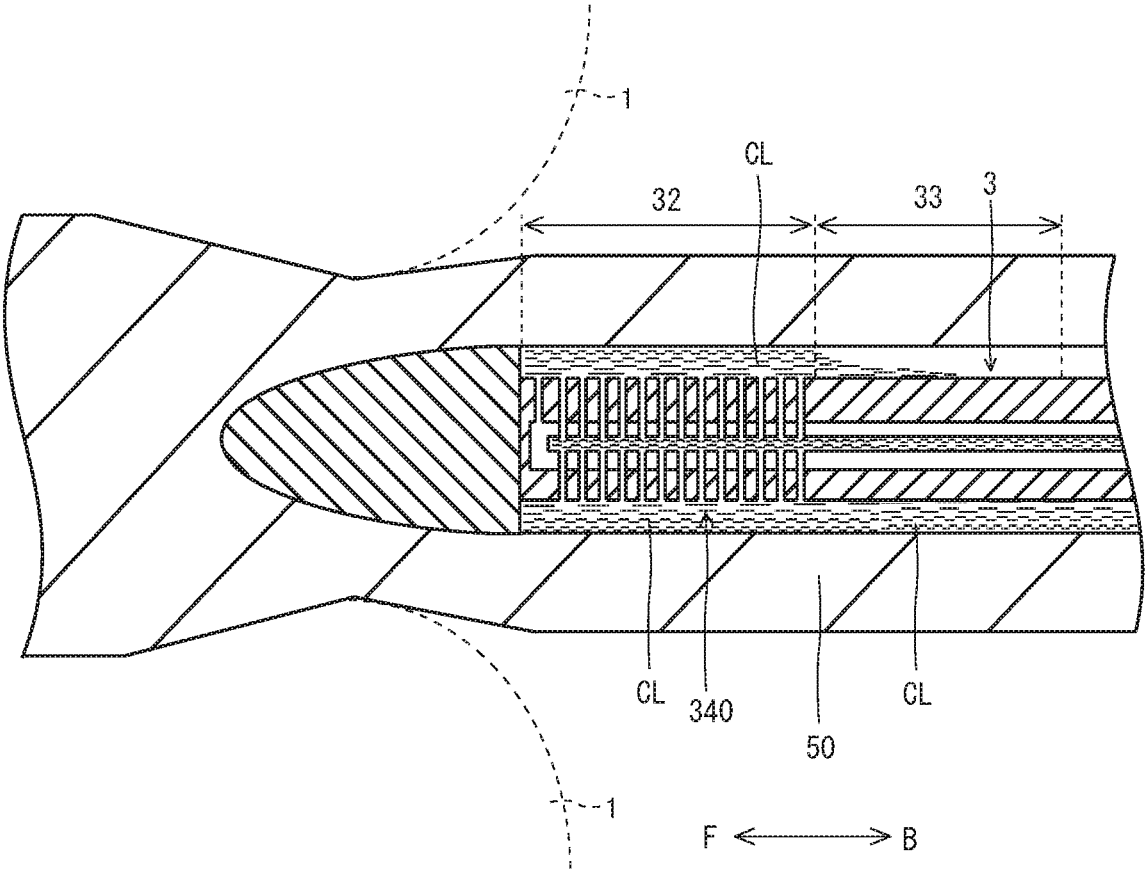
FIG. 12 is a longitudinal sectional drawing of the vicinity of the skewed rolls when a material is subjected to piercing-rolling or elongating rolling in a case where an inner surface damming mechanism of the present embodiment is not provided.

Here, a case will be supposed in which, as illustrated in FIG. 12, the mandrel bar 3 includes the inner surface cooling mechanism 340, but does not include the inner surface damming mechanism 350. In this case, because the inner surface damming mechanism 350 is not present, the coolant CL flows out as far as the contact suppression zone 33 that is further rearward than the cooling zone 32. The coolant CL that flowed out is liable to accumulate, in particular, on the inner surface of the hollow shell 50 at a position that is below the mandrel bar 3. As the piercing-rolling or elongating rolling proceeds, the area in which the coolant CL accumulates changes because the length of the hollow shell 50 that extends rearward of the plug 2 increases. Therefore, it is difficult for the time periods of cooling by the coolant CL at each position in the longitudinal direction of the hollow shell 50 during the piercing-rolling or during the elongating rolling to be constant, and cooling nonuniformity occurs in the longitudinal direction. Consequently, in some cases the fore end portion of the hollow shell 50 (end portion that passes the plug 2 in the initial stage of rolling) is excessively cooled, and the temperature at the fore end portion becomes excessively low compared to the rear end portion (end portion that passes the plug 2 at the end of rolling) of the hollow shell 50.

In contrast, in the piercing machine 10 of the present embodiment, as illustrated in FIG. 9, the inner surface damming mechanism 350 is provided in the contact suppression zone 33. Further, the coolant CL that enters the contact suppression zone 33 is blown away or the entry of coolant to the contact suppression zone 33 is damed by the compressed gas CG ejected from the compressed gas ejection holes 351 of the inner surface damming mechanism 350. By this means, the inner surface of the hollow shell 50 during piercing-rolling or during elongating rolling is cooled by the coolant CL in the cooling zone 32, and contact of the coolant CL with the inner surface of the hollow shell 50 in a zone (contact suppression zone 33) that is further rearward than the cooling zone 32 is suppressed. As a result, it is easy for the time period of cooling by the coolant CL at each position in the longitudinal direction of the hollow shell 50 during piercing-rolling or during elongating rolling to be a constant time period, and the occurrence of a temperature difference between the fore end portion and rear end portion of the hollow shell 50 after piercing-rolling or after elongating rolling can be suppressed. Thus, it is easy to obtain a seamless metal pipe that has a uniform micro-structure in the longitudinal direction.

Figure 13:
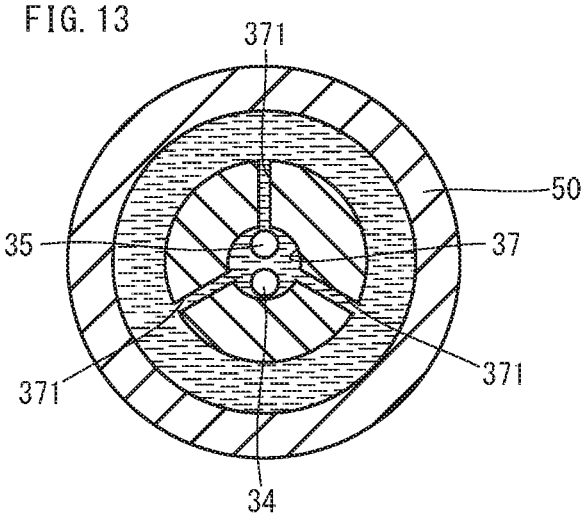
FIG. 13 is a sectional drawing along a line segment C-C in FIG. 9.

Note that, as illustrated in FIG. 9, the mandrel bar 3 includes the drainage hole 371 in the cooling zone 32 in the fore end portion. Therefore, as illustrated in FIG. 13, during piercing-rolling or during elongating rolling, some of the coolant CL that cooled the inner surface of the hollow shell 50 is drained into the drainage channel 37 through the drainage hole 371. The coolant CL which was drained into the drainage channel 37 flows through the drainage channel 37 and is discharged to outside of the mandrel bar 3 without contacting the hollow shell 50. Note that, coolant CL of an amount corresponding to the amount by which the coolant CL decreased as a result of some of the coolant CL being discharged is newly replenished from the coolant ejection holes 341. Thus, when the mandrel bar includes the drainage hole 371, because the coolant CL circulates, cooling of the inner surface of the hollow shell 50 in the cooling zone 32 is promoted. The drainage hole 371 may be disposed at any position within the cooling zone 32. In order to promote convection of the coolant CL, the drainage hole 371 is preferably disposed nearer to the plug 2 than the central part in the axial direction of the cooling zone 32.

Note that, the drainage hole 371 and the drainage channel 37 need not be provided. However, if the drainage hole 371 and the drainage channel 37 are formed, the aforementioned effect can be obtained.

Second Embodiment

Figure 14:
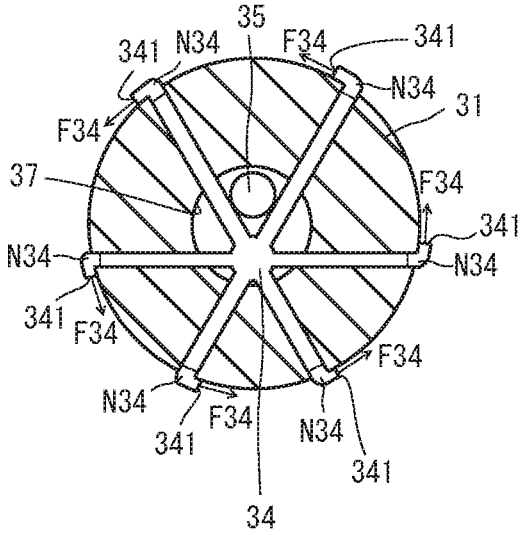
FIG. 14 is a sectional drawing along a line segment A-A of the mandrel bar illustrated in FIG. 5, in a piercing machine according to a second embodiment.
Figure 15:
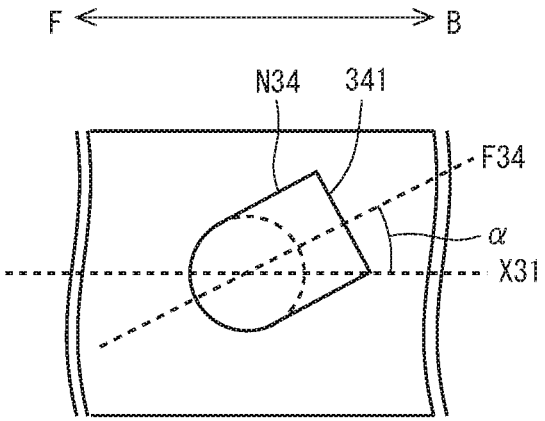
FIG. 15 is an enlarged view of a coolant ejection hole in a case where the bar body of the mandrel bar illustrated in FIG. 14 is viewed from the surface.

The orientation of the coolant ejection holes 341 of the inner surface cooling mechanism of the mandrel bar 3 is not particularly limited. FIG. 14 is a sectional drawing in a direction perpendicular to the axial direction of the mandrel bar 3 that is taken along a line segment A-A inside the cooling zone 32 shown in FIG. 5 in the piercing machine according to the embodiment illustrated in FIG. 2, which is different from the sectional drawing in FIG. 6. Referring to FIG. 14, the coolant ejection holes 341 are formed in a front end of ejection nozzles N34, respectively, and are connected with the coolant channel 34. FIG. 15 is an enlarged view of the coolant ejection hole 341 in a case where the bar body 31 illustrated in FIG. 14 is seen from the surface. Referring to FIG. 14 and FIG. 15, when seen in the advancing direction of the hollow shell 50, the plurality of coolant ejection holes 341 are oriented in the circumferential direction of the bar body 31. Further, as illustrated in FIG. 15, when seen in the radial direction of the bar body 31 (that is, when the bar body 31 is viewed from the side), an ejection direction F34 of the coolant ejection hole 341 that is opened in the front end of the ejection nozzle N34 intersects at an angle $\alpha$ with an axial direction X31 of the bar body 31, and faces rearward of the bar body 31.

Figure 16:
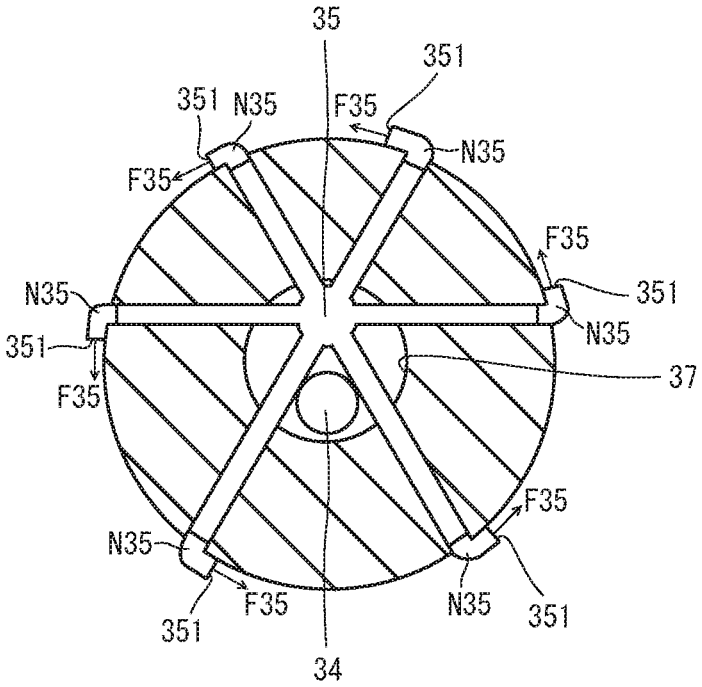
FIG. 16 is a sectional drawing along a line segment B-B of the mandrel bar illustrated in FIG. 5, in the piercing machine according to the second embodiment.
Figure 17:
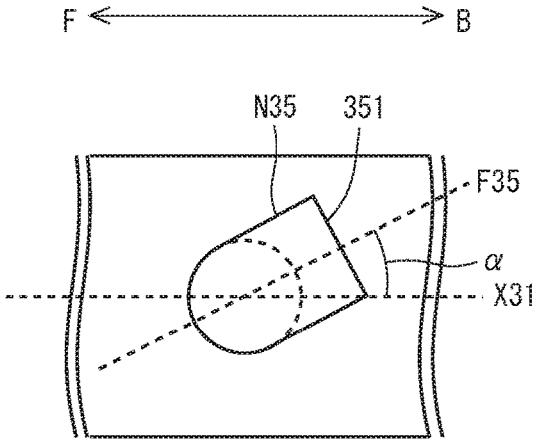
FIG. 17 is an enlarged view of a coolant ejection hole in a case where the bar body of the mandrel bar illustrated in FIG. 14 is viewed from the surface.

FIG. 16 is a sectional drawing in a direction perpendicular to the axial direction of the mandrel bar 3 that is taken along a line segment B-B inside the contact suppression zone 33 shown in FIG. 5, which is different from the sectional drawing in FIG. 7. Referring to FIG. 16, the compressed gas ejection holes 351 are formed in a front end of an ejection nozzles N35, respectively, and are connected with the gas channel 35. FIG. 17 is an enlarged view of the compressed gas ejection hole 351 in a case where the bar body 31 of the mandrel bar 3 is seen from the surface. Referring to FIG. 16 and FIG. 17, when seen in the advancing direction of the hollow shell 50, the plurality of compressed gas ejection holes 351 are oriented in the circumferential direction of the bar body 31. Further, referring to FIG. 17, when seen in the radial direction of the bar body 31 (that is, when the bar body 31 is viewed from the side), an ejection direction F35 of the compressed gas ejection hole 351 that is opened in the front end of the ejection nozzle N35 intersects at an angle $\alpha$ with an axial direction X31 of the bar body 31, and faces rearward of the bar body 31.

[Formation of Swirl Flows]

Figure 18:
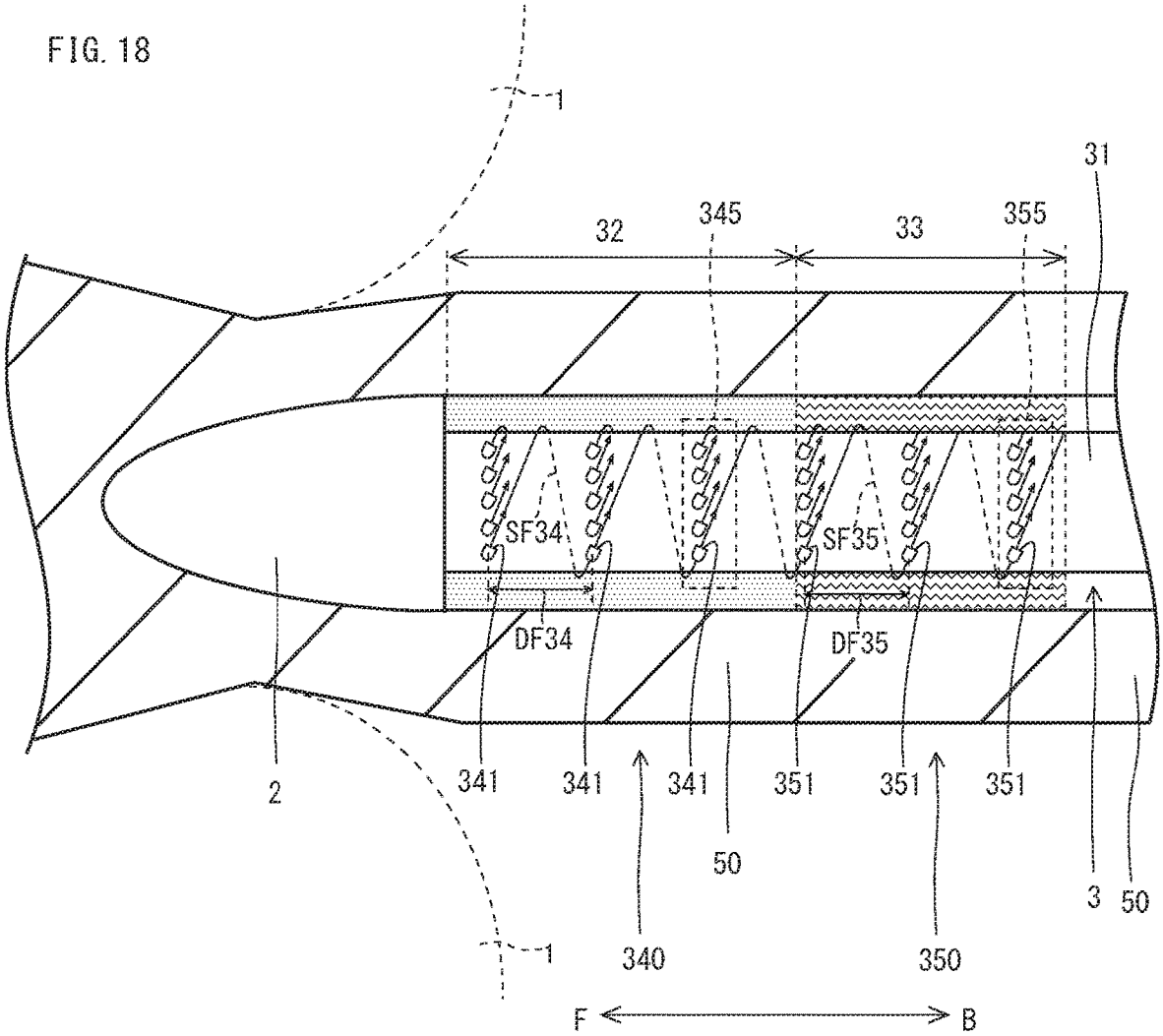
FIG. 18 is a longitudinal sectional drawing of the piercing machine of the second embodiment for describing a swirl flow generated by coolant and a swirl flow generated by compressed gas when a material is subjected to piercing-rolling or elongating rolling by the piercing machine of the second embodiment.

Referring to FIG. 18, in the piercing machine 10 according to the second embodiment, when seen in the advancing direction of the hollow shell 50, the inner surface cooling mechanism 340 ejects coolant in the circumferential direction of the bar body 31 from the coolant ejection holes 341. By this means, coolant that is filled between the bar body 31 and the inner surface of the hollow shell 50 inside the cooling zone 32 is caused to swirl in the circumferential direction of the bar body 31, thereby generating a swirl flow SF34. The swirl flow SF34 flows in the rearward direction of the bar body 31, while swirling around the bar body 31. By means of the swirl flow SF34, variations in the flow of the coolant in the circumferential direction of the bar body 31 can be suppressed. As a result, the occurrence of cooling nonuniformity in the circumferential direction at the inner surface of the hollow shell 50 can be suppressed.

In addition, in the present embodiment, when seen in the advancing direction of the hollow shell 50, the inner surface damming mechanism 350 ejects compressed gas in the circumferential direction of the bar body 31 from the compressed gas ejection holes 351. By this means, compressed gas that is filled between the bar body 31 and the inner surface of the hollow shell 50 inside the contact suppression zone 33 is caused to swirl in the circumferential direction of the bar body 31, thereby generating a swirl flow SF35. The swirl flow SF35 flows in the rearward direction of the bar body 31, while swirling around the bar body 31. By means of the swirl flow SF35, in a case where coolant constituting the swirl flow SF34 enters the contact suppression zone 33 from the cooling zone 32, the coolant is quickly blown away to rearward of the bar body 31 by the swirl flow SF35 constituted by the compressed gas. Therefore, within the contact suppression zone 33, contact of coolant with the inner surface of the hollow shell 50 can be suppressed.

Figure 19:
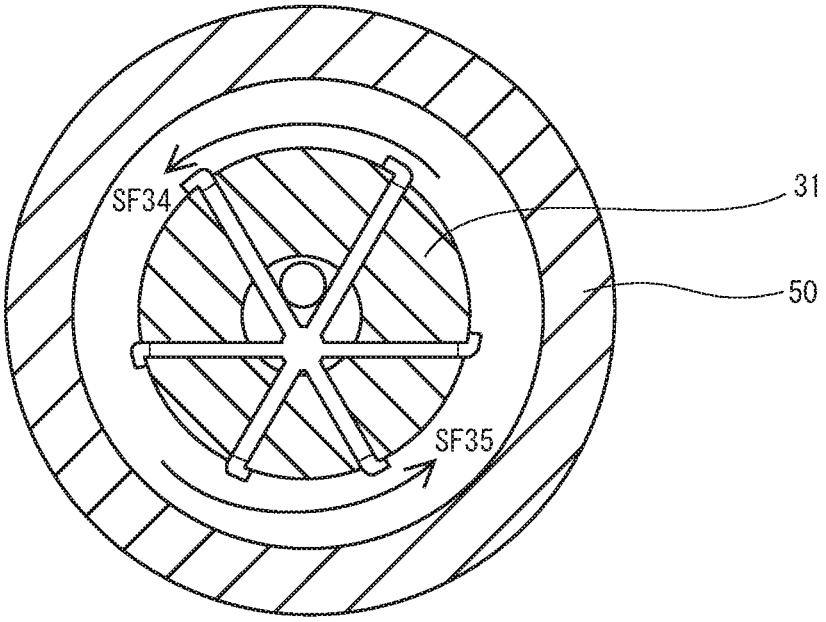
FIG. 19 is a sectional drawing of the piercing machine of the second embodiment for describing a swirl flow generated by coolant and a swirl flow generated by compressed gas, when the piercing machine of the second embodiment is seen from the axial direction of the bar body.

FIG. 19 is a sectional drawing illustrating the piercing machine 10 in a case where the piercing machine 10 is seen from the axial direction of the bar body 31, which is a drawing for describing the swirl flow SF34 generated by the coolant, and the swirl flow SF35 generated by the compressed gas. As illustrated in FIG. 19, when seen in the advancing direction of the hollow shell 50, the swirling direction of the swirl flow SF34 of the coolant ejected from the plurality of coolant ejection holes 341 of the inner surface cooling mechanism 340 is the clockwise direction or counterclockwise direction. Further, the swirling direction of the swirl flow SF35 of the compressed gas ejected from the plurality of compressed gas ejection holes of the inner surface damming mechanism 350 is the clockwise direction or counterclockwise direction.

Preferably, as illustrated in FIG. 19, the swirling direction of the swirl flow SF35 of compressed gas is the same as the swirling direction of the swirl flow SF34 of coolant generated by the inner surface cooling mechanism 340. In this case, the occurrence of an eddy flow caused by a collision between fluids (coolant and compressed gas) can be suppressed at the boundary between the cooling zone 32 and the contact suppression zone 33. Therefore, the occurrence of a situation in which coolant stays at the boundary between the cooling zone 32 and the contact suppression zone 33 can be suppressed, and coolant entering the contact suppression zone 33 can be quickly blown away to rearward of the bar body 31 by the swirl flow SF35. As a result, while suppressing the occurrence of cooling nonuniformity in the circumferential direction at the inner surface of the hollow shell 50 within the cooling zone 32, contact of coolant with the inner surface portion of the hollow shell 50 at a position that is further rearward than the cooling zone 32 can also be suppressed.

Referring to FIG. 18, the inner surface cooling mechanism 340 may include a plurality of annularly arranged coolant-ejection-hole groups 345 that are arrayed in the axial direction of the bar body 31. In this case, each annularly arranged coolant-ejection-hole group 345 includes a plurality of coolant ejection holes 341 that are arrayed in the circumferential direction of the bar body 31. Here, a distance in the axial direction of the bar body 31 that the swirl flow SF34 of coolant advances until completing one rotation around the bar body 31 is defined as "one swirl period distance DF34." At this time, it is preferable that a distance between annularly arranged coolant-ejection-hole groups 345 that are adjacent in the axial direction of the bar body 31 is the same as the one swirl period distance DF34. Here the term "the same as the one swirl period distance DF34" means that the distance between the annularly arranged coolant-ejection-hole groups 345 that are adjacent is within a range of the one swirl period distance DF34 ±50%. Preferably, the distance between the annularly arranged coolant-ejection-hole groups 345 that are adjacent is within a range of the one swirl period distance DF34 ±20%, and more preferably is within a range of the one swirl period distance DF34 ±10%.

In this case, when the swirl flow SF34 advances the one swirl period distance DF34, new coolant is supplied from the annularly arranged coolant-ejection-hole group 345 in the next row. Therefore, it is more difficult for an eddy flow to arise in the swirl flow SF34 in comparison to a case where new coolant is supplied from the annularly arranged coolant-ejection-hole group 345 in the next row before the swirl flow SF34 reaches the one swirl period distance DF34. Thus, the occurrence of cooling nonuniformity in the circumferential direction at the inner surface of the hollow shell 50 can be further suppressed.

Referring to FIG. 18, similarly to the inner surface cooling mechanism 340, the inner surface damming mechanism 350 may include a plurality of annularly arranged gas-ejection-hole groups 355 that are arrayed in the axial direction of the bar body 31. Each annularly arranged gas-ejection-hole group 355 includes a plurality of compressed gas ejection holes 351 that are arrayed in the circumferential direction of the bar body 31. Here, a distance in the axial direction of the bar body 31 that the swirl flow SF35 of compressed gas advances until completing one rotation around the bar body 31 is defined as "one swirl period distance DF35." At this time, it is preferable that a distance between the annularly arranged gas-ejection-hole groups 355 that are adjacent in the axial direction X31 of the bar body 31 is the same as the one swirl period distance DF35. Here the term "the same as the one swirl period distance DF35" means that the distance between the annularly arranged gas-ejection-hole groups 355 that are adjacent is within a range of the one swirl period distance DF35 ±50%. Preferably, the distance between the annularly arranged gas-ejection-hole groups 355 that are adjacent is within a range of the one swirl period distance DF35 ±20%, and more preferably is within a range of the one swirl period distance DF35 ±10%.

In this case, when the swirl flow SF35 advances the one swirl period distance DF35, new compressed gas is supplied from the annularly arranged gas-ejection-hole group 355 in the next row. Therefore, it is more difficult for an eddy flow to arise in the swirl flow SF35 in comparison to a case where new compressed gas is supplied from the annularly arranged gas-ejection-hole group 355 in the next row before the swirl flow SF35 reaches the one swirl period distance DF35. In this case, coolant that flowed rearward from the cooling zone 32 can be blown away more quickly to rearward of the bar body 31 by the swirl flow SF35, and contact of coolant with the inner surface of the hollow shell 50 at a position that is further rearward than the cooling zone 32 can be further suppressed.

In the aforementioned embodiment, as illustrated in FIG. 19, the swirling direction of the swirl flow SF35 of compressed gas which the inner surface damming mechanism 350 generates is made the same as the swirling direction of the swirl flow SF34 of coolant which the inner surface cooling mechanism 340 generates. However, the swirling direction of the swirl flow SF35 of compressed gas which the inner surface damming mechanism 350 generates may be a different direction (opposite direction) to the swirling direction of the swirl flow SF34 of coolant which the inner surface cooling mechanism 340 generates.

Further, even when the swirling direction of the swirl flow SF35 of the compressed gas which the inner surface damming mechanism 350 generates is the same direction as the swirling direction of the swirl flow SF34 of coolant which the inner surface cooling mechanism 340 generates, the angle α formed between the ejection direction F34 of the coolant from the coolant ejection holes 341 and the axial direction X31 of the bar body 31 that is illustrated in FIG. 15 may be a different angle to the angle α formed between the ejection direction F35 of the compressed gas from the compressed gas ejection holes 351 and the axial direction X31 of the bar body 31 that is illustrated in FIG. 17.

Furthermore, although in the aforementioned embodiment the inner surface cooling mechanism 340 generates the swirl flow SF34 of coolant and the inner surface damming mechanism 350 generates the swirl flow SF35 of the compressed gas, in the piercing machine 10 of the second embodiment the aforementioned effect is obtained to a certain extent as long as at least the inner surface cooling mechanism 340 generates the swirl flow SF34 of coolant. That is, in the piercing machine 10 according to the second embodiment, although the inner surface cooling mechanism 340 generates the swirl flow SF34 of coolant and the inner surface damming mechanism 350 ejects compressed gas, the inner surface damming mechanism 350 need not generate the swirl flow SF35. For example, the inner surface damming mechanism 350 ejects compressed gas in the radial direction of the bar body 31. In this case, the inner surface damming mechanism 350 does not form the swirl flow SF35. However, even in this case, because the inner surface cooling mechanism 340 generates the swirl flow SF34, in the cooling zone 32, cooling nonuniformity in the circumferential direction at the inner surface of the hollow shell 50 can be suppressed to a certain extent.

Figure 20:
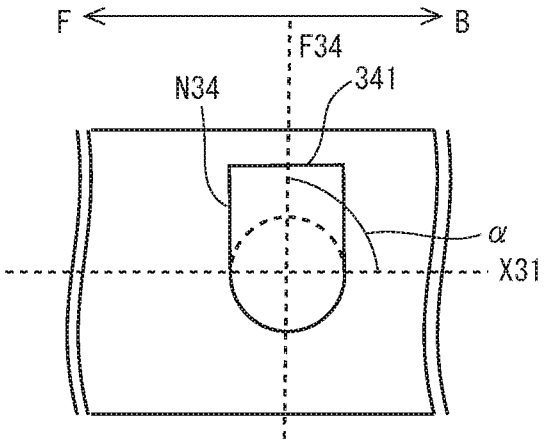
FIG. 20 is an enlarged view of the coolant ejection hole in a case where the bar body of the mandrel bar is seen from a side face, which is different from FIG. 15.

In the aforementioned embodiment, when the bar body 31 is viewed from the side (that is, when viewed from a direction that is perpendicular to the axial direction of the bar body 31), the ejection direction F34 of the coolant ejection holes 341 of the inner surface cooling mechanism 340 intersects with the axial direction X31 of the bar body 31 and faces rearward of the bar body 31. However, as illustrated in FIG. 20, the ejection direction F34 of the coolant ejection holes 341 may be orthogonal to the axial direction X31 of the bar body 31, and need not face rearward of the bar body 31. In this case also, the swirl flow SF34 can be generated to a certain extent. However, it is preferable that the ejection direction F34 of the coolant ejection holes 341 of the inner surface cooling mechanism 340 intersects with the axial direction X31 of the bar body 31 and faces rearward of the bar body 31. The reason is that it is easier for coolant to advance in the rearward direction of the bar body 31.

Third Embodiment

The inner surface damming mechanism 350 may suppress coolant from entering into the contact suppression zone 33 by using a method other than compressed gas.

Figure 21:
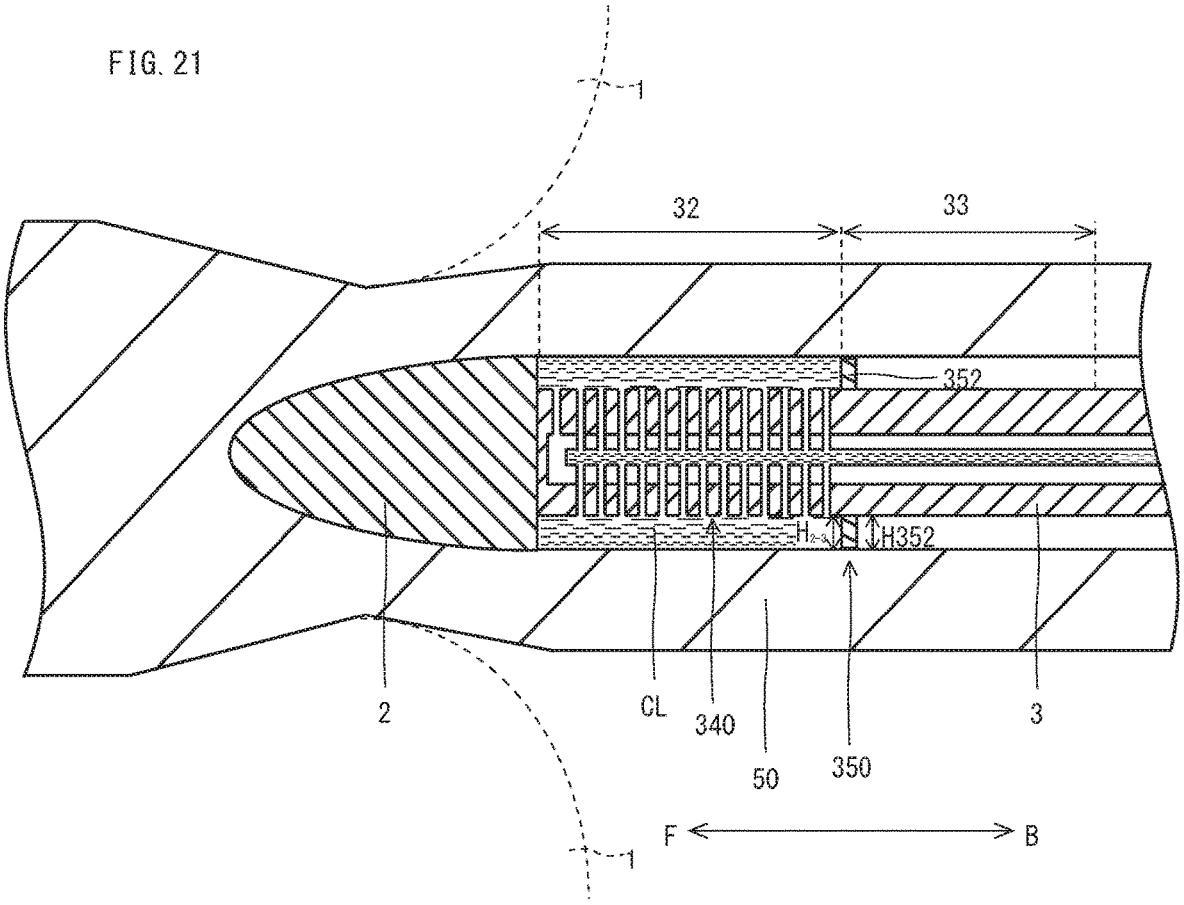
FIG. 21 is a longitudinal sectional drawing illustrating the vicinity of skewed rolls when a material is subjected to piercing-rolling or elongating rolling by a piercing machine according to a third embodiment.

FIG. 21 is a longitudinal sectional drawing of the vicinity of the skewed rolls when a material is subjected to piercing-rolling or elongating rolling by a piercing machine according to the third embodiment. Referring to FIG. 21, in the present embodiment, the mandrel bar 3 does not include the gas channel 35, and does not receive a supply of gas from the gas supply device 8. In addition, the inner surface damming mechanism 350 includes an inner surface damming member 352 instead of the plurality of compressed gas ejection holes 351.

The inner surface damming member 352 is disposed adjacent to the rear end of the cooling zone 32. The inner surface damming member 352 extends in the circumferential direction of the bar body 31, and accordingly, when the mandrel bar 3 is seen from the axial direction, the outer edge of the inner surface damming member 352 is a circular shape. When the mandrel bar 3 is seen from a direction perpendicular to the axial direction, a height H352 of the inner surface damming member 352 is less than a differential value $H_{2-3}$ obtained by subtracting the radius of the mandrel bar at the position at which the inner surface damming member 352 is disposed from the maximum radius of the plug 2. In other words, the height of the inner surface damming member is lower than a differential value between the maximum radius of the plug and the radius of the bar body at the position at which the inner surface damming member is disposed. Therefore, during piercing-rolling or during elongating rolling, the inner surface damming member does not contact the inner surface of the hollow shell that passed by the plug, and also does not roll down the inner surface of the hollow shell. Preferably, the height H352 of the inner surface damming member 352 is equal to or greater than one-half of the differential value $H_{2-3}$.

The material of the inner surface damming member 352 is, for example, glass wool. The material of the inner surface damming member 352 is not limited to glass wool. It suffices that the material has a fusing point that is higher than the inner surface temperature of the hollow shell 50 during piercing-rolling or elongating rolling. Preferably, the fusing point of the material of the inner surface damming member 352 is 1100° C. or higher.

The remaining configuration of the piercing machine of the present embodiment is the same as the configuration of the piercing machine 10 of the first embodiment.

As illustrated in FIG. 21, in the piercing machine of the present embodiment also, during piercing-rolling or during elongating rolling, the inner surface damming member 352 suppresses the entry of the coolant CL into the contact suppression zone 33, and physically dams the coolant CL inside the cooling zone 32. Hence, the same effect as in the first embodiment is obtained.

Note that, the mandrel bar 3 illustrated in FIG. 21 may include the gas channel 35, and the inner surface damming mechanism 350 may include the plurality of compressed gas ejection holes 351 and the inner surface damming member 352.

Fourth Embodiment

In the first to third embodiments, of the entire inner surface of the hollow shell 50 subjected to piercing-rolling or elongating rolling, the inner surface portion that is over the cooling zone 32 is cooled. In the present embodiment, the outer surface portion of the hollow shell 50 that is inside the cooling zone 32 is also cooled.

Figure 22:
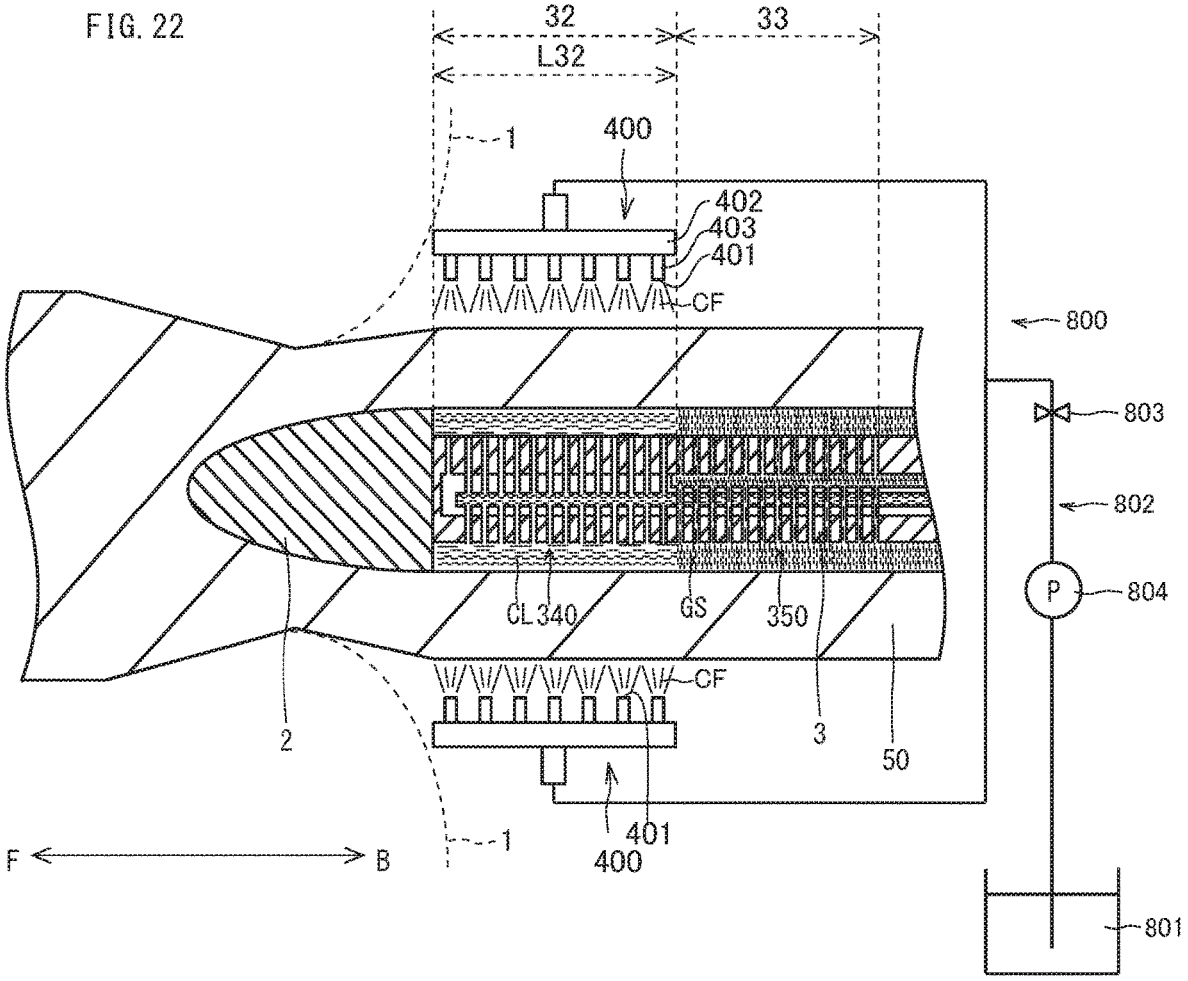
FIG. 22 is a longitudinal sectional drawing illustrating the vicinity of skewed rolls when a material is subjected to piercing-rolling or elongating rolling by a piercing machine according to a fourth embodiment.

FIG. 22 is a longitudinal sectional drawing of the vicinity of the skewed rolls when a material is subjected to piercing-rolling or elongating rolling by a piercing machine of the fourth embodiment.

Referring to FIG. 22, in comparison to the piercing machine 10 illustrated in FIG. 9, the piercing machine 10 further includes an outer surface cooling mechanism 400. The outer surface cooling mechanism 400 is disposed around the mandrel bar 3, at a position that is rearward of the plug 2.

Referring to FIG. 22, during piercing-rolling or elongating rolling, the outer surface cooling mechanism 400 ejects cooling fluid toward the outer surface portion of the hollow shell 50 that is advancing within the cooling zone 32, and thereby cools the hollow shell 50 that is within the cooling zone 32.

Figure 23:
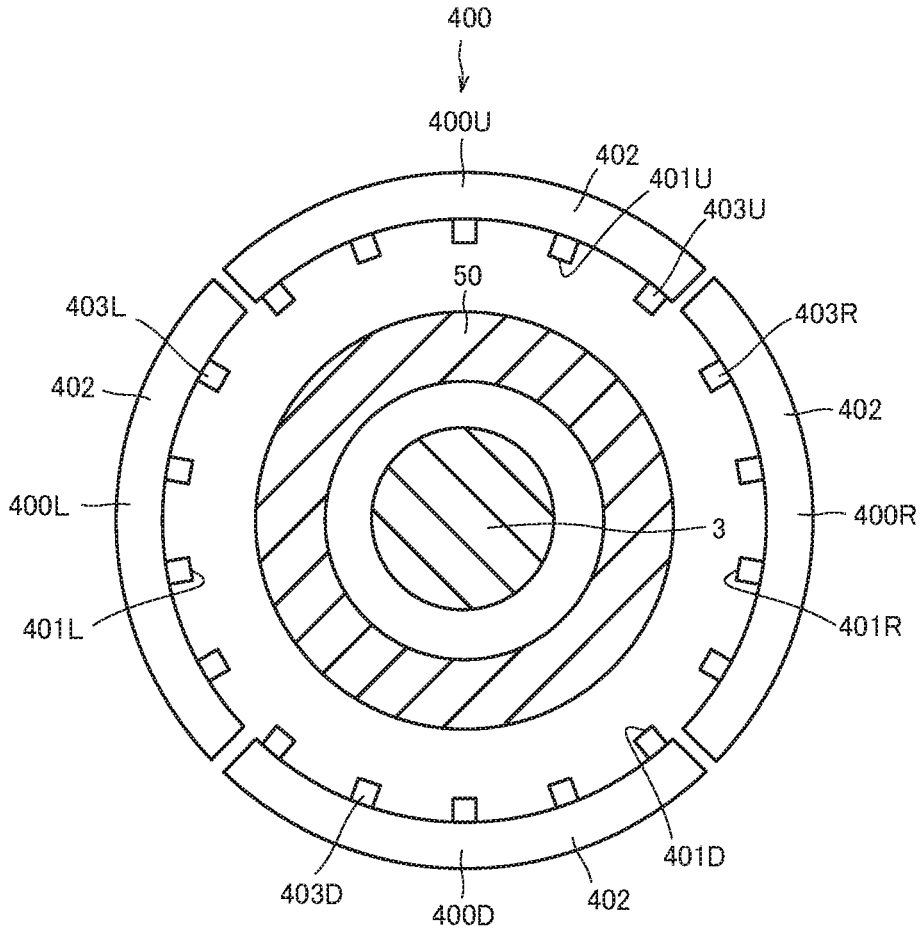
FIG. 23 is a front view of an outer surface cooling mechanism illustrated in FIG. 22 as seen from the advancing direction of a hollow shell.

FIG. 23 is a view that illustrates the outer surface cooling mechanism 400 when seen from the advancing direction of the hollow shell 50 (that is, a front view of the outer surface cooling mechanism 400). Referring to FIG. 22 and FIG. 23, the outer surface cooling mechanism 400 includes an outer surface cooling upper member 400U, an outer surface cooling lower member 400D, an outer surface cooling left member 400L and an outer surface cooling right member 400R.

[Configuration of Outer Surface Cooling Upper Member 400U]

The outer surface cooling upper member 400U is disposed above the mandrel bar 3. The outer surface cooling upper member 400U includes a main body 402 and a plurality of cooling fluid upper-part ejection holes 401U. The main body 402 is a tube-shaped or plate-shaped casing that is curved in the circumferential direction of the mandrel bar 3, and includes therein one or more cooling fluid paths which allow a cooling fluid CF (see FIG. 22) to pass therethrough. In the present example, the plurality of cooling fluid upper-part ejection holes 401U are formed in a front end of a plurality of cooling fluid upper-part ejection nozzles 403U. However, the cooling fluid upper-part ejection holes 401U may be formed directly in the main body 402. In the present example, the plurality of cooling fluid upper-part ejection nozzles 403U that are arrayed around the mandrel bar 3 are connected to the main body 402.

The plurality of cooling fluid upper-part ejection holes 401U face the mandrel bar 3. When the hollow shell 50 subjected to piercing-rolling or elongating rolling passes through the inside of the outer surface cooling mechanism 400, the plurality of cooling fluid upper-part ejection holes 401U face the outer surface of the hollow shell 50. The plurality of cooling fluid upper-part ejection holes 401U are arrayed around the mandrel bar 3, in the circumferential direction of the mandrel bar 3. Preferably, the plurality of cooling fluid upper-part ejection holes 401U are disposed at regular intervals around the mandrel bar 3. Referring to FIG. 22, preferably the plurality of cooling fluid upper-part ejection holes 401U are also arrayed in plurality in the axial direction of the mandrel bar 3.

[Configuration of Outer Surface Cooling Lower Member 400D]

Referring to FIG. 23, the outer surface cooling lower member 400D is disposed below the mandrel bar 3. The outer surface cooling lower member 400D includes a main body 402 and a plurality of cooling fluid lower-part ejection holes 401D. The main body 402 is a tube-shaped or plate-shaped casing that is curved in the circumferential direction of the mandrel bar 3, and includes therein one or more cooling fluid paths which allow the cooling fluid CF to pass therethrough. In the present example, the plurality of cooling fluid lower-part ejection holes 401D are formed in a front end of a plurality of cooling fluid lower-part ejection nozzles 403D. However, the cooling fluid lower-part ejection holes 401D may be formed directly in the main body 402. In the present example, the plurality of cooling fluid lower-part ejection nozzles 403D that are arrayed around the mandrel bar 3 are connected to the main body 402.

The plurality of cooling fluid lower-part ejection holes 401D face the mandrel bar 3. When the hollow shell 50 subjected to piercing-rolling or elongating rolling passes through the inside of the outer surface cooling mechanism 400, the plurality of cooling fluid lower-part ejection holes 401D face the outer surface of the hollow shell 50. The plurality of cooling fluid lower-part ejection holes 401D are arrayed around the mandrel bar 3, in the circumferential direction of the mandrel bar 3. Preferably, the plurality of cooling fluid lower-part ejection holes 401D are disposed at regular intervals around the mandrel bar 3. Referring to FIG. 22, preferably the plurality of cooling fluid lower-part ejection holes 401D are also arrayed in plurality in the axial direction of the mandrel bar 3.

[Configuration of Outer Surface Cooling Left Member 400L]

Referring to FIG. 23, the outer surface cooling left member 400L is disposed leftward of the mandrel bar 3. The outer surface cooling left member 400L includes a main body 402 and a plurality of cooling fluid left-part ejection holes 401L. The main body 402 is a tube-shaped or plate-shaped casing that is curved in the circumferential direction of the mandrel bar 3, and includes therein one or more cooling fluid paths which allow the cooling fluid CF to pass therethrough. In the present example, a plurality of cooling fluid left-part ejection nozzles 403L that are arrayed around the mandrel bar 3 are connected to the main body 402, and the plurality of cooling fluid left-part ejection holes 401L are formed in a front end of the plurality of cooling fluid left-part ejection nozzles 403L. However, the cooling fluid left-part ejection holes 401L may be formed directly in the main body 402.

The plurality of cooling fluid left-part ejection holes 401L face the mandrel bar 3. When the hollow shell 50 subjected to piercing-rolling or elongating rolling passes through the inside of the outer surface cooling mechanism 400, the plurality of cooling fluid left-part ejection holes 401L face the outer surface of the hollow shell 50. The plurality of cooling fluid left-part ejection holes 401L are arrayed around the mandrel bar 3, in the circumferential direction of the mandrel bar 3. Preferably, the plurality of cooling fluid left-part ejection holes 401L are disposed at regular intervals around the mandrel bar 3. Preferably, the plurality of cooling fluid left-part ejection holes 401L are also arrayed in plurality in the axial direction of the mandrel bar 3.

[Configuration of Outer Surface Cooling Right Member 400R]

Referring to FIG. 23, the outer surface cooling right member 400R is disposed rightward of the mandrel bar 3. The outer surface cooling right member 400R includes a main body 402 and a plurality of cooling fluid right-part ejection holes 401R. The main body 402 is a tube-shaped or plate-shaped casing that is curved in the circumferential direction of the mandrel bar 3, and includes therein one or more cooling fluid paths which allow the cooling fluid CF to pass therethrough. In the present example, a plurality of cooling fluid right-part ejection nozzles 403R that are arrayed around the mandrel bar 3 are connected to the main body 402, and the plurality of cooling fluid right-part ejection holes 401R are formed in a front end of the plurality of cooling fluid right-part ejection nozzles 403R. However, the cooling fluid right-part ejection holes 401R may be formed directly in the main body 402.

The plurality of cooling fluid right-part ejection holes 401R face the mandrel bar 3. When the hollow shell 50 subjected to piercing-rolling or elongating rolling passes through the inside of the outer surface cooling mechanism 400, the plurality of cooling fluid right-part ejection holes 401R face the outer surface of the hollow shell 50. The plurality of cooling fluid right-part ejection holes 401R are arrayed around the mandrel bar 3, in the circumferential direction of the mandrel bar 3. Preferably, the plurality of cooling fluid right-part ejection holes 401R are disposed at regular intervals around the mandrel bar 3. Preferably, the plurality of cooling fluid right-part ejection holes 401R are also arrayed in plurality in the axial direction of the mandrel bar 3.

Figure 24:
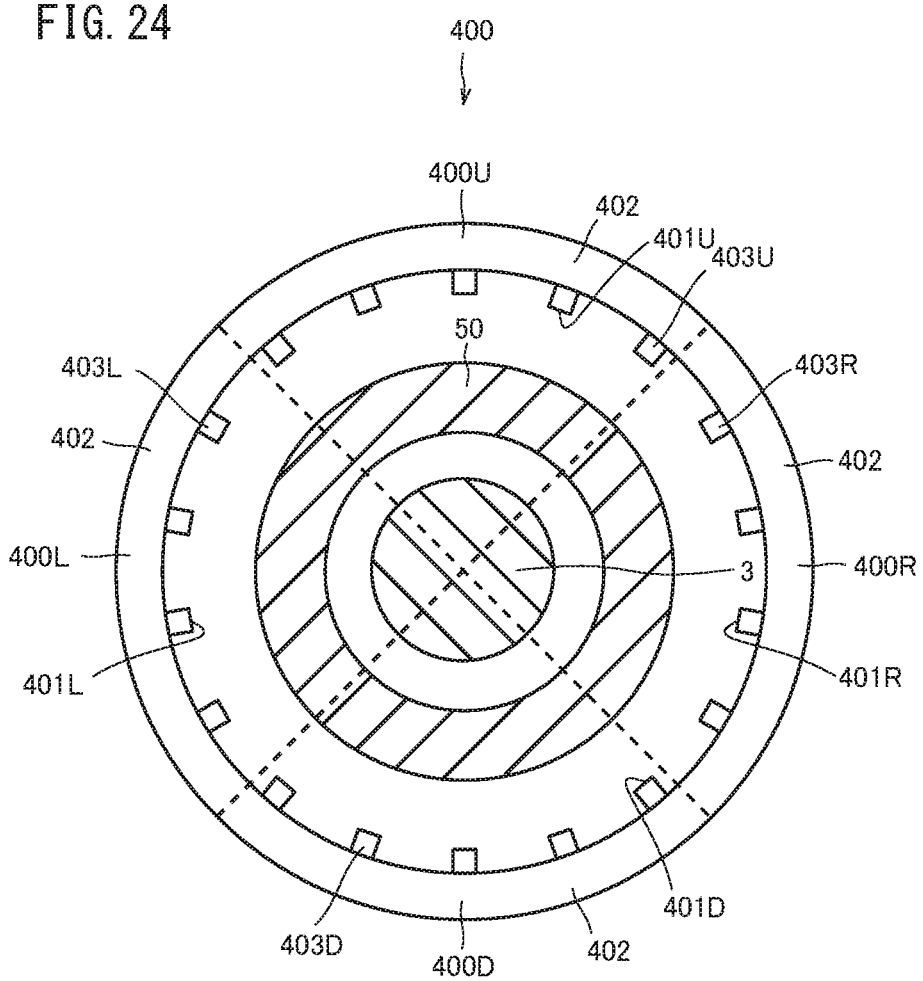
FIG. 24 is a front view of an outer surface cooling mechanism of a different form from the outer surface cooling mechanism illustrated in FIG. 23.

Note that, in FIG. 23 the outer surface cooling upper member 400U, the outer surface cooling lower member 400D, the outer surface cooling left member 400L and the outer surface cooling right member 400R are separate members that are independent from each other. However, as illustrated in FIG. 24, the outer surface cooling upper member 400U, the outer surface cooling lower member 400D, the outer surface cooling left member 400L and the outer surface cooling right member 400R may be connected.

Figure 25:
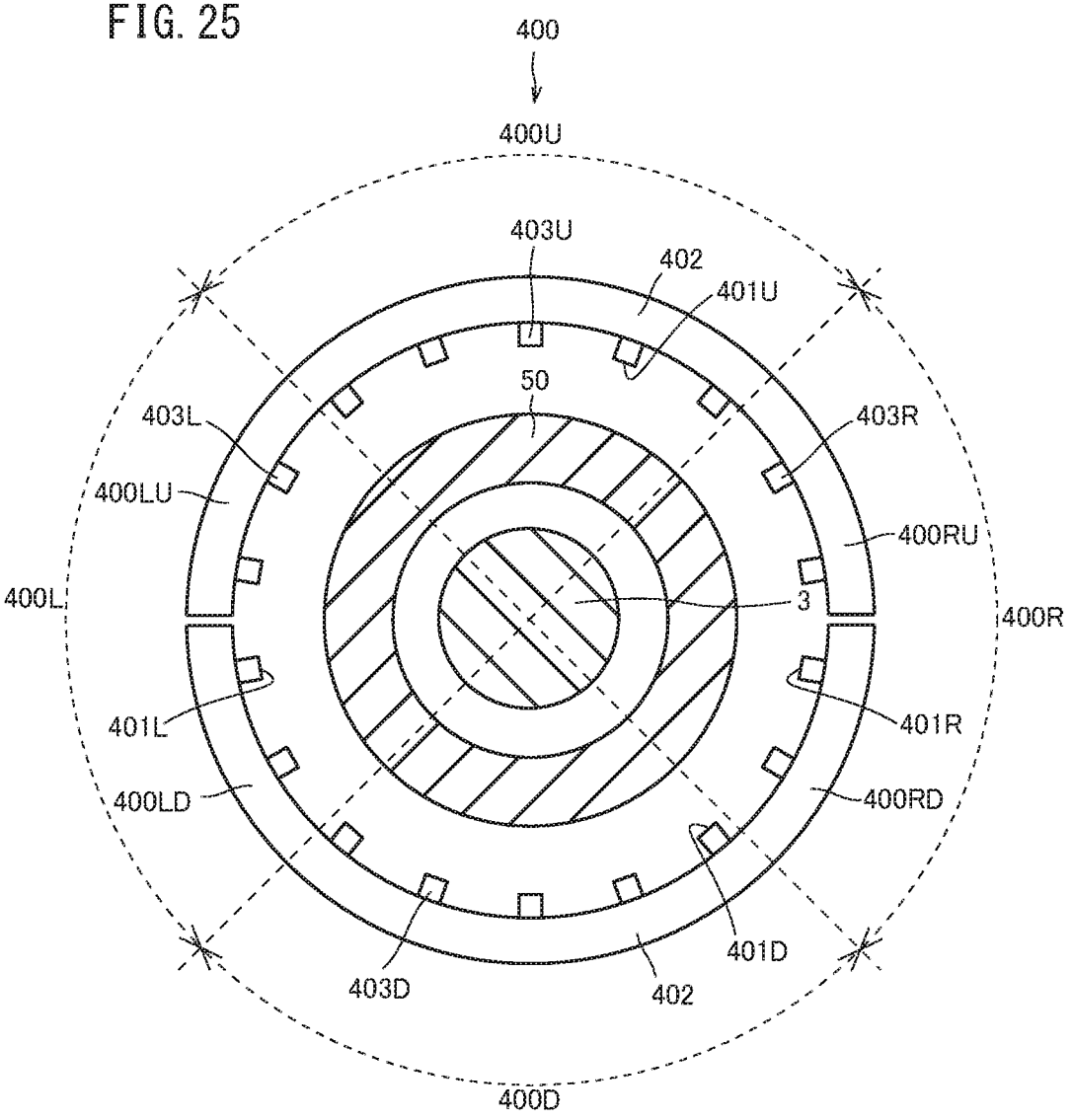
FIG. 25 is a front view of an outer surface cooling mechanism of a different form from the outer surface cooling mechanisms illustrated in FIG. 23 and FIG. 24.

Further, any of the outer surface cooling upper member 400U, the outer surface cooling lower member 400D, the outer surface cooling left member 400L and the outer surface cooling right member 400R may be constituted by a plurality of members, and parts of adjacent outer surface cooling members may be connected. In FIG. 25, the outer surface cooling left member 400L is constituted by two members (400LU, 400LD). Further, an upper member 400LU of the outer surface cooling left member 400L is connected to the outer surface cooling upper member 400U, and a lower member 400LD of the outer surface cooling left member 400L is connected to the outer surface cooling lower member 400D. Furthermore, the outer surface cooling right member 400R is constituted by two members (400RU, 400RD). An upper member 400RU of the outer surface cooling right member 400R is connected to the outer surface cooling upper member 400U, and a lower member 400RD of the outer surface cooling right member 400R is connected to the outer surface cooling lower member 400D.

In short, each of the outer surface cooling members (the outer surface cooling upper member 400U, the outer surface cooling lower member 400D, the outer surface cooling left member 400L and the outer surface cooling right member 400R) may include a plurality of members, and a part or all of each of the outer surface cooling members may be formed integrally with another outer surface cooling member. As long as the outer surface cooling upper member 400U ejects the cooling fluid CF toward the upper part of the outer surface of the hollow shell 50, the outer surface cooling lower member 400D ejects the cooling fluid CF toward the lower part of the outer surface of the hollow shell 50, the outer surface cooling left member 400L ejects the cooling fluid CF toward the left part of the outer surface of the hollow shell 50, and the outer surface cooling right member 400R ejects the cooling fluid CF toward the right part of the outer surface of the hollow shell 50, the configuration of each of the outer surface cooling members (the outer surface cooling upper member 400U, the outer surface cooling lower member 400D, the outer surface cooling left member 400L and the outer surface cooling right member 400R) is not particularly limited.

[Operations of Outer Surface Cooling Mechanism 400]

Of the entire hollow shell 50 subjected to piercing-rolling or elongating rolling by the piercing machine 10 and passed through the skewed rolls 1, the outer surface cooling mechanism 400 having the configuration described above ejects the cooling fluid CF toward the upper part, the lower part, the left part and the right part of the outer surface of the hollow shell 50 that is passing through the cooling zone 32 and thereby cools the hollow shell 50 within the cooling zone 32 of the specific length L32. More specifically, when seen from the advancing direction of the hollow shell 50, the outer surface cooling upper member 400U ejects the cooling fluid CF toward the upper part of the outer surface of the hollow shell 50 within the cooling zone 32, the outer surface cooling lower member 400D ejects the cooling fluid CF toward the lower part of the outer surface of the hollow shell 50 within the cooling zone 32, the outer surface cooling left member 400L ejects the cooling fluid CF toward the left part of the outer surface of the hollow shell 50 within the cooling zone 32, and the outer surface cooling right member 400R ejects the cooling fluid CF toward the right part of the outer surface of the hollow shell 50 within the cooling zone 32, to thereby cool the entire outer surface (upper part, lower part, left part and right part of the outer surface) of the hollow shell 50 within the cooling zone 32. By this means, the outer surface cooling mechanism 400 suppresses a temperature difference between the fore end portion and rear end portion of the hollow shell 50 from becoming large, and suppresses the occurrence of temperature variations in the axial direction of the hollow shell 50. Hereunder, the operations of the outer surface cooling mechanism 400 when the piercing machine 10 performs piercing-rolling or elongating rolling are described.

The piercing machine 10 subjects the material 20 to piercing-rolling or elongating rolling to produce the hollow shell 50. In a case where the piercing machine 10 is a piercing mill, the piercing machine 10 subjects a round billet that is the material 20 to piercing-rolling to form the hollow shell 50. In a case where the piercing machine 10 is an elongator, the piercing machine 10 subjects a hollow shell that is the material 20 to elongating rolling to form the hollow shell 50.

Referring to FIG. 22, when the piercing machine 10 performs piercing-rolling or elongating rolling, the outer surface cooling mechanism 400 receives a supply of the cooling fluid CF from a fluid supply source 800. Here, as described above, the cooling fluid CF is a gas and/or a liquid. The cooling fluid CF may be a gas only, or may be a liquid only. The cooling fluid CF may be a mixed fluid of a gas and a liquid.

The fluid supply source 800 includes a storage tank 801 for storing the cooling fluid CF, and a supply mechanism 802 that supplies the cooling fluid CF. In a case where the cooling fluid CF is a gas, the supply mechanism 802, for example, includes a valve 803 for starting and stopping the supply of the cooling fluid CF, and a fluid driving source (gas pressure control unit) 804 for supplying the fluid (gas). In a case where the cooling fluid CF is a liquid, the supply mechanism 802, for example, includes a valve 803 for starting and stopping the supply of the cooling fluid CF, and a fluid driving source (pump) 804 for supplying the fluid (liquid). In a case where the cooling fluid CF is a gas and a liquid, the supply mechanism 802 includes a mechanism for supplying gas and a mechanism for supplying liquid. The fluid supply source 800 is not limited to the configuration described above. The configuration of the fluid supply source 800 is not limited as long as the fluid supply source 800 is capable of supplying cooling fluid to the outer surface cooling mechanism 400, and the configuration of the fluid supply source 800 may be a well-known configuration.

The cooling fluid CF that is supplied to the outer surface cooling mechanism 400 from the fluid supply source 800 passes through the cooling fluid path inside the main body 402 of the outer surface cooling upper member 400U of the outer surface cooling mechanism 400, and reaches each cooling fluid upper-part ejection hole 401U. The cooling fluid CF also passes through the cooling fluid path inside the main body 402 of the outer surface cooling lower member 400D, and reaches each cooling fluid lower-part ejection hole 401D. Further, the cooling fluid CF passes through the cooling fluid path inside the main body 402 of the outer surface cooling left member 400L, and reaches each cooling fluid left-part ejection hole 401L. The cooling fluid CF also passes through the cooling fluid path inside the main body 402 of outer surface cooling right member 400R, and reaches each cooling fluid right-part ejection hole 401R. The outer surface cooling mechanism 400 then ejects the cooling fluid CF toward the upper part, the lower part, the left part and the right part of the outer surface of the hollow shell 50 subjected to piercing-rolling or elongating rolling and passed by the rear end of the plug 2 and entered the cooling zone 32, and thereby cools the hollow shell 50.

At this time, as illustrated in FIG. 22, within the area of the cooling zone 32 that has a specific length in the axial direction of the mandrel bar 3, the outer surface cooling mechanism 400 ejects the cooling fluid CF toward the upper part, the lower part, the left part and the right part of the outer surface of the hollow shell 50 to thereby cool the hollow shell 50. The term "cooling zone 32" means the area within which the cooling fluid CF is ejected by the outer surface cooling mechanism 400. The cooling zone 32 is an area that surrounds the entire circumference of the mandrel bar 3 when seen in the advancing direction of the hollow shell 50 (when seen from the frontward side of the piercing machine 10 toward the rearward side thereof). That is, the cooling zone 32 is a circular cylindrical area that extends in the axial direction of the mandrel bar 3.

Changing of the area of the cooling zone 32 is not scheduled while one material 20 is being subjected to piercing-rolling or elongating rolling. That is, the cooling zone 32 is substantially fixed during piercing-rolling or elongating rolling of one material 20. The cooling zone 32 is substantially determined by the positions at which the plurality of coolant ejection holes 341 of the inner surface cooling mechanism 340 are disposed. In a case where the outer surface cooling mechanism 400 includes a plurality of cooling fluid ejection holes 401 (cooling fluid upper-part ejection holes 401U, cooling fluid lower-part ejection holes 401D, cooling fluid left-part ejection holes 401L and cooling fluid right-part ejection holes 401R), the plurality of cooling fluid ejection holes 401 (cooling fluid upper-part ejection holes 401U, cooling fluid lower-part ejection holes 401D, cooling fluid left-part ejection holes 401L and cooling fluid right-part ejection holes 401R) are disposed inside the cooling zone 32.

As described above, in the present embodiment, in the piercing machine 10, using the outer surface cooling mechanism 400 that is disposed around the mandrel bar 3 rearward of the plug 2, the inner surface cooling mechanism 340 cools the inner surface of the hollow shell 50 inside the cooling zone 32 having the specific length L32 that is disposed rearward of the plug 2. In addition, when seen in the advancing direction of the hollow shell 50, the outer surface cooling mechanism 400 ejects the cooling fluid CF toward the upper part, the lower part, the left part and the right part of the outer surface of the hollow shell 50 to cool the hollow shell 50 within the cooling zone 32. At such time, the outer surface portion (upper part, lower part, left part and right part) of the hollow shell 50 that is advancing through the cooling zone 32 contacts the cooling fluid CF, and the hollow shell 50 is thereby cooled. On the other hand, outside the area of the cooling zone 32 (frontward of the cooling zone 32 and rearward of the cooling zone 32), it is difficult for the outer surface portion of the hollow shell 50 to contact the cooling fluid CF. The reason is that after contacting the outer surface portion of the hollow shell 50 in the cooling zone 32, most of the cooling fluid CF ejected from the outer surface cooling mechanism 400 runs down naturally to below the hollow shell 50 under the force of gravity. Therefore, the inner surface and the outer surface of the hollow shell 50 that are within the cooling zone 32 are cooled by the inner surface cooling mechanism 340 and the outer surface cooling mechanism 400, and the coolant CL and the cooling fluid CF can be suppressed from contacting the inner surface and outer surface of the hollow shell 50 in a zone other than the cooling zone 32. As a result, temperature differences in the axial direction of the hollow shell 50 after cooling can be suppressed, and in particular a temperature difference between the fore end portion and the rear end portion of the hollow shell 50 can be reduced.

[Method for Producing Seamless Metal Pipe in Fourth Embodiment]

In the fourth embodiment, during piercing-rolling or during elongating rolling, the inner surface cooling mechanism 340 cools the inner surface portion of the hollow shell 50 within the cooling zone 32, and the outer surface cooling mechanism 400 cools the outer surface portion of the hollow shell 50 within the cooling zone. Therefore, cooling of the hollow shell 50 can be promoted immediately after piercing-rolling or elongating rolling is completed (that is, immediately after the hollow shell 50 passes the plug 2). In particular, a useful effect is obtained in the case of producing a heavy-wall seamless metal pipe (for example, a seamless metal pipe with a wall thickness of 30 mm or more).

According to the aforementioned cooling process, during the rolling process (piercing-rolling or elongating rolling) the inner surface cooling mechanism 340 cools the inner surface portion of the hollow shell 50 within the cooling zone 32, and of the entire outer surface of the hollow shell 50 that is advancing through the cooling zone 32, the cooling fluid CF is ejected toward the upper part of the outer surface, the lower part of the outer surface, the left part of the outer surface and the right part of the outer surface of the hollow shell as seen in the advancing direction of the hollow shell 50, to thereby cool the hollow shell 50 inside the cooling zone 32. Thus, as described above, temperature variations in the axial direction of the hollow shell 50 after cooling can be reduced, and a temperature difference between the fore end portion and the rear end portion of the hollow shell 50 can be reduced.

Note that, although in the configurations illustrated in FIG. 22 to FIG. 25, the outer surface cooling mechanism 400 cools the outer surface portion of the hollow shell 50 in the cooling zone 32 by ejecting the cooling fluid CF from the plurality of cooling fluid ejection holes 401 (cooling fluid upper-part ejection holes 401U, cooling fluid lower-part ejection holes 401D, cooling fluid left-part ejection holes 401L and cooling fluid right-part ejection holes 401R), the shape of the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) is not particularly limited. The cooling fluid ejection holes 401 (cooling fluid upper-part ejection holes 401U, cooling fluid lower-part ejection holes 401D, cooling fluid left-part ejection holes 401L and cooling fluid right-part ejection holes 401R) may be a circular shape, may be an oval shape or may be a rectangular shape. For example, the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) may be an oval shape or rectangular shape that extends in the axial direction of the mandrel bar 3, or may be an oval shape or rectangular shape that extends in the circumferential direction of the mandrel bar 3. As long as the plurality of cooling fluid ejection holes 401 (cooling fluid upper-part ejection holes 401U, cooling fluid lower-part ejection holes 401D, cooling fluid left-part ejection holes 401L and cooling fluid right-part ejection holes 401R) can eject the cooling fluid CF and cool the outer surface portion of the hollow shell 50 within the area of the cooling zone 32, the shape of the plurality of cooling fluid ejection holes 401 (cooling fluid upper-part ejection holes 401U, cooling fluid lower-part ejection holes 401D, cooling fluid left-part ejection holes 401L and cooling fluid right-part ejection holes 401R) is not particularly limited.

Although in FIG. 22 the plurality of the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) are arrayed in the axial direction of the mandrel bar 3, the plurality of the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) need not be arrayed in the axial direction of the mandrel bar 3. Further, although in FIG. 23 to FIG. 25 the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) are arrayed at regular intervals around the mandrel bar 3, arraying of the cooling fluid ejection holes 401 (cooling fluid upper-part ejection holes 401U, cooling fluid lower-part ejection holes 401D, cooling fluid left-part ejection holes 401L and cooling fluid right-part ejection holes 401R) around the mandrel bar 3 need not be in a manner in which the cooling fluid ejection holes 401 are arrayed at regular intervals.

Fifth Embodiment

Figure 26:
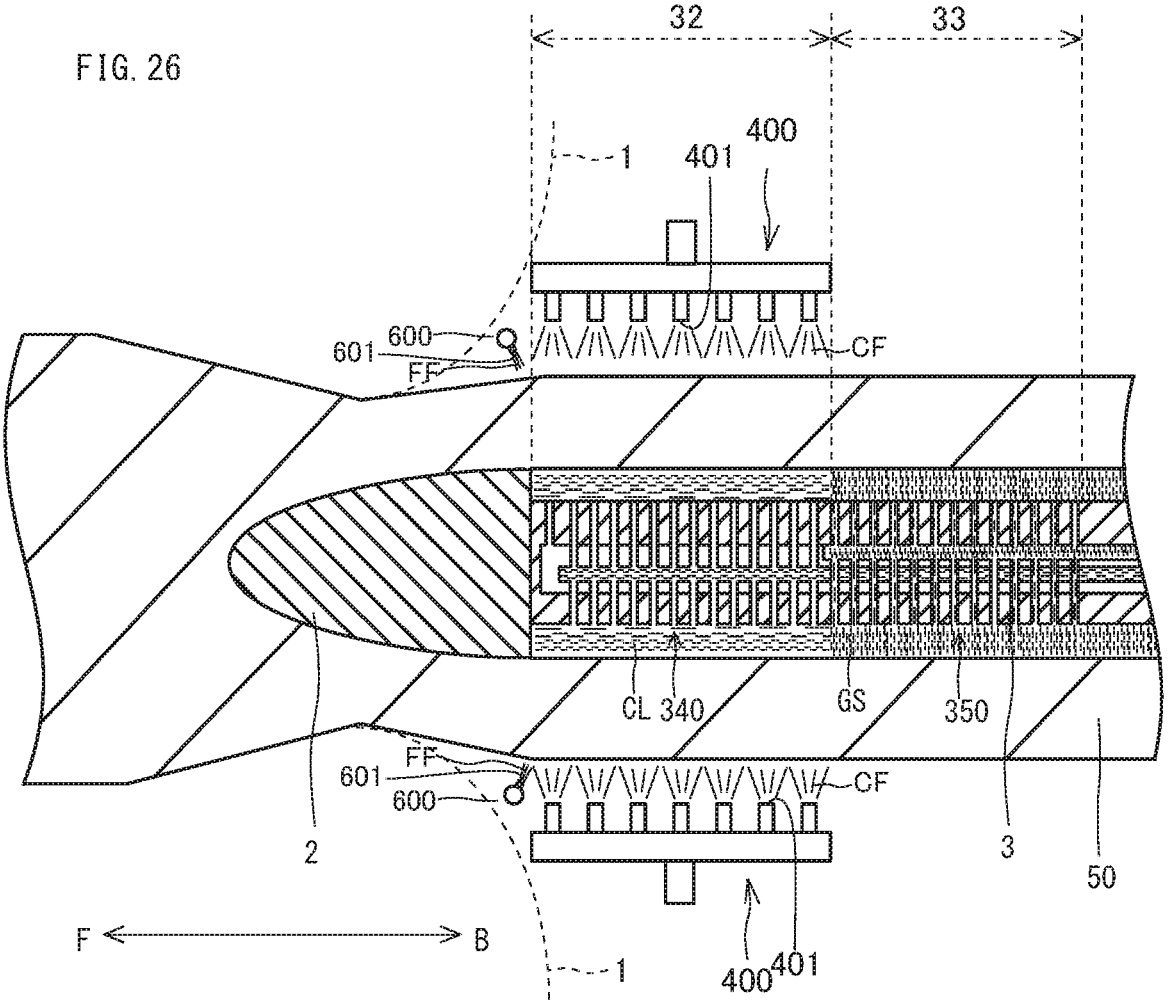
FIG. 26 is a longitudinal sectional drawing illustrating the vicinity of skewed rolls when a material is subjected to piercing-rolling or elongating rolling by a piercing machine according to a fifth embodiment.

FIG. 26 is a view illustrating a configuration on the delivery side of the skewed rolls 1 of a piercing machine 10 according to a fifth embodiment. Referring to FIG. 26, in comparison to the piercing machine 10 according to the fourth embodiment, the piercing machine 10 according to the fifth embodiment newly includes a frontward damming mechanism 600. The remaining configuration of the piercing machine 10 according to the fifth embodiment is the same as the configuration of the piercing machine 10 according to the fourth embodiment.

[Frontward Damming Mechanism 600]

The frontward damming mechanism 600 is disposed around the mandrel bar 3 at a position that is rearward of the plug 2 and is frontward of the outer surface cooling mechanism 400. The frontward damming mechanism 600 is equipped with a mechanism that, when the outer surface cooling mechanism 400 is cooling the hollow shell in the cooling zone 32 by ejecting the cooling fluid CF toward the upper part of the outer surface, the lower part of the outer surface, the left part of the outer surface and the right part of the outer surface of the hollow shell 50 in the cooling zone 32, dams the cooling fluid from flowing to the upper part of the outer surface, the lower part of the outer surface, the left part of the outer surface and the right part of the outer surface of the hollow shell 50 before the aforementioned parts of the outer surface of the hollow shell 50 enter the cooling zone 32.

Figure 27:
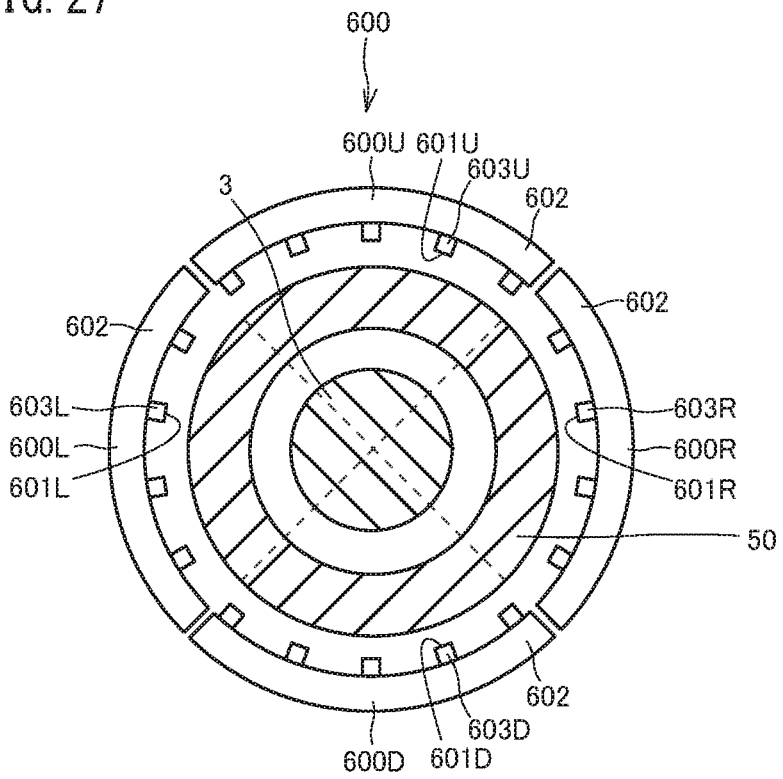
FIG. 27 is a front view of a frontward damming mechanism illustrated in FIG. 26, as seen from the advancing direction of a hollow shell.

FIG. 27 is a view illustrating the frontward damming mechanism 600 as seen in the advancing direction of the hollow shell 50 (view of the frontward damming mechanism 600 when seen from the entrance side toward the delivery side of the skewed rolls 1). Referring to FIG. 26 and FIG. 27, when seen in the advancing direction of the hollow shell 50, the frontward damming mechanism 600 is disposed around the mandrel bar 3. Further, during piercing-rolling or elongating rolling, as illustrated in FIG. 27, the frontward damming mechanism 600 is disposed around the hollow shell 50 subjected to piercing-rolling or elongating rolling.

Referring to FIG. 27, when seen in the advancing direction of the hollow shell 50, the frontward damming mechanism 600 includes a frontward damming upper member 600U, a frontward damming lower member 600D, a frontward damming left member 600L and a frontward damming right member 600R.

[Configuration of Frontward Damming Upper Member 600U]

The frontward damming upper member 600U is disposed above the mandrel bar 3. The frontward damming upper member 600U includes a main body 602 and a plurality of frontward damming fluid upper-part ejection holes 601U. The main body 602 is a tube-shaped or plate-shaped casing that is curved in the circumferential direction of the mandrel bar 3, and includes therein one or more fluid paths which allow a frontward damming fluid FF (see FIG. 26) to pass therethrough. In the present example, the plurality of frontward damming fluid upper-part ejection holes 601U are formed in a front end of a plurality of frontward damming fluid upper-part ejection nozzles 603U. However, the frontward damming fluid upper-part ejection holes 601U may be formed directly in the main body 602. In the present example, the plurality of frontward damming fluid upper-part ejection nozzles 603U that are arrayed around the mandrel bar 3 are connected to the main body 602.

When the hollow shell 50 subjected to piercing-rolling or elongating rolling passes through the inside of the outer surface cooling mechanism 400, the plurality of frontward damming fluid upper-part ejection holes 601U of the frontward damming upper member 600U face the upper part of the outer surface of the hollow shell 50 that is positioned in the vicinity of the entrance side of the cooling zone 32. When seen in the advancing direction of the hollow shell 50, the plurality of frontward damming fluid upper-part ejection holes 601U are arrayed around the mandrel bar 3, in the circumferential direction of the mandrel bar 3. Preferably, the plurality of frontward damming fluid upper-part ejection holes 601U are arrayed at regular intervals around the mandrel bar. The plurality of frontward damming fluid upper-part ejection holes 601U may also be arrayed side-by-side in the axial direction of the mandrel bar 3.

During piercing-rolling or elongating rolling, when the outer surface cooling mechanism 400 is cooling the hollow shell 50 in the cooling zone 32, the frontward damming upper member 600U ejects the frontward damming fluid FF toward an upper part of the outer surface of the hollow shell 50 that is positioned in the vicinity of the entrance side of the cooling zone 32 from the plurality of frontward damming fluid upper-part ejection holes 601U to thereby dam the cooling fluid CF from flowing to the upper part of the outer surface of the hollow shell 50 before the upper part of the outer surface of the hollow shell 50 enters the cooling zone 32.

[Configuration of Frontward Damming Lower Member 600D]

The frontward damming lower member 600D is disposed below the mandrel bar 3. The frontward damming lower member 600D includes a main body 602 and a plurality of frontward damming fluid lower-part ejection holes 601D. The main body 602 is a tube-shaped or plate-shaped casing that is curved in the circumferential direction of the mandrel bar 3, and includes therein one or more fluid paths which allow the frontward damming fluid FF to pass therethrough. In the present example, the plurality of frontward damming fluid lower-part ejection holes 601D are formed in a front end of a plurality of frontward damming fluid lower-part ejection nozzles 603D. However, the frontward damming fluid lower-part ejection holes 601D may be formed directly in the main body 602. In the present example, the plurality of frontward damming fluid lower-part ejection nozzles 603D that are arrayed around the mandrel bar 3 are connected to the main body 602.

When the hollow shell 50 subjected to piercing-rolling or elongating rolling passes through the inside of the outer surface cooling mechanism 400, the plurality of frontward damming fluid lower-part ejection holes 601D of the frontward damming lower member 600D face the lower part of the outer surface of the hollow shell 50 that is positioned in the vicinity of the entrance side of the cooling zone 32. When seen in the advancing direction of the hollow shell 50, the plurality of frontward damming fluid lower-part ejection holes 601D are arrayed around the mandrel bar 3, in the circumferential direction of the mandrel bar 3. Preferably, the plurality of frontward damming fluid lower-part ejection holes 601D are arrayed at regular intervals around the mandrel bar. The plurality of frontward damming fluid lower-part ejection holes 601D may also be arrayed side-by-side in the axial direction of the mandrel bar 3.

During piercing-rolling or elongating rolling, when the outer surface cooling mechanism 400 is cooling the hollow shell 50 in the cooling zone 32, the frontward damming lower member 600D ejects the frontward damming fluid FF toward a lower part of the outer surface of the hollow shell 50 that is positioned in the vicinity of the entrance side of the cooling zone 32 from the plurality of frontward damming fluid lower-part ejection holes 601D to thereby dam the cooling fluid CF from flowing to the lower part of the outer surface of the hollow shell 50 before the lower part of the outer surface of the hollow shell 50 enters the cooling zone 32.

[Configuration of Frontward Damming Left Member 600L]

The frontward damming left member 600L is disposed leftward of the mandrel bar 3 when seen in the advancing direction of the hollow shell 50. The frontward damming left member 600L includes a main body 602 and a plurality of frontward damming fluid left-part ejection holes 601L. The main body 602 is a tube-shaped or plate-shaped casing that is curved in the circumferential direction of the mandrel bar 3, and includes therein one or more fluid paths which allow the frontward damming fluid FF to pass therethrough. In the present example, the plurality of frontward damming fluid left-part ejection holes 601L are formed in a front end of a plurality of frontward damming fluid left-part ejection nozzles 603L. However, the frontward damming fluid left-part ejection holes 601L may be formed directly in the main body 602. In the present example, the plurality of frontward damming fluid left-part ejection nozzles 603L that are arrayed around the mandrel bar 3 are connected to the main body 602.

When the hollow shell 50 subjected to piercing-rolling or elongating rolling passes through the inside of the outer surface cooling mechanism 400, the plurality of frontward damming fluid left-part ejection holes 601L of the frontward damming left member 600L face the left part of the outer surface of the hollow shell 50 that is positioned in the vicinity of the entrance side of the cooling zone 32. When seen in the advancing direction of the hollow shell 50, the plurality of frontward damming fluid left-part ejection holes 601L are arrayed around the mandrel bar 3, in the circumferential direction of the mandrel bar 3. Preferably, the plurality of frontward damming fluid left-part ejection holes 601L are arrayed at regular intervals around the mandrel bar. The plurality of frontward damming fluid left-part ejection holes 601L may also be arrayed side-by-side in the axial direction of the mandrel bar 3.

During piercing-rolling or elongating rolling, when the outer surface cooling mechanism 400 is cooling the hollow shell 50 in the cooling zone 32, the frontward damming left member 600L ejects the frontward damming fluid FF toward a left part of the outer surface of the hollow shell 50 that is positioned in the vicinity of the entrance side of the cooling zone 32 from the plurality of frontward damming fluid left-part ejection holes 601L to thereby dam the cooling fluid CF from flowing to the left part of the outer surface of the hollow shell 50 before the left part of the outer surface of the hollow shell 50 enters the cooling zone 32.

[Configuration of Frontward Damming Right Member 600R]

The frontward damming right member 600R is disposed rightward of the mandrel bar 3 when seen in the advancing direction of the hollow shell 50. The frontward damming right member 600R includes a main body 602 and a plurality of frontward damming fluid right-part ejection holes 601R. The main body 602 is a tube-shaped or plate-shaped casing that is curved in the circumferential direction of the mandrel bar 3, and includes therein one or more fluid paths which allow the frontward damming fluid FF to pass therethrough. In the present example, the plurality of frontward damming fluid right-part ejection holes 601R are formed in a front end of a plurality of frontward damming fluid right-part ejection nozzles 603R. However, the frontward damming fluid right-part ejection holes 601R may be formed directly in the main body 602. In the present example, the plurality of frontward damming fluid right-part ejection nozzles 603R that are arrayed around the mandrel bar 3 are connected to the main body 602.

When the hollow shell 50 subjected to piercing-rolling or elongating rolling passes through the inside of the outer surface cooling mechanism 400, the plurality of frontward damming fluid right-part ejection holes 601R of the frontward damming right member 600R face the right part of the outer surface of the hollow shell 50 that is positioned in the vicinity of the entrance side of the cooling zone 32. When seen in the advancing direction of the hollow shell 50, the plurality of frontward damming fluid right-part ejection holes 601R are arrayed around the mandrel bar 3, in the circumferential direction of the mandrel bar 3. Preferably, the plurality of frontward damming fluid right-part ejection holes 601R are arrayed at regular intervals around the mandrel bar. The plurality of frontward damming fluid right-part ejection holes 601R may also be arrayed side-by-side in the axial direction of the mandrel bar 3.

During piercing-rolling or elongating rolling, when the outer surface cooling mechanism 400 is cooling the hollow shell 50 in the cooling zone 32, the frontward damming right member 600R ejects the frontward damming fluid FF toward a right part of the outer surface of the hollow shell 50 that is positioned in the vicinity of the entrance side of the cooling zone 32 from the plurality of frontward damming fluid right-part ejection holes 601R to thereby dam the cooling fluid CF from flowing to the right part of the outer surface of the hollow shell 50 before the right part of the outer surface of the hollow shell 50 enters the cooling zone 32.

[Operations of Frontward Damming Mechanism 600]

During piercing-rolling or elongating rolling, of the entire outer surface of the hollow shell 50 subjected to piercing-rolling or elongating rolling, the outer surface cooling mechanism 400 ejects the cooling fluid CF at the outer surface portion of the hollow shell 50 that is inside the cooling zone 32 to thereby cool the hollow shell 50. At this time, after the cooling fluid CF ejected at the outer surface portion of the hollow shell 50 inside the cooling zone 32 contacts the outer surface portion of the hollow shell 50, a situation can arise in which the cooling fluid CF flows to frontward of the outer surface portion and contacts the outer surface portion of the hollow shell 50 that is frontward of the cooling zone 32. If the frequency at which contact of the cooling fluid CF with an outer surface portion of the hollow shell 50 in a zone other than the cooling zone 32 occurs is high, variations can arise in the temperature distribution in the axial direction of the hollow shell 50.

Therefore, in the present embodiment, during piercing-rolling or elongating rolling, the frontward damming mechanism 600 suppresses the cooling fluid CF that flows over the outer surface after contacting the outer surface portion of the hollow shell 50 inside the cooling zone 32 from contacting the outer surface portion of the hollow shell 50 that is frontward of the cooling zone 32.

The frontward damming mechanism 600 is equipped with a mechanism that, when the outer surface cooling mechanism 400 is cooling the hollow shell inside the cooling zone 32 by ejecting the cooling fluid CF toward the upper part of the outer surface, the lower part of the outer surface, the left part of the outer surface and the right part of the outer surface of the hollow shell 50 inside the cooling zone 32, dams the cooling fluid from flowing to the upper part, the lower part, the left part and the right part of the outer surface of the hollow shell 50 before the aforementioned parts of the outer surface of the hollow shell 50 enter the cooling zone 32. Specifically, when seen in the advancing direction of the hollow shell 50, the frontward damming upper member 600U ejects the frontward damming fluid FF toward the upper part of the outer surface of the hollow shell 50 that is positioned in the vicinity of the entrance side of the cooling zone 32 to thereby form a dam (protective wall) composed of the frontward damming fluid FF at the upper part of the outer surface of the hollow shell 50 before the upper part of the outer surface of the hollow shell 50 enters the cooling zone 32. Similarly, the frontward damming lower member 600D ejects the frontward damming fluid FF toward the lower part of the outer surface of the hollow shell 50 that is positioned in the vicinity of the entrance side of the cooling zone 32 to thereby form a dam (protective wall) composed of the frontward damming fluid FF at the lower part of the outer surface of the hollow shell 50 before the lower part of the outer surface of the hollow shell 50 enters the cooling zone 32. Similarly, the frontward damming left member 600L ejects the frontward damming fluid FF toward the left part of the outer surface of the hollow shell 50 that is positioned in the vicinity of the entrance side of the cooling zone 32 to thereby form a dam (protective wall) composed of the frontward damming fluid FF at the left part of the outer surface of the hollow shell 50 before the left part of the outer surface of the hollow shell 50 enters the cooling zone 32. Similarly, the frontward damming right member 600R ejects the frontward damming fluid FF toward the right part of the outer surface of the hollow shell 50 that is positioned in the vicinity of the entrance side of the cooling zone 32 to thereby form a dam (protective wall) composed of the frontward damming fluid FF at the right part of the outer surface of the hollow shell 50 before the right part of the outer surface of the hollow shell 50 enters the cooling zone 32. These dams that are composed of the frontward damming fluid FF dam the cooling fluid CF that contacts the outer surface portion of the hollow shell 50 within the cooling zone 32 and rebounds therefrom and attempts to flow to the zone frontward of the cooling zone 32. Therefore, contact of the cooling fluid CF with the outer surface portion of the hollow shell 50 that is frontward of the cooling zone 32 can be suppressed, and temperature variations in the axial direction of the hollow shell 50 can be further reduced.

Figure 28:
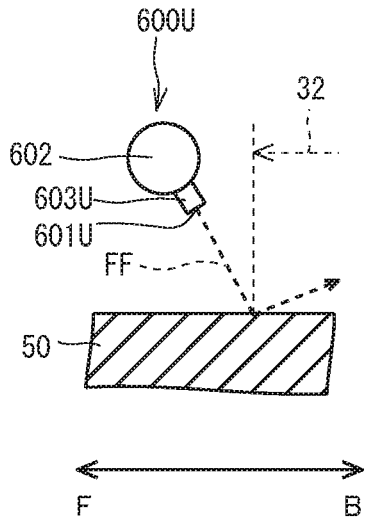
FIG. 28 is a sectional drawing of a frontward damming upper member illustrated in FIG. 27, as seen from a direction parallel to the advancing direction of the hollow shell.
Figure 29:
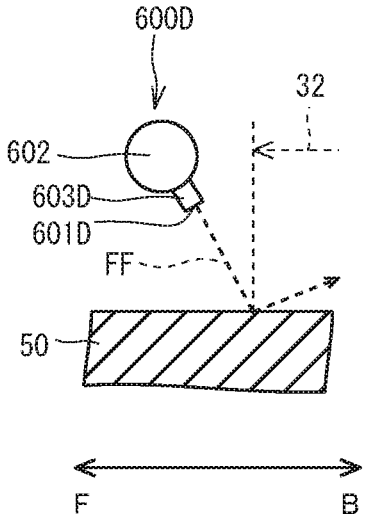
FIG. 29 is a sectional drawing of a frontward damming lower member illustrated in FIG. 27, as seen from a direction parallel to the advancing direction of the hollow shell.
Figure 30:
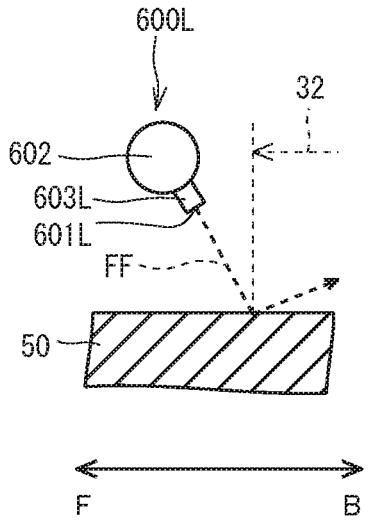
FIG. 30 is a sectional drawing of a frontward damming left member illustrated in FIG. 27, as seen from a direction parallel to the advancing direction of the hollow shell.
Figure 31:
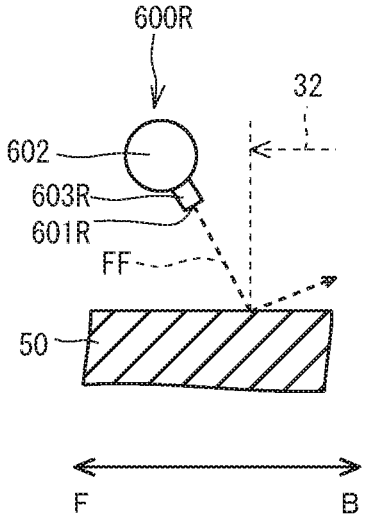
FIG. 31 is a sectional drawing of a frontward damming right member illustrated in FIG. 27, as seen from a direction parallel to the advancing direction of the hollow shell.

FIG. 28 is a sectional drawing of the frontward damming upper member 600U, when seen from a direction parallel to the advancing direction of the hollow shell 50. FIG. 29 is a sectional drawing of the frontward damming lower member 600D, when seen from a direction parallel to the advancing direction of the hollow shell 50. FIG. 30 is a sectional drawing of the frontward damming left member 600L, when seen from a direction parallel to the advancing direction of the hollow shell 50. FIG. 31 is a sectional drawing of the frontward damming right member 600R, when seen from a direction parallel to the advancing direction of the hollow shell 50.

Referring to FIG. 28, preferably the frontward damming upper member 600U ejects the frontward damming fluid FF diagonally rearward towards the upper part of the outer surface of the hollow shell 50 that is positioned in the vicinity of the entrance side of the cooling zone 32 from the frontward damming fluid upper-part ejection holes 601U. Referring to FIG. 29, preferably the frontward damming lower member 600D ejects the frontward damming fluid FF diagonally rearward towards the lower part of the outer surface of the hollow shell 50 that is positioned in the vicinity of the entrance side of the cooling zone 32 from the frontward damming fluid lower-part ejection holes 601D. Referring to FIG. 30, preferably the frontward damming left member 600L ejects the frontward damming fluid FF diagonally rearward towards the left part of the outer surface of the hollow shell 50 that is positioned in the vicinity of the entrance side of the cooling zone 32 from the frontward damming fluid left-part ejection holes 601L. Referring to FIG. 31, preferably the frontward damming right member 600R ejects the frontward damming fluid FF diagonally rearward towards the right part of the outer surface of the hollow shell 50 that is positioned in the vicinity of the entrance side of the cooling zone 32 from the frontward damming fluid right-part ejection holes 601R.

In FIG. 28 to FIG. 31, the frontward damming upper member 600U forms a dam (protective wall) composed of the frontward damming fluid FF that extends diagonally rearward toward the upper part of the outer surface of the hollow shell 50 from above the hollow shell 50. Similarly, the frontward damming lower member 600D forms a dam (protective wall) composed of the frontward damming fluid FF that extends diagonally rearward toward the lower part of the outer surface of the hollow shell 50 from below the hollow shell 50. Similarly, the frontward damming left member 600L forms a dam (protective wall) composed of the frontward damming fluid FF that extends diagonally rearward toward the left part of the outer surface of the hollow shell 50 from leftward of the hollow shell 50. Similarly, the frontward damming right member 600R forms a dam (protective wall) composed of the frontward damming fluid FF that extends diagonally rearward toward the right part of the outer surface of the hollow shell 50 from rightward of the hollow shell 50. These dams dam the cooling fluid CF that contacts the outer surface portion of the hollow shell 50 within the cooling zone 32 and rebounds therefrom and attempts to fly out to the zone that is frontward of the cooling zone 32. In addition, after the frontward damming fluid FF constituting the dams contacts the outer surface portion of the hollow shell 50 in the vicinity of the entrance side of the cooling zone 32, as illustrated in FIG. 28 to FIG. 31, it is easy for the frontward damming fluid FF to rebound into the inside of the cooling zone 32, and the frontward damming fluid FF easily flows inside the cooling zone 32. Therefore, the frontward damming fluid FF constituting the dams can suppress contact of the frontward damming fluid FF with an outer surface portion of the hollow shell 50 that is further frontward than the cooling zone 32.

Note that, the respective frontward damming members (frontward damming upper member 600U, frontward damming lower member 600D, frontward damming left member 600L and frontward damming right member 600R) need not eject the frontward damming fluid FF diagonally rearward toward the upper part, the lower part, the left part and the right part of the outer surface of the hollow shell 50 positioned in the vicinity of the entrance side of the cooling zone 32 from the respective frontward damming fluid upper-part ejection holes (601U, 601D, 601L, 601R). For example, the frontward damming upper member 600U may eject the frontward damming fluid FF in the radial direction of the mandrel bar 3 from the frontward damming fluid upper-part ejection holes 601U. The frontward damming lower member 600D may eject the frontward damming fluid FF in the radial direction of the mandrel bar 3 from the frontward damming fluid lower-part ejection holes 601D. The frontward damming left member 600L may eject the frontward damming fluid FF in the radial direction of the mandrel bar 3 from the frontward damming fluid left-part ejection holes 601L. The frontward damming right member 600R may eject the frontward damming fluid FF in the radial direction of the mandrel bar 3 from the frontward damming fluid right-part ejection holes 601R.

The frontward damming fluid FF is a gas and/or a liquid. That is, as the frontward damming fluid FF, a gas may be used, a liquid may be used, or both a gas and a liquid may be used. Here, the gas is, for example, air or an inert gas. The inert gas is, for example, argon gas or nitrogen gas. In the case of utilizing a gas as the frontward damming fluid FF, only air may be utilized, or only an inert gas may be utilized, or both air and an inert gas may be utilized. Further, as the inert gas, only one kind of inert gas (for example, argon gas only, or nitrogen gas only) may be utilized, or a plurality of inert gases may be mixed and utilized. In the case of utilizing a liquid as the frontward damming fluid FF, the liquid is, for example, water or oil, and preferably is water.

The frontward damming fluid FF may be the same fluid as the cooling fluid CF, or may be a different fluid from the cooling fluid CF. The frontward damming mechanism 600 receives a supply of the frontward damming fluid FF from an unshown fluid supply source. A configuration of the fluid supply source is, for example, the same as the configuration of the fluid supply source 800. The frontward damming fluid FF supplied from the fluid supply source passes through the fluid path inside each main body 602 of the frontward damming mechanism 600, and is ejected from the frontward damming fluid ejection holes (frontward damming fluid upper-part ejection holes 601U, frontward damming fluid lower-part ejection holes 601D, frontward damming fluid left-part ejection holes 601L and frontward damming fluid right-part ejection holes 601R).

Figure 32:
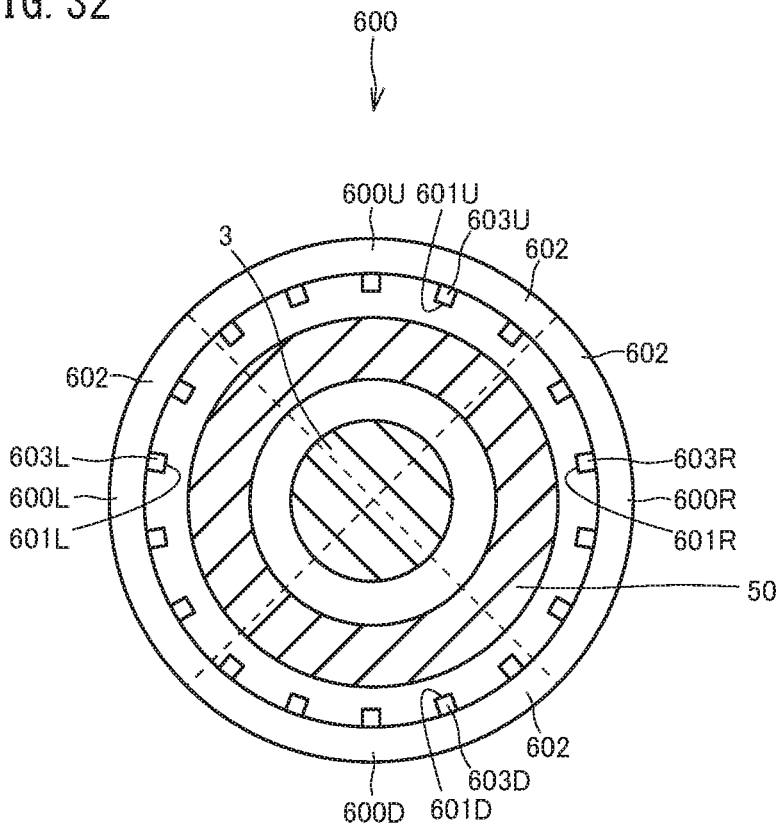
FIG. 32 is a front view of a frontward damming mechanism of a different form from the frontward damming mechanism illustrated in FIG. 27.

Note that, the configuration of the frontward damming mechanism 600 is not limited to the configuration illustrated in FIG. 26 to FIG. 31. For example, in FIG. 27 the frontward damming upper member 600U, the frontward damming lower member 600D, the frontward damming left member 600L and the frontward damming right member 600R are separate members which are independent from each other. However, as illustrated in FIG. 32, the frontward damming upper member 600U, the frontward damming lower member 600D, the frontward damming left member 600L and the frontward damming right member 600R may be integrally connected.

Figure 33:
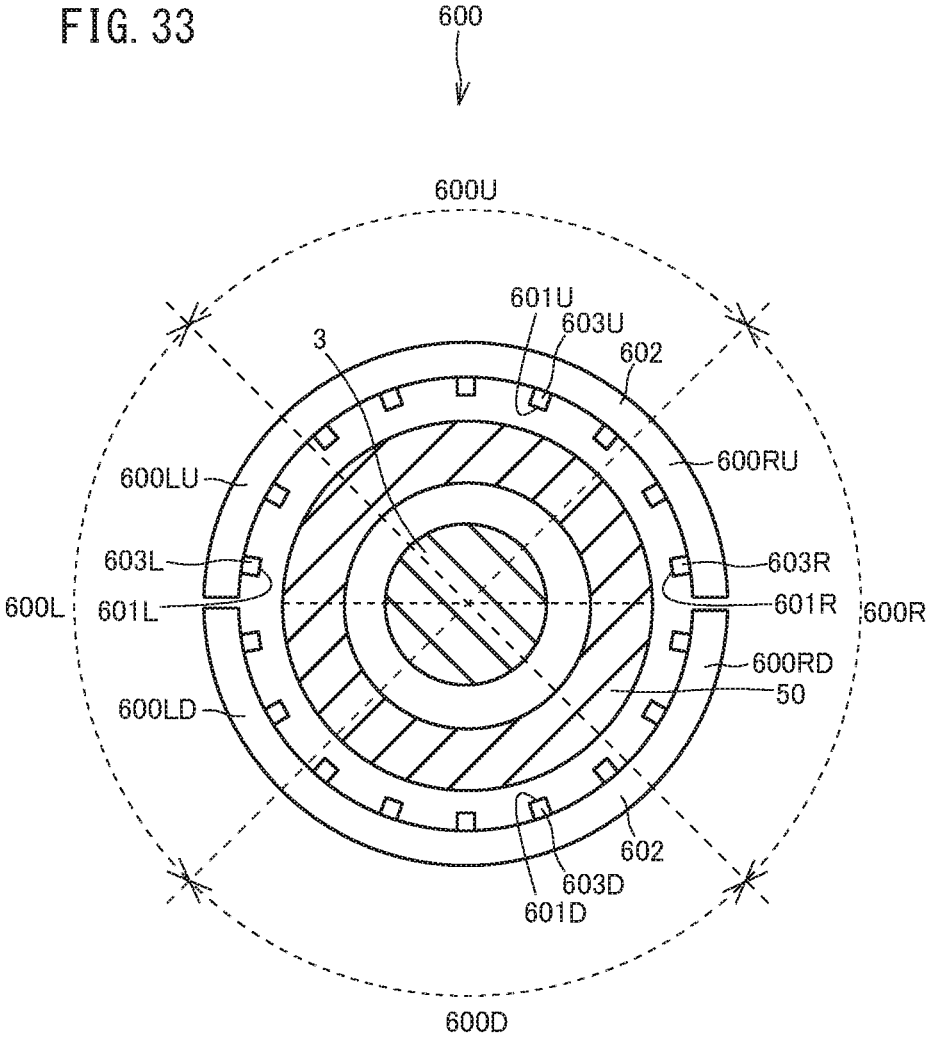
FIG. 33 is a front view of a frontward damming mechanism of a different form from the frontward damming mechanisms illustrated in FIG. 27 and FIG. 32.

Further, any of the frontward damming upper member 600U, the frontward damming lower member 600D, the frontward damming left member 600L and the frontward damming right member 600R may be constituted by a plurality of members, and parts of adjacent frontward damming members may be connected. In FIG. 33, the frontward damming left member 600L is constituted by two members (600LU, 600LD). Further, an upper member 600LU of the frontward damming left member 600L is connected to the frontward damming upper member 600U, and a lower member 600LD of the frontward damming left member 600L is connected to the frontward damming lower member 600D. Furthermore, the frontward damming right member 600R is constituted by two members (600RU, 600RD). An upper member 600RU of the frontward damming right member 600R is connected to the frontward damming upper member 600U, and a lower member 600RD of the frontward damming right member 600R is connected to the frontward damming lower member 600D.

In other words, each of the frontward damming members (the frontward damming upper member 600U, the frontward damming lower member 600D, the frontward damming left member 600L and the frontward damming right member 600R) may include a plurality of members, and a part or all of each of the frontward damming members may be formed integrally with another frontward damming member. As long as the frontward damming upper member 600U ejects the frontward damming fluid FF toward the upper part of the outer surface of the hollow shell 50 that is positioned in the vicinity of the entrance side of the cooling zone 32, the frontward damming lower member 600D ejects the frontward damming fluid FF toward the lower part of the outer surface of the hollow shell 50 that is positioned in the vicinity of the entrance side of the cooling zone 32, the frontward damming left member 600L ejects the frontward damming fluid FF toward the left part of the outer surface of the hollow shell 50 that is positioned in the vicinity of the entrance side of the cooling zone 32, and the frontward damming right member 600R ejects the frontward damming fluid FF toward the right part of the outer surface of the hollow shell 50 that is positioned in the vicinity of the entrance side of the cooling zone 32 and thereby the aforementioned members suppress the cooling fluid CF from flowing to the outer surface of the hollow shell 50 before the aforementioned parts of the outer surface of the hollow shell 50 enter the cooling zone 32, the configuration of each frontward damming member (the frontward damming upper member 600U, the frontward damming lower member 600D, the frontward damming left member 600L and the frontward damming right member 600R) is not particularly limited.

Figure 34:
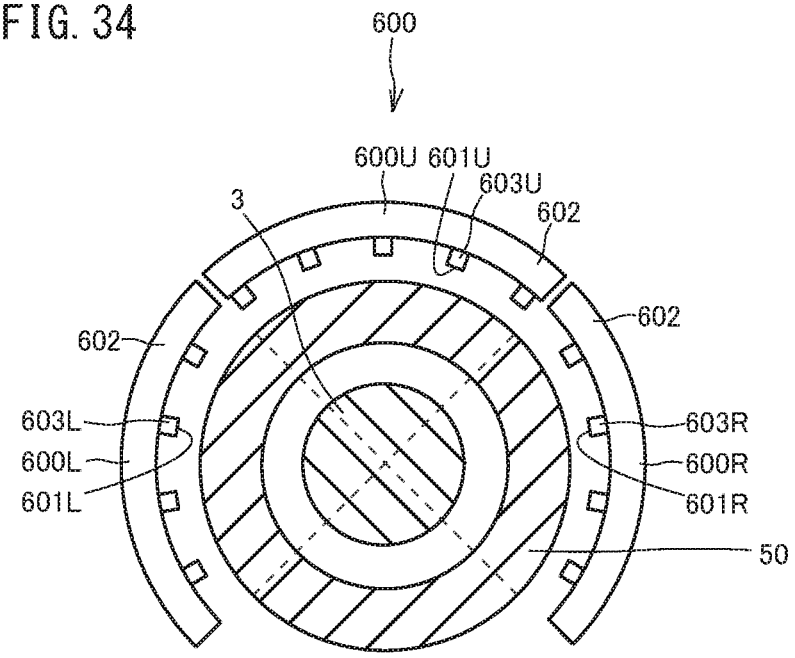
FIG. 34 is a front view of a frontward damming mechanism of a different form from the frontward damming mechanisms illustrated in FIG. 27, FIG. 32 and FIG. 33.
Figure 35:
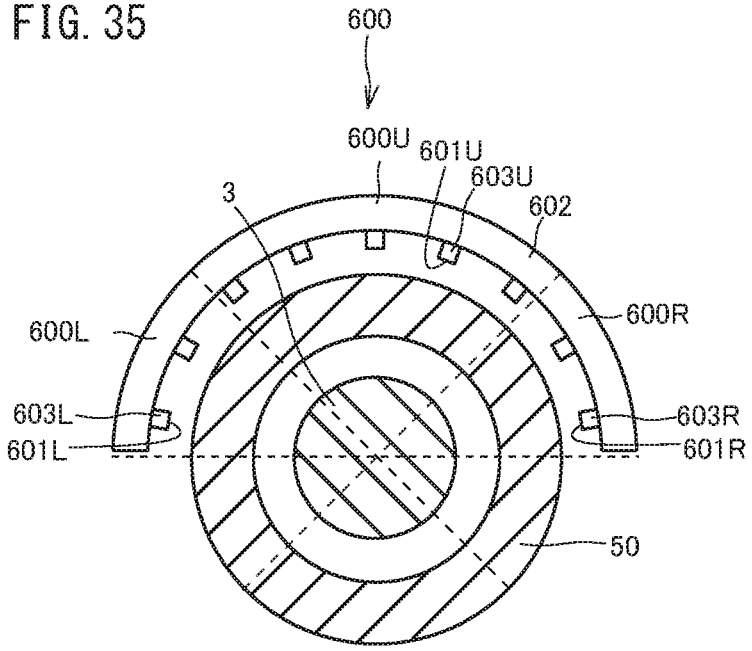
FIG. 35 is a front view of a frontward damming mechanism of a different form from the frontward damming mechanisms illustrated in FIG. 27 and FIG. 32 to FIG. 34.

Further, as illustrated in FIG. 34, the frontward damming mechanism 600 may include the frontward damming upper member 600U, the frontward damming left member 600L and the frontward damming right member 600R, and need not include the frontward damming lower member 600D. After the cooling fluid CF ejected toward the lower part of the outer surface of the hollow shell 50 inside the cooling zone 32 from the outer surface cooling mechanism 400 contacts the lower part of the outer surface of the hollow shell 50, the cooling fluid CF easily drops down naturally under the force of gravity to below the hollow shell 50. Therefore, it is difficult for the cooling fluid CF ejected toward the lower part of the outer surface of the hollow shell 50 within the cooling zone 32 from the outer surface cooling mechanism 400 to flow to the lower part of the outer surface of the hollow shell that is frontward of the cooling zone 32. Accordingly, the frontward damming mechanism 600 need not include the frontward damming lower member 600D. Further, as illustrated in FIG. 35, the frontward damming mechanism 600 may include the frontward damming upper member 600U, the frontward damming left member 600L and the frontward damming right member 600R, and need not include the frontward damming lower member 600D, and the frontward damming left member 600L may be disposed further upward than the central axis of the mandrel bar 3, and the frontward damming right member 600R may be disposed further upward than the central axis of the mandrel bar 3. The cooling fluid CF that contacts the outer surface portion of the outer surface of the hollow shell 50 which is located further downward than the central axis of the mandrel bar 3 easily drops down naturally under the force of gravity to below the hollow shell 50. Therefore, it suffices that the frontward damming left member 600L is disposed at least further upward than the central axis of the mandrel bar 3, and it suffices that the frontward damming right member 600R is disposed at least further upward than the central axis of the mandrel bar 3.

Figure 36:
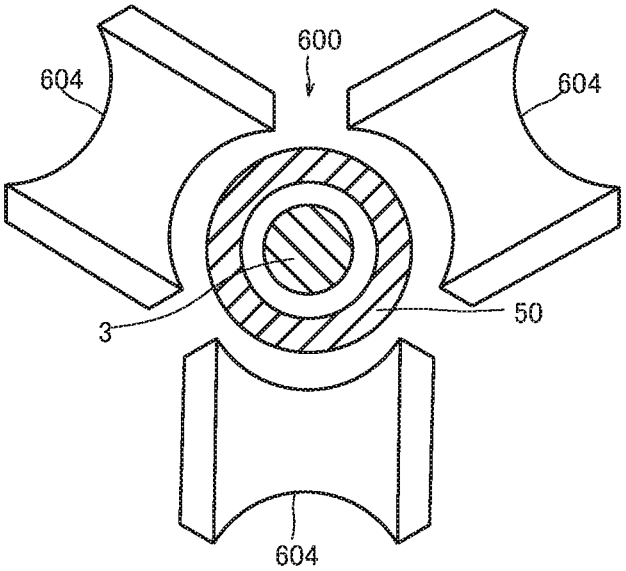
FIG. 36 is a front view of a frontward damming mechanism of a different form from the frontward damming mechanisms illustrated in FIG. 27 and FIG. 32 to FIG. 35.
Figure 37:
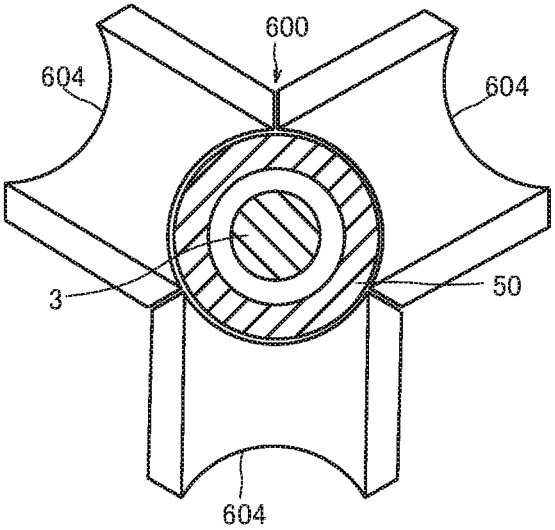
FIG. 37 is a front view of the frontward damming mechanism illustrated in FIG. 36 that illustrates a state in which a plurality of damming members shown in FIG. 36 have been brought close to the outer surface of a hollow shell during piercing-rolling or elongating rolling.

In addition, the frontward damming mechanism 600 may have a configuration that is different from the configurations illustrated in FIG. 26 to FIG. 35. For example, as illustrated in FIG. 36 and FIG. 37, the frontward damming mechanism 600 may be a mechanism that uses a plurality of damming members 604. In this case, as illustrated in FIG. 36, when seen in the advancing direction of the hollow shell 50, the frontward damming mechanism 600 includes a plurality of damming members 604 which are disposed around the mandrel bar 3. As illustrated in FIG. 36, the plurality of damming members 604 are, for example, rolls. In a case where the damming members 604 are rolls, as illustrated in FIG. 36 and FIG. 37, preferably a roll surface of each damming member 604 is curved so that the roll surface of each damming member 604 contacts the outer surface of the hollow shell 50. The damming members 604 are movable in the radial direction of the mandrel bar 3 by means of an unshown moving mechanism. The moving mechanism is, for example, a cylinder. The cylinder may be a hydraulic cylinder, may be a pneumatic cylinder, or may be an electric motor-driven cylinder.

During piercing-rolling or elongating rolling, when the hollow shell 50 passes the frontward damming mechanism 600, the plurality of damming members 604 move in the radial direction toward the outer surface of the hollow shell 50. The inner surface of each of the plurality of damming members 604 is then disposed in the vicinity of the outer surface of the hollow shell 50 (FIG. 37). Thus, when the outer surface cooling mechanism 400 is ejecting the cooling fluid CF toward the upper part of the outer surface, the lower part of the outer surface, the left part of the outer surface and the right part of the outer surface of the hollow shell 50 that is inside the cooling zone 32, the plurality of damming members 604 form a dam (protective wall). Therefore, the frontward damming mechanism 600 dams cooling fluid from flowing to the upper part of the outer surface, the lower part of the outer surface, the left part of the outer surface and the right part of the outer surface of the hollow shell 50 before the aforementioned parts of the outer surface of the hollow shell 50 enter the cooling zone 32.

Thus, the frontward damming mechanism 600 may have a configuration that does not use the frontward damming fluid FF. The configuration of the frontward damming mechanism 600 is not particularly limited as long as the frontward damming mechanism 600 is equipped with a mechanism that, when the outer surface cooling mechanism 400 is cooling the hollow shell 50, dams cooling fluid from flowing to the upper part of the outer surface, the lower part of the outer surface, the left part of the outer surface and the right part of the outer surface of the hollow shell 50 before the aforementioned parts of the outer surface of the hollow shell 50 enter the cooling zone 32.

Sixth Embodiment

Figure 38:
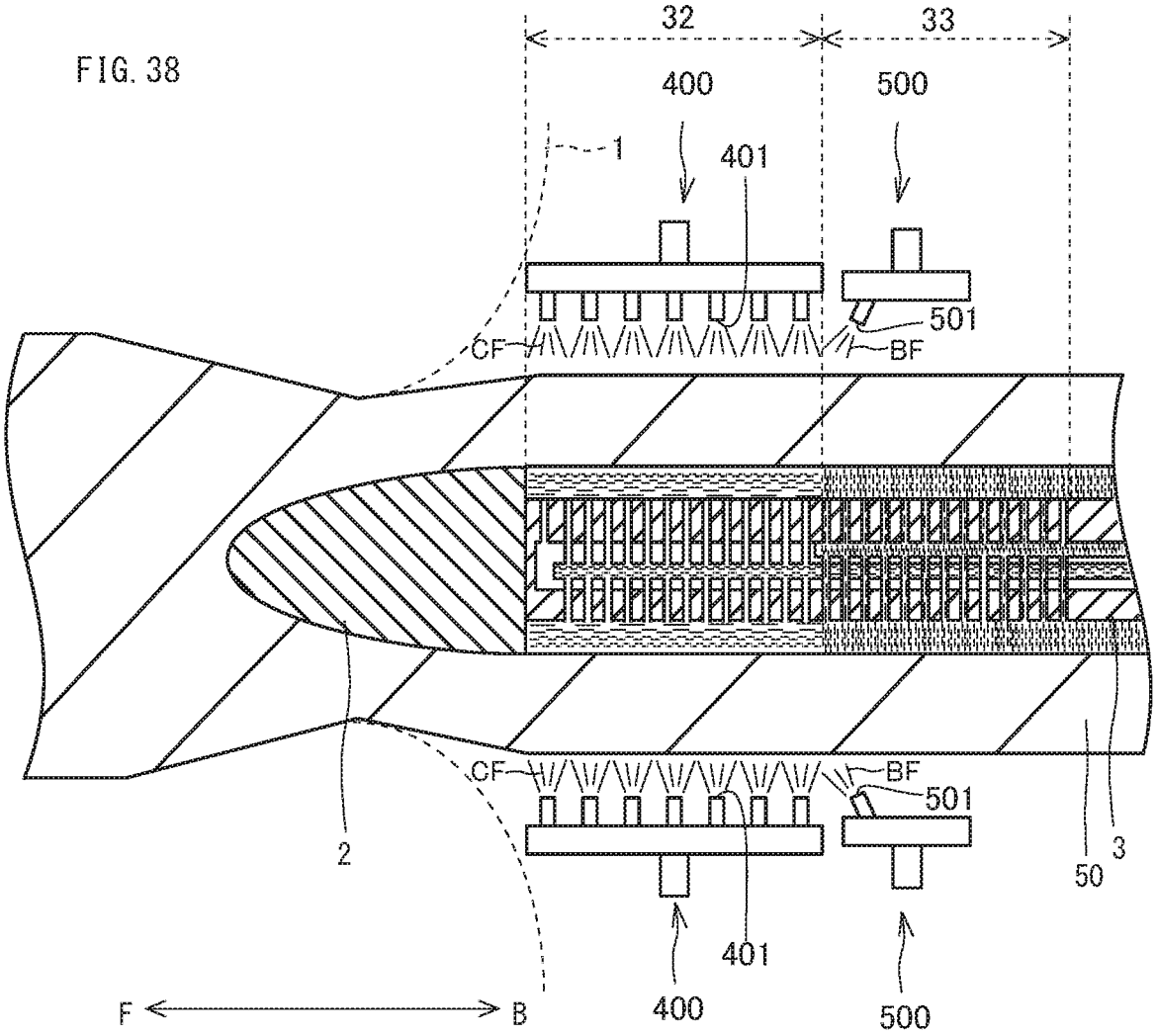
FIG. 38 is an enlarged view of the vicinity of the delivery side of skewed rolls of a piercing machine according to a sixth embodiment.

FIG. 38 is a view illustrating a configuration on the delivery side of the skewed rolls 1 of a piercing machine 10 according to a sixth embodiment. Referring to FIG. 38, in comparison to the piercing machine 10 according to the first embodiment, the piercing machine 10 according to the sixth embodiment newly includes a rearward damming mechanism 500. The remaining configuration of the piercing machine 10 according to the sixth embodiment is the same as the configuration of the piercing machine 10 according to the fourth embodiment.

[Rearward Damming Mechanism 500]

The rearward damming mechanism 500 is disposed around the mandrel bar 3 at a position that is rearward of the outer surface cooling mechanism 400. The rearward damming mechanism 500 is equipped with a mechanism that, when the outer surface cooling mechanism 400 is cooling the hollow shell in the cooling zone 32 by ejecting the cooling fluid CF toward the upper part of the outer surface, the lower part of the outer surface, the left part of the outer surface and the right part of the outer surface of the hollow shell 50 in the cooling zone 32, dams the cooling fluid from flowing to the upper part of the outer surface, the left part of the outer surface and the right part of the outer surface of the hollow shell 50 after the aforementioned parts of the outer surface of the hollow shell 50 leave from the cooling zone 32.

Figure 39:
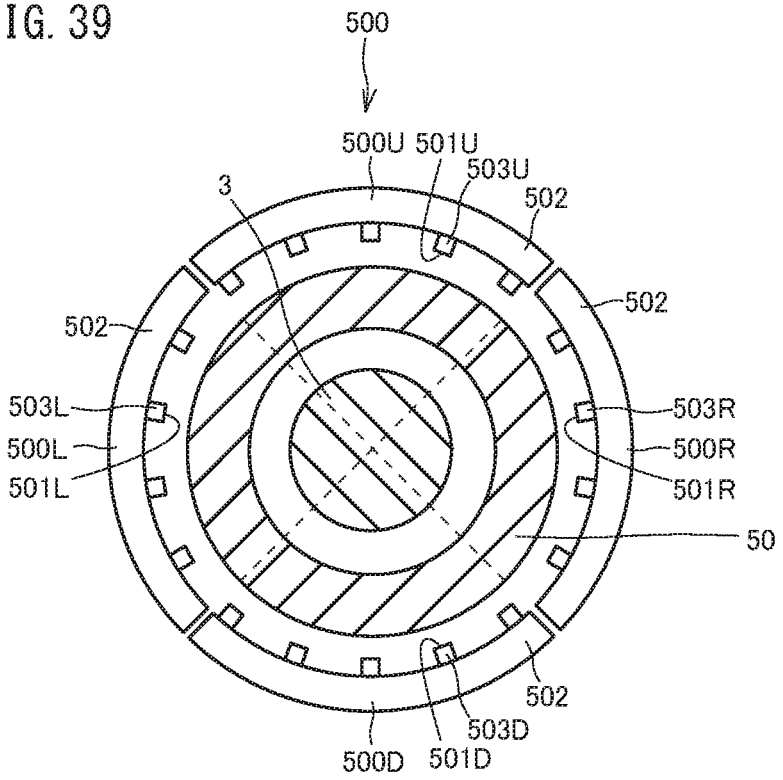
FIG. 39 is a front view of a rearward damming mechanism illustrated in FIG. 38, as seen from the advancing direction of a hollow shell.

FIG. 39 is a view illustrating the rearward damming mechanism 500 as seen in the advancing direction of the hollow shell 50 (view of the rearward damming mechanism 500 when seen from the entrance side toward the delivery side of the skewed rolls 1). Referring to 38 and FIG. 39, when seen in the advancing direction of the hollow shell 50, the rearward damming mechanism 500 is disposed around the mandrel bar 3, at a position that is rearward of the outer surface cooling mechanism 400. Further, during piercing-rolling or elongating rolling, as illustrated in FIG. 39, the rearward damming mechanism 500 is disposed around the hollow shell 50 subjected to piercing-rolling or elongating rolling.

Referring to FIG. 39, when seen in the advancing direction of the hollow shell 50, the rearward damming mechanism 500 includes a rearward damming upper member 500U, a rearward damming lower member 500D, a rearward damming left member 500L and a rearward damming right member 500R.

[Configuration of Rearward Damming Upper Member 500U]

The rearward damming upper member 500U is disposed above the mandrel bar 3. The rearward damming upper member 500U includes a main body 502 and a plurality of rearward damming fluid upper-part ejection holes 501U. The main body 502 is a tube-shaped or plate-shaped casing that is curved in the circumferential direction of the mandrel bar 3, and includes therein one or more fluid paths which allow a rearward damming fluid BF (see FIG. 38) to pass therethrough. In the present example, the plurality of rearward damming fluid upper-part ejection holes 501U are formed in a front end of a plurality of rearward damming fluid upper-part ejection nozzles 503U. However, the rearward damming fluid upper-part ejection holes 501U may be formed directly in the main body 502. In the present example, the plurality of rearward damming fluid upper-part ejection nozzles 503U that are arrayed around the mandrel bar 3 are connected to the main body 502.

When the hollow shell 50 subjected to piercing-rolling or elongating rolling passes through the inside of the rearward damming mechanism 500, the plurality of rearward damming fluid upper-part ejection holes 501U of the rearward damming upper member 500U face the upper part of the outer surface of the hollow shell 50 that is positioned in the vicinity of the delivery side of the cooling zone 32. When seen in the advancing direction of the hollow shell 50, the plurality of rearward damming fluid upper-part ejection holes 501U are arrayed around the mandrel bar 3, in the circumferential direction of the mandrel bar 3. Preferably, the plurality of rearward damming fluid upper-part ejection holes 501U are arrayed at regular intervals around the mandrel bar 3. The plurality of rearward damming fluid upper-part ejection holes 501U may also be arrayed side-by-side in the axial direction of the mandrel bar 3.

During piercing-rolling or elongating rolling, when the outer surface cooling mechanism 400 is cooling the hollow shell 50 in the cooling zone 32, the rearward damming upper member 500U ejects the rearward damming fluid BF toward the upper part of the outer surface of the hollow shell 50 that is positioned in the vicinity of the delivery side of the cooling zone 32 from the plurality of rearward damming fluid upper-part ejection holes 501U to thereby dam the cooling fluid CF from flowing to the upper part of the outer surface of the hollow shell 50 after the upper part of the outer surface of the hollow shell 50 leaves from the cooling zone 32.

[Configuration of Rearward Damming Lower Member 500D]

The rearward damming lower member 500D is disposed below the mandrel bar 3. The rearward damming lower member 500D includes a main body 502 and a plurality of rearward damming fluid lower-part ejection holes 501D. The main body 502 is a tube-shaped or plate-shaped casing that is curved in the circumferential direction of the mandrel bar 3, and includes therein one or more fluid paths which allow the rearward damming fluid BF to pass therethrough. In the present example, the plurality of rearward damming fluid lower-part ejection holes 501D are formed in a front end of a plurality of rearward damming fluid lower-part ejection nozzles 503D. However, the rearward damming fluid lower-part ejection holes 501D may be formed directly in the main body 502. In the present example, the plurality of rearward damming fluid lower-part ejection nozzles 503D that are arrayed around the mandrel bar 3 are connected to the main body 502.

When the hollow shell 50 subjected to piercing-rolling or elongating rolling passes through the inside of the rearward damming mechanism 500, the plurality of rearward damming fluid lower-part ejection holes 501D of the rearward damming lower member 500D face the lower part of the outer surface of the hollow shell 50 that is positioned in the vicinity of the delivery side of the cooling zone 32. When seen in the advancing direction of the hollow shell 50, the plurality of rearward damming fluid lower-part ejection holes 501D are arrayed around the mandrel bar 3, in the circumferential direction of the mandrel bar 3. Preferably, the plurality of rearward damming fluid lower-part ejection holes 501D are arrayed at regular intervals around the mandrel bar 3. The plurality of rearward damming fluid lower-part ejection holes 501D may also be arrayed side-by-side in the axial direction of the mandrel bar 3.

During piercing-rolling or elongating rolling, when the outer surface cooling mechanism 400 is cooling the hollow shell 50 in the cooling zone 32, the rearward damming lower member 500D ejects the rearward damming fluid BF toward the lower part of the outer surface of the hollow shell 50 that is positioned in the vicinity of the delivery side of the cooling zone 32 from the plurality of rearward damming fluid lower-part ejection holes 501D to thereby dam the cooling fluid CF from flowing to the lower part of the outer surface of the hollow shell 50 after the lower part of the outer surface of the hollow shell 50 leaves from the cooling zone 32.

[Configuration of Rearward Damming Left Member 500L]

The rearward damming left member 500L is disposed leftward of the mandrel bar 3 when seen in the advancing direction of the hollow shell 50. The rearward damming left member 500L includes a main body 502 and a plurality of rearward damming fluid left-part ejection holes 501L. The main body 502 is a tube-shaped or plate-shaped casing that is curved in the circumferential direction of the mandrel bar 3, and includes therein one or more fluid paths which allow the rearward damming fluid BF to pass therethrough. In the present example, the plurality of rearward damming fluid left-part ejection holes SOIL are formed in a front end of a plurality of rearward damming fluid left-part ejection nozzles 503L. However, the rearward damming fluid left-part ejection holes SOIL may be formed directly in the main body 502. In the present example, the plurality of rearward damming fluid left-part ejection nozzles 503L that are arrayed around the mandrel bar 3 are connected to the main body 502.

When the hollow shell 50 subjected to piercing-rolling or elongating rolling passes through the inside of the rearward damming mechanism 500, the plurality of rearward damming fluid left-part ejection holes SOIL of the rearward damming left member 500L face the left part of the outer surface of the hollow shell 50 that is positioned in the vicinity of the delivery side of the cooling zone 32. When seen in the advancing direction of the hollow shell 50, the plurality of rearward damming fluid left-part ejection holes SOIL are arrayed around the mandrel bar 3, in the circumferential direction of the mandrel bar 3. Preferably, the plurality of rearward damming fluid left-part ejection holes SOIL are arrayed at regular intervals around the mandrel bar 3. The plurality of rearward damming fluid left-part ejection holes SOIL may also be arrayed side-by-side in the axial direction of the mandrel bar 3.

During piercing-rolling or elongating rolling, when the outer surface cooling mechanism 400 is cooling the hollow shell 50 in the cooling zone 32, the rearward damming left member 500L ejects the rearward damming fluid BF toward the left part of the outer surface of the hollow shell 50 that is positioned in the vicinity of the delivery side of the cooling zone 32 from the plurality of rearward damming fluid left-part ejection holes SOIL to thereby dam the cooling fluid CF from flowing to the left part of the outer surface of the hollow shell 50 after the left part of the outer surface of the hollow shell 50 leaves from the cooling zone 32.

[Configuration of Rearward Damming Right Member 500R]

The rearward damming right member 500R is disposed rightward of the mandrel bar 3 when seen in the advancing direction of the hollow shell 50. The rearward damming right member 500R includes a main body 502 and a plurality of rearward damming fluid right-part ejection holes 501R. The main body 502 is a tube-shaped or plate-shaped casing that is curved in the circumferential direction of the mandrel bar 3, and includes therein one or more fluid paths which allow the rearward damming fluid BF to pass therethrough. In the present example, the plurality of rearward damming fluid right-part ejection holes 501R are formed in a front end of a plurality of rearward damming fluid right-part ejection nozzles 503R. However, the rearward damming fluid right-part ejection holes 501R may be formed directly in the main body 502. In the present example, the plurality of rearward damming fluid right-part ejection nozzles 503R that are arrayed around the mandrel bar 3 are connected to the main body 502.

When the hollow shell 50 subjected to piercing-rolling or elongating rolling passes through the inside of the rearward damming mechanism 500, the plurality of rearward damming fluid right-part ejection holes 501R of the rearward damming right member 500R face the right part of the outer surface of the hollow shell 50 that is positioned in the vicinity of the delivery side of the cooling zone 32. When seen in the advancing direction of the hollow shell 50, the plurality of rearward damming fluid right-part ejection holes 501R are arrayed around the mandrel bar 3, in the circumferential direction of the mandrel bar 3. Preferably, the plurality of rearward damming fluid right-part ejection holes 501R are arrayed at regular intervals around the mandrel bar 3. The plurality of rearward damming fluid right-part ejection holes 501R may also be arrayed side-by-side in the axial direction of the mandrel bar 3.

During piercing-rolling or elongating rolling, when the outer surface cooling mechanism 400 is cooling the hollow shell 50 in the cooling zone 32, the rearward damming right member 500R ejects the rearward damming fluid BF toward the right part of the outer surface of the hollow shell 50 that is positioned in the vicinity of the delivery side of the cooling zone 32 from the plurality of rearward damming fluid right-part ejection holes 501R to thereby dam the cooling fluid CF from flowing to the right part of the outer surface of the hollow shell 50 after the right part of the outer surface of the hollow shell 50 leaves from the cooling zone 32.

[Operations of Rearward Damming Mechanism 500]

During piercing-rolling or elongating rolling, of the entire outer surface of the hollow shell 50 subjected to piercing-rolling or elongating rolling, the outer surface cooling mechanism 400 ejects the cooling fluid CF toward the outer surface portion of the hollow shell 50 that is inside the cooling zone 32 to thereby cool the hollow shell 50. At this time, after the cooling fluid CF ejected toward the outer surface portion of the hollow shell 50 inside the cooling zone 32 contacts the outer surface portion of the hollow shell 50, a situation can arise in which the cooling fluid CF flows to rearward of the outer surface portion and contacts the outer surface portion of the hollow shell 50 that is rearward of the cooling zone 32. If the frequency at which contact of the cooling fluid CF with an outer surface portion of the hollow shell 50 in a zone other than the cooling zone 32 occurs is high, variations can arise in the temperature distribution in the axial direction of the hollow shell 50.

Therefore, in the present embodiment, during piercing-rolling or elongating rolling, the rearward damming mechanism 500 suppresses the cooling fluid CF that flows over the outer surface after contacting the outer surface portion of the hollow shell 50 inside the cooling zone 32 from contacting the outer surface portion of the hollow shell 50 that is rearward of the cooling zone 32.

The rearward damming mechanism 500 is equipped with a mechanism that, when the outer surface cooling mechanism 400 is cooling the hollow shell inside the cooling zone 32 by ejecting the cooling fluid CF toward the upper part of the outer surface, the lower part of the outer surface, the left part of the outer surface and the right part of the outer surface of the hollow shell 50 inside the cooling zone 32, dams the cooling fluid CF from flowing to the upper part, the lower part, the left part and the right part of the outer surface of the hollow shell 50 after the aforementioned parts of the outer surface of the hollow shell 50 leave from the cooling zone 32. Specifically, when seen in the advancing direction of the hollow shell 50, the rearward damming upper member 500U ejects the rearward damming fluid BF toward the upper part of the outer surface of the hollow shell 50 that is positioned in the vicinity of the delivery side of the cooling zone 32 to thereby form a dam (protective wall) composed of the rearward damming fluid BF at the upper part of the outer surface of the hollow shell 50 after the upper part of the outer surface of the hollow shell 50 leaves from the cooling zone 32. Similarly, the rearward damming lower member 500D ejects the rearward damming fluid BF toward the lower part of the outer surface of the hollow shell 50 that is positioned in the vicinity of the delivery side of the cooling zone 32 to thereby form a dam (protective wall) composed of the rearward damming fluid BF at the lower part of the outer surface of the hollow shell 50 after the lower part of the outer surface of the hollow shell 50 leaves from the cooling zone 32. Similarly, the rearward damming left member 500L ejects the rearward damming fluid BF toward the left part of the outer surface of the hollow shell 50 that is positioned in the vicinity of the delivery side of the cooling zone 32 to thereby form a dam (protective wall) composed of the rearward damming fluid BF at the left part of the outer surface of the hollow shell 50 after the left part of the outer surface of the hollow shell 50 leaves from the cooling zone 32. Similarly, the rearward damming right member 500R ejects the rearward damming fluid BF toward the right part of the outer surface of the hollow shell 50 that is positioned in the vicinity of the delivery side of the cooling zone 32 to thereby form a dam (protective wall) composed of the rearward damming fluid BF at the right part of the outer surface of the hollow shell 50 after the right part of the outer surface of the hollow shell 50 leaves from the cooling zone 32. These dams that are composed of the rearward damming fluid BF dam the cooling fluid CF that contacts the outer surface portion of the hollow shell 50 within the cooling zone 32 and rebounds therefrom and attempts to flow to the zone rearward of the cooling zone 32. Therefore, contact of the cooling fluid CF with the outer surface portion of the hollow shell 50 that is rearward of the cooling zone 32 can be suppressed, and temperature variations in the axial direction of the hollow shell 50 can be further reduced.

Figure 40:
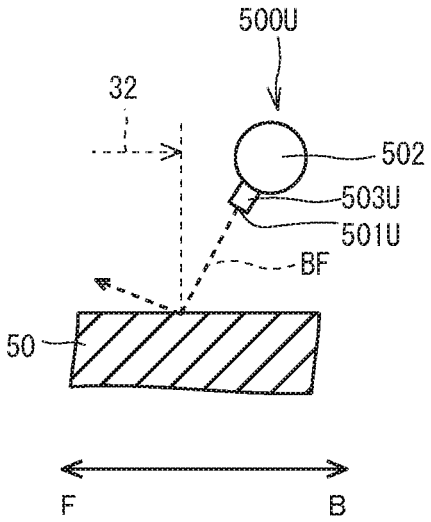
FIG. 40 is a sectional drawing of a rearward damming upper member illustrated in FIG. 39, as seen from a direction parallel to the advancing direction of the hollow shell.
Figure 41:
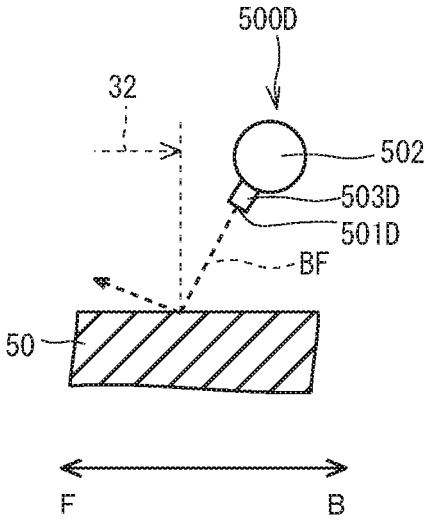
FIG. 41 is a sectional drawing of a rearward damming lower member illustrated in FIG. 39, as seen from a direction parallel to the advancing direction of the hollow shell.
Figure 42:
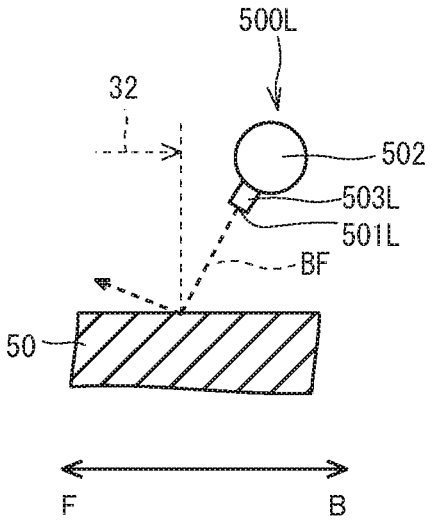
FIG. 42 is a sectional drawing of a rearward damming left member illustrated in FIG. 39, as seen from a direction parallel to the advancing direction of the hollow shell.
Figure 43:
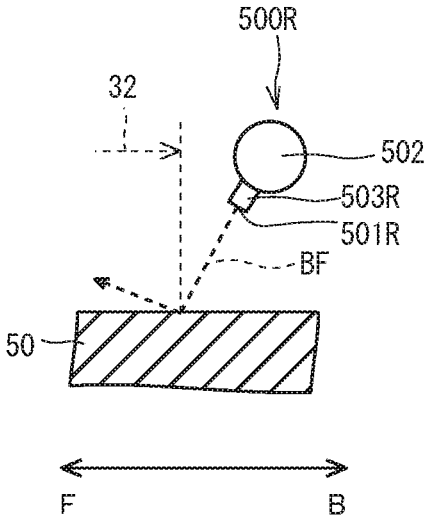
FIG. 43 is a sectional drawing of a rearward damming right member illustrated in FIG. 39, as seen from a direction parallel to the advancing direction of the hollow shell.

FIG. 40 is a sectional drawing of the rearward damming upper member 500U, when seen from a direction parallel to the advancing direction of the hollow shell 50. FIG. 41 is a sectional drawing of the rearward damming lower member 500D, when seen from the direction parallel to the advancing direction of the hollow shell 50. FIG. 42 is a sectional drawing of the rearward damming left member 500L, when seen from the direction parallel to the advancing direction of the hollow shell 50. FIG. 43 is a sectional drawing of the rearward damming right member 500R, when seen from the direction parallel to the advancing direction of the hollow shell 50.

Referring to FIG. 40, preferably the rearward damming upper member 500U ejects the rearward damming fluid BF diagonally frontward towards the upper part of the outer surface of the hollow shell 50 that is positioned in the vicinity of the delivery side of the cooling zone 32 from the rearward damming fluid upper-part ejection holes 501U. Referring to FIG. 41, preferably the rearward damming lower member 500D ejects the rearward damming fluid BF diagonally frontward towards the lower part of the outer surface of the hollow shell 50 that is positioned in the vicinity of the delivery side of the cooling zone 32 from the rearward damming fluid lower-part ejection holes 501D. Referring to FIG. 42, preferably the rearward damming left member 500L ejects the rearward damming fluid BF diagonally frontward towards the left part of the outer surface of the hollow shell 50 that is positioned in the vicinity of the delivery side of the cooling zone 32 from the rearward damming fluid left-part ejection holes 501L. Referring to FIG. 43, preferably the rearward damming right member 500R ejects the rearward damming fluid BF diagonally frontward towards the right part of the outer surface of the hollow shell 50 that is positioned in the vicinity of the delivery side of the cooling zone 32 from the rearward damming fluid right-part ejection holes 501R.

In FIG. 40 to FIG. 43, the rearward damming upper member 500U forms a dam (protective wall) composed of the rearward damming fluid BF that extends diagonally frontward toward the upper part of the outer surface of the hollow shell 50 from above the hollow shell 50. Similarly, the rearward damming lower member 500D forms a dam (protective wall) composed of the rearward damming fluid BF that extends diagonally frontward toward the lower part of the outer surface of the hollow shell 50 from below the hollow shell 50. Similarly, the rearward damming left member 500L forms a dam (protective wall) composed of the rearward damming fluid BF that extends diagonally frontward toward the left part of the outer surface of the hollow shell 50 from leftward of the hollow shell 50. Similarly, the rearward damming right member 500R forms a dam (protective wall) composed of the rearward damming fluid BF that extends diagonally frontward toward the right part of the outer surface of the hollow shell 50 from rightward of the hollow shell 50. These dams dam the cooling fluid CF that contacts the outer surface portion of the hollow shell 50 within the cooling zone 32 and rebounds therefrom and attempts to fly out to the zone that is rearward of the cooling zone 32. In addition, after the rearward damming fluid BF constituting the dams contacts the outer surface portion of the hollow shell 50 in the vicinity of the delivery side of the cooling zone 32, as illustrated in FIG. 40 to FIG. 43, it is easy for the rearward damming fluid BF to rebound into the inside of the cooling zone 32, and the rearward damming fluid BF easily flows inside the cooling zone 32. Therefore, contact of the rearward damming fluid BF constituting the dams with an outer surface portion of the hollow shell 50 that is further rearward than the cooling zone 32 can be suppressed.

Note that, the respective rearward damming members (rearward damming upper member 500U, rearward damming lower member 500D, rearward damming left member 500L and rearward damming right member 500R) need not eject the rearward damming fluid BF diagonally frontward toward the upper part, the lower part, the left part and the right part of the outer surface of the hollow shell 50 positioned in the vicinity of the delivery side of the cooling zone 32 from the respective rearward damming fluid ejection holes (rearward damming fluid upper-part ejection holes 501U, rearward damming fluid lower-part ejection holes 501D, rearward damming fluid left-part ejection holes SOIL, and rearward damming fluid right-part ejection holes 501R). For example, the rearward damming upper member 500U may eject the rearward damming fluid BF in the radial direction of the mandrel bar 3 from the rearward damming fluid upper-part ejection holes 501U. The rearward damming lower member 500D may eject the rearward damming fluid BF in the radial direction of the mandrel bar 3 from the rearward damming fluid lower-part ejection holes 501D. The rearward damming left member 500L may eject the rearward damming fluid BF in the radial direction of the mandrel bar 3 from the rearward damming fluid left-part ejection holes 501L. The rearward damming right member 500R may eject the rearward damming fluid BF in the radial direction of the mandrel bar 3 from the rearward damming fluid right-part ejection holes 501R.

The rearward damming fluid BF is a gas and/or a liquid. That is, as the rearward damming fluid BF, a gas may be used, a liquid may be used, or both a gas and a liquid may be used. Here, the gas is, for example, air or an inert gas. The inert gas is, for example, argon gas or nitrogen gas. In the case of utilizing a gas as the rearward damming fluid BF, only air may be utilized, or only an inert gas may be utilized, or both air and an inert gas may be utilized. Further, as the inert gas, only one kind of inert gas (for example, argon gas only, or nitrogen gas only) may be utilized, or a plurality of inert gases may be mixed and utilized. In the case of utilizing a liquid as the rearward damming fluid BF, the liquid is, for example, water or oil, and preferably is water.

The rearward damming fluid BF may be of the same kind as the kind of the cooling fluid CF and/or the frontward damming fluid FF, or may be of a different kind from the cooling fluid CF and/or the frontward damming fluid FF. The rearward damming mechanism 500 receives a supply of the rearward damming fluid BF from an unshown fluid supply source. A configuration of the fluid supply source is, for example, the same as the configuration of the fluid supply source 800. The rearward damming fluid BF supplied from the fluid supply source passes through the fluid path inside each main body 502 of the rearward damming mechanism 500, and is ejected from the respective rearward damming fluid ejection holes (rearward damming fluid upper-part ejection holes 501U, rearward damming fluid lower-part ejection holes 501D, rearward damming fluid left-part ejection holes 501L and rearward damming fluid right-part ejection holes 501R).

Figure 44:
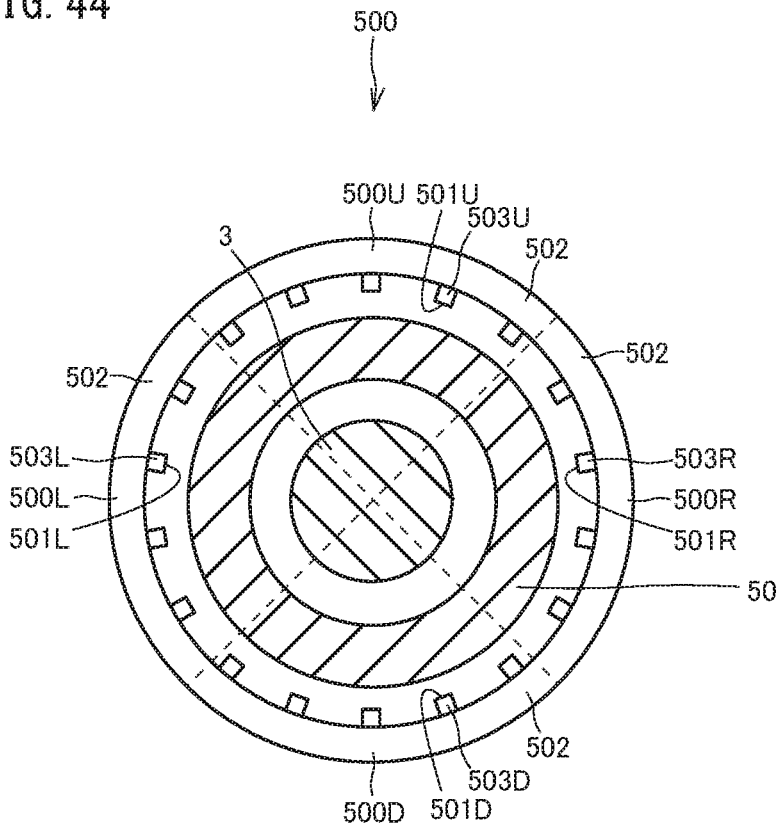
FIG. 44 is a front view of a rearward damming mechanism of a different form from the rearward damming mechanism illustrated in FIG. 39.

Note that, the configuration of the rearward damming mechanism 500 is not limited to the configuration illustrated in FIG. 38 to FIG. 43. For example, in FIG. 39 the rearward damming upper member 500U, the rearward damming lower member 500D, the rearward damming left member 500L and the rearward damming right member 500R are separate members which are independent from each other. However, as illustrated in FIG. 44, the rearward damming upper member 500U, the rearward damming lower member 500D, the rearward damming left member 500L and the rearward damming right member 500R may be integrally connected.

Figure 45:
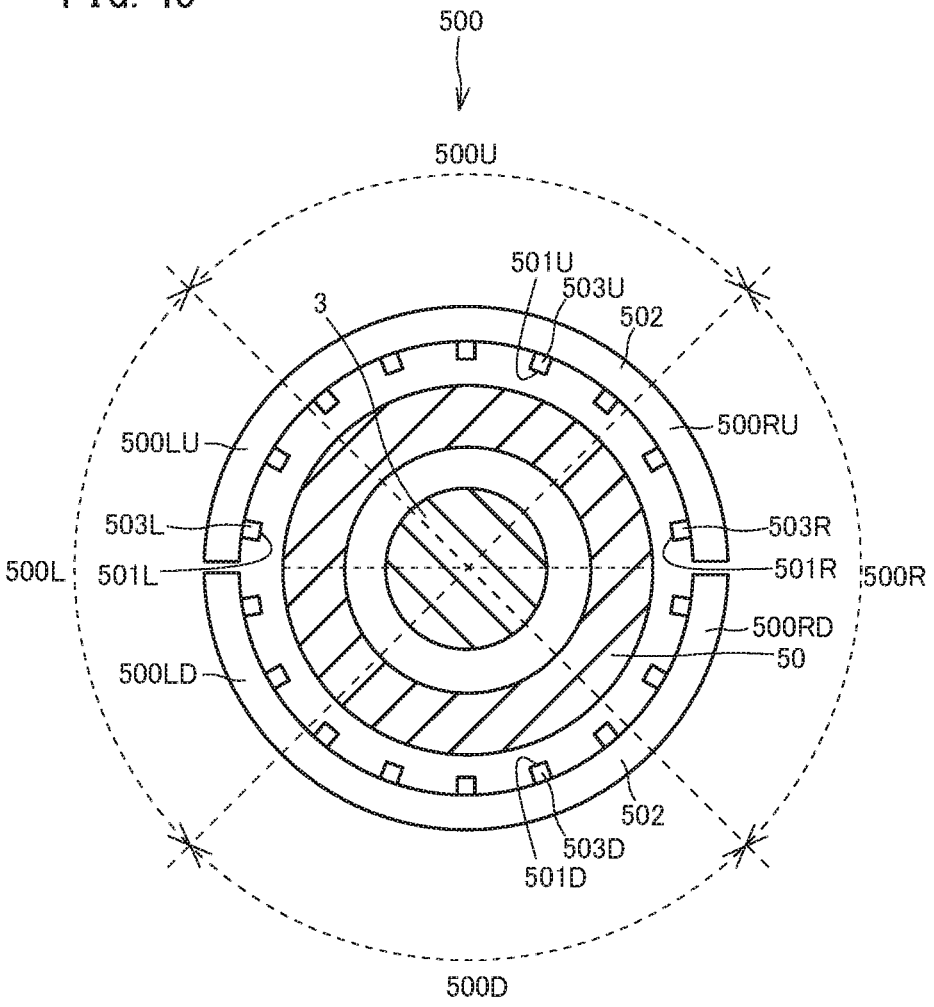
FIG. 45 is a front view of a rearward damming mechanism of a different form from the rearward damming mechanisms illustrated in FIG. 39 and FIG. 44.

Further, any of the rearward damming upper member 500U, the rearward damming lower member 500D, the rearward damming left member 500L and the rearward damming right member 500R may be constituted by a plurality of members, and parts of adjacent rearward damming members may be connected. In FIG. 45, the rearward damming left member 500L is constituted by two members (500LU, 500LD). Further, an upper member 500LU of the rearward damming left member 500L is connected to the rearward damming upper member 500U, and a lower member 500LD of the rearward damming left member 500L is connected to the rearward damming lower member 500D. Furthermore, the rearward damming right member 500R is constituted by two members (500RU, 500RD). An upper member 500RU of the rearward damming right member 500R is connected to the rearward damming upper member 500U, and a lower member 500RD of the rearward damming right member 500R is connected to the rearward damming lower member 500D.

In other words, each of the rearward damming members (the rearward damming upper member 500U, the rearward damming lower member 500D, the rearward damming left member 500L and the rearward damming right member 500R) may include a plurality of members, and a part or all of each of the rearward damming members may be formed integrally with another rearward damming member. As long as the rearward damming upper member 500U ejects the rearward damming fluid BF toward the upper part of the outer surface of the hollow shell 50 that is positioned in the vicinity of the delivery side of the cooling zone 32, the rearward damming lower member 500D ejects the rearward damming fluid BF toward the lower part of the outer surface of the hollow shell 50 that is positioned in the vicinity of the delivery side of the cooling zone 32, the rearward damming left member 500L ejects the rearward damming fluid BF toward the left part of the outer surface of the hollow shell 50 that is positioned in the vicinity of the delivery side of the cooling zone 32, and the rearward damming right member 500R ejects the rearward damming fluid BF toward the right part of the outer surface of the hollow shell 50 that is positioned in the vicinity of the delivery side of the cooling zone 32 and thereby the aforementioned members suppress the cooling fluid CF from flowing to the outer surface of the hollow shell 50 after the aforementioned parts of the outer surface of the hollow shell 50 leave from the cooling zone 32, the configuration of each rearward damming member (the rearward damming upper member 500U, the rearward damming lower member 500D, the rearward damming left member 500L and the rearward damming right member 500R) is not particularly limited.

Figure 46:
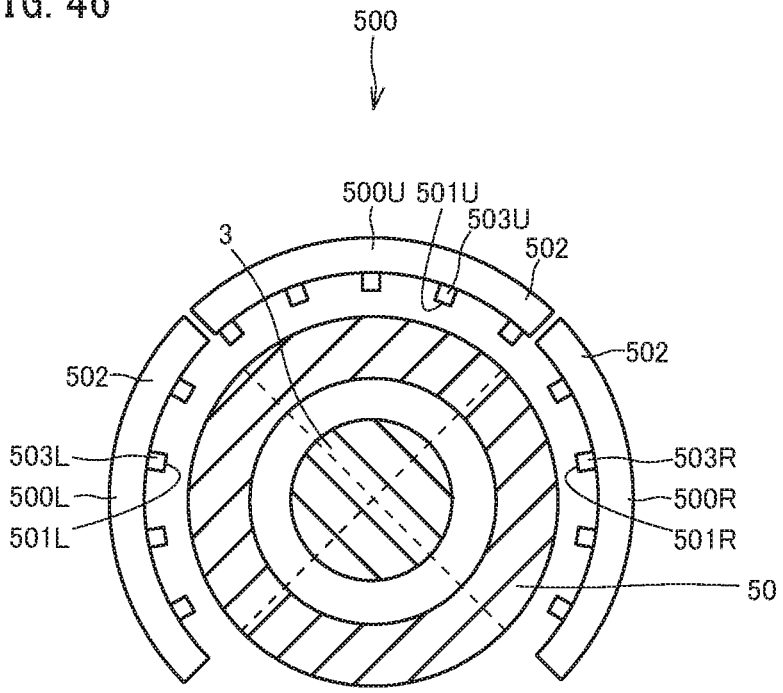
FIG. 46 is a front view of a rearward damming mechanism of a different form from the rearward damming mechanisms illustrated in FIG. 39, FIG. 44 and FIG. 45.
Figure 47:
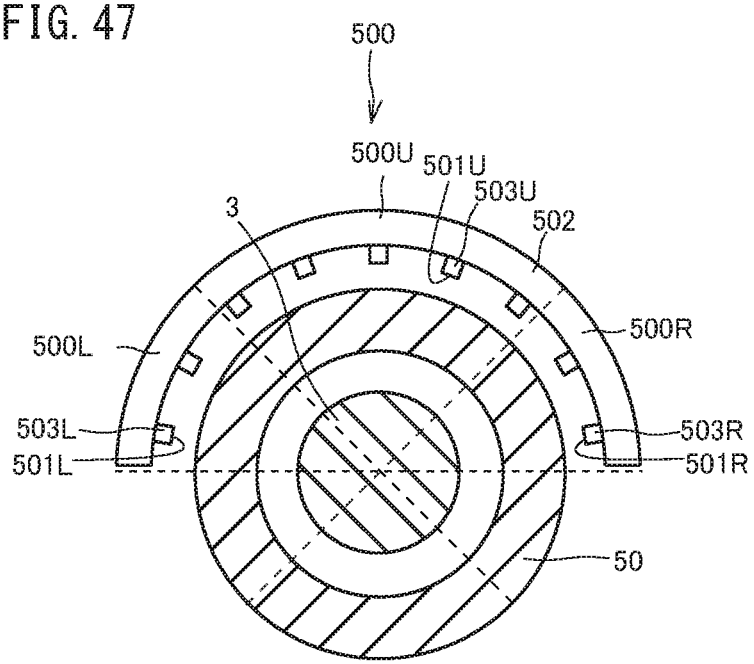
FIG. 47 is a front view of a rearward damming mechanism of a different form from the rearward damming mechanisms illustrated in FIG. 39 and FIG. 44 to FIG. 46.

Further, as illustrated in FIG. 46, the rearward damming mechanism 500 may include the rearward damming upper member 500U, the rearward damming left member 500L and the rearward damming right member 500R, and need not include the rearward damming lower member 500D. After the cooling fluid CF ejected toward the lower part of the outer surface of the hollow shell 50 inside the cooling zone 32 from the outer surface cooling mechanism 400 contacts the lower part of the outer surface of the hollow shell 50, the cooling fluid CF easily drops down naturally under the force of gravity to below the hollow shell 50. Therefore, it is difficult for the cooling fluid CF ejected toward the lower part of the outer surface of the hollow shell 50 within the cooling zone 32 from the outer surface cooling mechanism 400 to flow to the lower part of the outer surface of the hollow shell that is rearward of the cooling zone 32. Accordingly, the rearward damming mechanism 500 need not include the rearward damming lower member 500D. Further, as illustrated in FIG. 47, the rearward damming mechanism 500 may include the rearward damming upper member 500U, the rearward damming left member 500L and the rearward damming right member 500R, and need not include the rearward damming lower member 500D, and the rearward damming left member 500L may be disposed further upward than the central axis of the mandrel bar 3, and the rearward damming right member 500R may be disposed further upward than the central axis of the mandrel bar 3. The cooling fluid CF that contacts the outer surface portion of the outer surface of the hollow shell 50 which is located further downward than the central axis of the mandrel bar 3 easily drops down naturally under the force of gravity to below the hollow shell 50. Therefore, it suffices that the rearward damming left member 500L is disposed at least further upward than the central axis of the mandrel bar 3, and it suffices that the rearward damming right member 500R is disposed at least further upward than the central axis of the mandrel bar 3.

Figure 48:
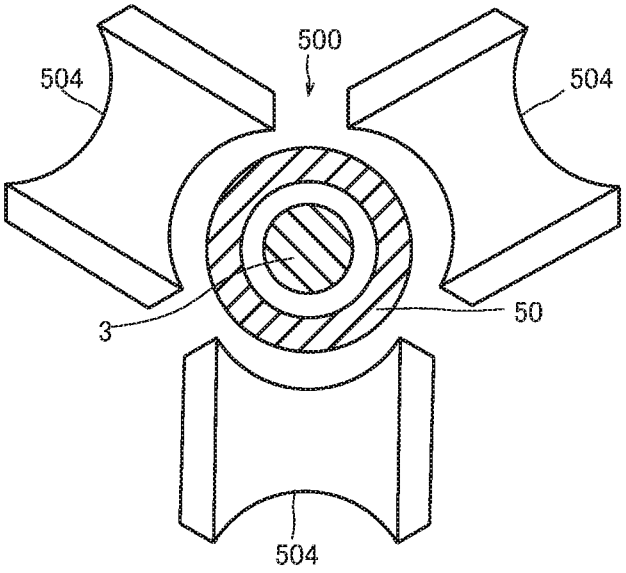
FIG. 48 is a front view of a rearward damming mechanism of a different form from the rearward damming mechanisms illustrated in FIG. 39 and FIG. 44 to FIG. 47.
Figure 49:
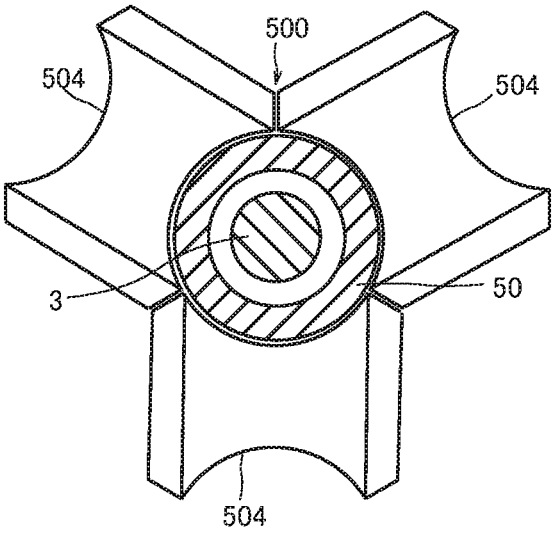
FIG. 49 is a front view of the rearward damming mechanism illustrated in FIG. 48, which illustrates a state in which a plurality of damming members illustrated in FIG. 48 have been brought close to the outer surface of a hollow shell during piercing-rolling or elongating rolling.

In addition, the rearward damming mechanism 500 may have a configuration that is different from the configurations illustrated in FIG. 38 to FIG. 47. For example, as illustrated in FIG. 48 and FIG. 49, the rearward damming mechanism 500 may be a mechanism that uses a plurality of damming members. In this case, as illustrated in FIG. 48, the rearward damming mechanism 500 includes a plurality of damming members 504 which are disposed around the mandrel bar 3. As illustrated in FIG. 48, the plurality of damming members 504 are, for example, rolls. In a case where the damming members 504 are rolls, as illustrated in FIG. 48 and FIG. 49, preferably a roll surface of each damming member 504 is curved so that the roll surface of each damming member 504 contacts the outer surface of the hollow shell 50. The damming members 504 are movable in the radial direction of the mandrel bar 3 by means of an unshown moving mechanism. The moving mechanism is, for example, a cylinder. The cylinder may be a hydraulic cylinder, may be a pneumatic cylinder, or may be an electric motor-driven cylinder.

During piercing-rolling or elongating rolling, when the hollow shell 50 passes the rearward damming mechanism 500, the plurality of damming members 504 move in the radial direction toward the outer surface of the hollow shell 50. As illustrated in FIG. 49, the inner surface of each of the plurality of damming members 504 is then disposed in the vicinity of the outer surface of the hollow shell 50. Thus, when the outer surface cooling mechanism 400 is ejecting the cooling fluid CF toward the upper part of the outer surface, the lower part of the outer surface, the left part of the outer surface and the right part of the outer surface of the hollow shell 50 that is inside the cooling zone 32, the plurality of damming members 504 form a dam (protective wall). Therefore, the rearward damming mechanism 500 dams cooling fluid from flowing to the upper part of the outer surface, the lower part of the outer surface, the left part of the outer surface and the right part of the outer surface of the hollow shell 50 after the aforementioned parts of the outer surface of the hollow shell 50 leave from the cooling zone 32.

Thus, the rearward damming mechanism 500 may have a configuration that does not use the rearward damming fluid BF. The configuration of the rearward damming mechanism 500 is not particularly limited as long as the rearward damming mechanism 500 is equipped with a mechanism that, when the outer surface cooling mechanism 400 is cooling the hollow shell 50, dams cooling fluid from flowing to the upper part of the outer surface, the lower part of the outer surface, the left part of the outer surface and the right part of the outer surface of the hollow shell 50 after the aforementioned parts of the outer surface of the hollow shell 50 leave from the cooling zone 32.

Seventh Embodiment

Figure 50:
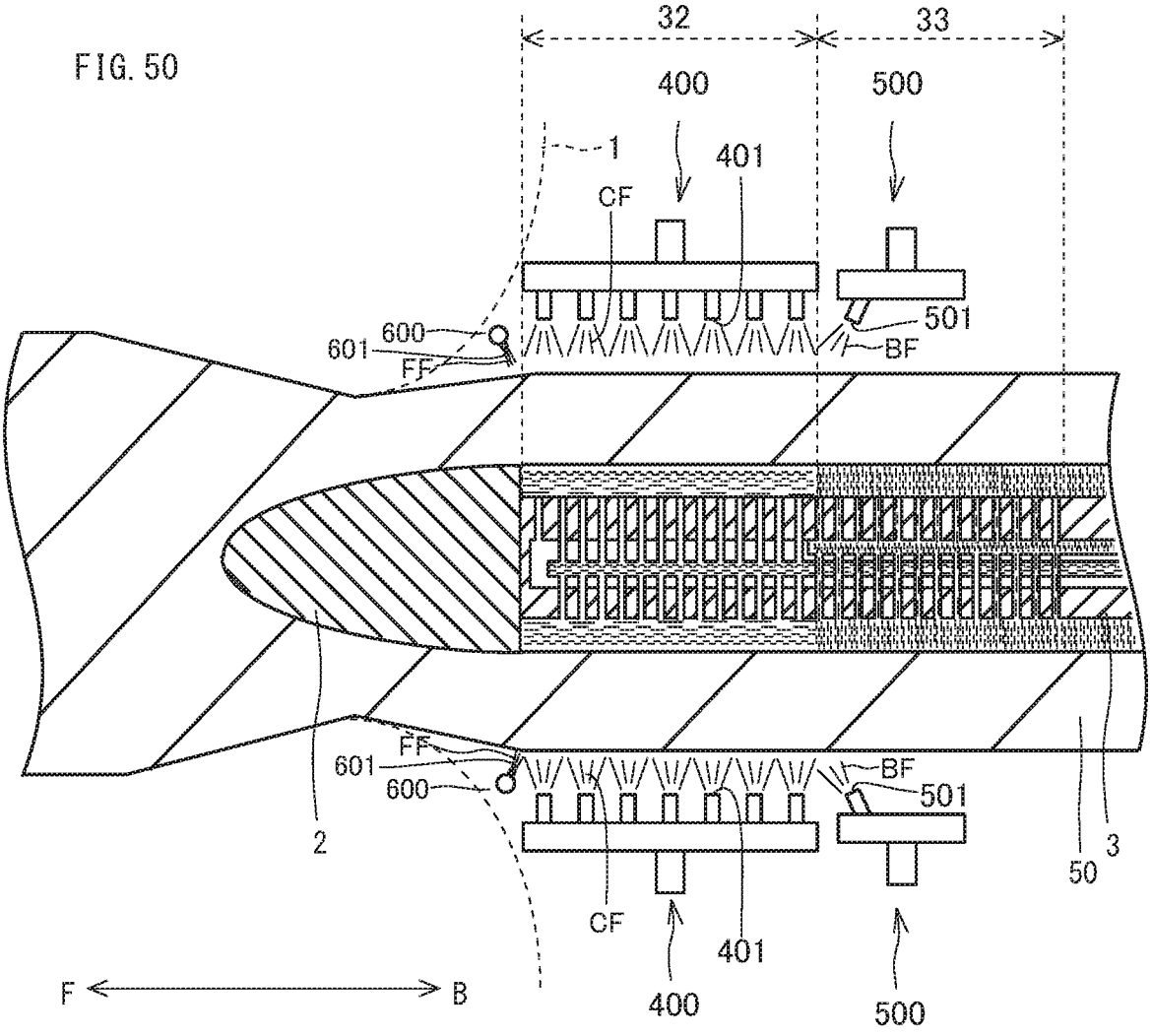
FIG. 50 is an enlarged view of the vicinity of the delivery side of skewed rolls of a piercing machine according to a seventh embodiment.

FIG. 50 is a view illustrating the vicinity of the delivery sides of the skewed rolls 1 of a piercing machine 10 according to a seventh embodiment. Referring to FIG. 50, in comparison to the piercing machine 10 according to the fourth embodiment, the piercing machine 10 according to the seventh embodiment newly includes a frontward damming mechanism 600 and a rearward damming mechanism 500. That is, the piercing machine 10 according to the seventh embodiment has a configuration obtained by combining the fifth embodiment and the sixth embodiment.

The configuration of the frontward damming mechanism 600 of the present embodiment is the same as the configuration of the frontward damming mechanism 600 in the fifth embodiment. Further, the configuration of the rearward damming mechanism 500 of the present embodiment is the same as the configuration of the rearward damming mechanism 500 in the sixth embodiment.

In the piercing machine 10 according to the present embodiment, during piercing-rolling or elongating rolling, the cooling fluid CF that flows over the outer surface portion of the hollow shell 50 after contacting the outer surface portion of the hollow shell 50 in the cooling zone 32 is suppressed from contacting the outer surface portions of the hollow shell 50 that are frontward and rearward of the cooling zone 32 by means of the frontward damming mechanism 600 and the rearward damming mechanism 500. Note that, during piercing-rolling or elongating rolling, the inner surface cooling mechanism 340 cools the inner surface of the hollow shell 50 inside the cooling zone 32.

Specifically, the frontward damming mechanism 600 is equipped with a mechanism that, when the outer surface cooling mechanism 400 is cooling the hollow shell inside the cooling zone 32 by ejecting the cooling fluid CF toward the upper part of the outer surface, the lower part of the outer surface, the left part of the outer surface and the right part of the outer surface of the hollow shell 50 inside the cooling zone 32, dams the cooling fluid from flowing to the upper part, the lower part, the left part and the right part of the outer surface of the hollow shell 50 before the aforementioned parts of the outer surface of the hollow shell 50 enter the cooling zone 32. Specifically, when seen in the advancing direction of the hollow shell 50, the frontward damming upper member 600U ejects the frontward damming fluid FF toward the upper part of the outer surface of the hollow shell 50 that is positioned in the vicinity of the entrance side of the cooling zone 32 to thereby form a dam (protective wall) composed of the frontward damming fluid FF at the upper part of the outer surface of the hollow shell 50 before the upper part of the outer surface of the hollow shell 50 enters the cooling zone 32. Similarly, the frontward damming lower member 600D ejects the frontward damming fluid FF toward the lower part of the outer surface of the hollow shell 50 that is positioned in the vicinity of the entrance side of the cooling zone 32 to thereby form a dam (protective wall) composed of the frontward damming fluid FF at the lower part of the outer surface of the hollow shell 50 before the lower part of the outer surface of the hollow shell 50 enters the cooling zone 32. Similarly, the frontward damming left member 600L ejects the frontward damming fluid FF toward the left part of the outer surface of the hollow shell 50 that is positioned in the vicinity of the entrance side of the cooling zone 32 to thereby form a dam (protective wall) composed of the frontward damming fluid FF at the left part of the outer surface of the hollow shell 50 before the left part of the outer surface of the hollow shell 50 enters the cooling zone 32. Similarly, the frontward damming right member 600R ejects the frontward damming fluid FF toward the right part of the outer surface of the hollow shell 50 that is positioned in the vicinity of the entrance side of the cooling zone 32 to thereby form a dam (protective wall) composed of the frontward damming fluid FF at the right part of the outer surface of the hollow shell 50 before the right part of the outer surface of the hollow shell 50 enters the cooling zone 32. These dams that are composed of the frontward damming fluid FF dam the cooling fluid CF that contacts the outer surface portion of the hollow shell 50 within the cooling zone 32 and rebounds therefrom and attempts to flow to the zone frontward of the cooling zone 32. Therefore, contact of the cooling fluid CF with the outer surface portion of the hollow shell 50 that is frontward of the cooling zone 32 can be suppressed, and temperature variations in the axial direction of the hollow shell 50 can be further reduced.

In addition, the rearward damming mechanism 500 is equipped with a mechanism that, when the outer surface cooling mechanism 400 is cooling the hollow shell inside the cooling zone 32 by ejecting the cooling fluid CF toward the upper part of the outer surface, the lower part of the outer surface, the left part of the outer surface and the right part of the outer surface of the hollow shell 50 inside the cooling zone 32, dams the cooling fluid CF from flowing to the upper part, the lower part, the left part and the right part of the outer surface of the hollow shell 50 after the aforementioned parts of the outer surface of the hollow shell 50 leave from the cooling zone 32. Specifically, when seen in the advancing direction of the hollow shell 50, the rearward damming upper member 500U ejects the rearward damming fluid BF toward the upper part of the outer surface of the hollow shell 50 that is positioned in the vicinity of the delivery side of the cooling zone 32 to thereby form a dam (protective wall) composed of the rearward damming fluid BF at the upper part of the outer surface of the hollow shell 50 after the upper part of the outer surface of the hollow shell 50 leaves from the cooling zone 32. Similarly, the rearward damming lower member 500D ejects the rearward damming fluid BF toward the lower part of the outer surface of the hollow shell 50 that is positioned in the vicinity of the delivery side of the cooling zone 32 to thereby form a dam (protective wall) composed of the rearward damming fluid BF at the lower part of the outer surface of the hollow shell 50 after the lower part of the outer surface of the hollow shell 50 leaves from the cooling zone 32. Similarly, the rearward damming left member 500L ejects the rearward damming fluid BF toward the left part of the outer surface of the hollow shell 50 that is positioned in the vicinity of the delivery side of the cooling zone 32 to thereby form a dam (protective wall) composed of the rearward damming fluid BF at the left part of the outer surface of the hollow shell 50 after the left part of the outer surface of the hollow shell 50 leaves from the cooling zone 32. Similarly, the rearward damming right member 500R ejects the rearward damming fluid BF toward the right part of the outer surface of the hollow shell 50 that is positioned in the vicinity of the delivery side of the cooling zone 32 to thereby form a dam (protective wall) composed of the rearward damming fluid BF at the right part of the outer surface of the hollow shell 50 after the right part of the outer surface of the hollow shell 50 leaves from the cooling zone 32. These dams that are composed of the rearward damming fluid BF dam the cooling fluid CF that contacts the outer surface portion of the hollow shell 50 within the cooling zone 32 and rebounds therefrom and attempts to flow to the zone rearward of the cooling zone 32. Therefore, contact of the cooling fluid CF with the outer surface portion of the hollow shell 50 that is rearward of the cooling zone 32 can be suppressed, and temperature variations in the axial direction of the hollow shell 50 can be further reduced.

In addition, during piercing-rolling or elongating rolling, while the inner surface cooling mechanism 340 cools the inner surface of the hollow shell 50 inside the cooling zone 32, the inner surface damming mechanism 350 suppresses the coolant ejected from the inner surface cooling mechanism 340 from contacting the inner surface of the hollow shell 50 that left from the cooling zone 32.

According to the configuration described above, in the piercing machine 10 of the present embodiment, while the inner surface of the hollow shell 50 that is inside the cooling zone 32 is being cooled by the inner surface cooling mechanism 340, the outer surface of the hollow shell 50 that is inside the cooling zone 32 is being cooled by the outer surface cooling mechanism 400. In addition, while the coolant CL is being suppressed from contacting the inner surface of the hollow shell 50 after the inner surface of the hollow shell 50 leaves from the cooling zone 32 by the inner surface damming mechanism 350, the cooling fluid CF can be suppressed from contacting the outer surface portions of the hollow shell 50 that are frontward and rearward of the cooling zone 32 by the frontward damming mechanism 600 and the rearward damming mechanism 500. Therefore, temperature variations in the axial direction of the hollow shell 50 can be further reduced. Thus, cooling of the hollow shell 50 can be promoted immediately after piercing-rolling or elongating rolling is completed (that is, immediately after passing the plug 2). In particular, a useful effect is obtained in the case of producing a heavy-wall seamless metal pipe (for example, a seamless metal pipe with a wall thickness of 30 mm or more).

Note that, in the piercing machine 10 of the seventh embodiment, the frontward damming mechanism 600 may have the configuration illustrated in FIG. 36 and FIG. 37, and the rearward damming mechanism 500 may have the configuration illustrated in FIG. 48 and FIG. 49.

As described in the foregoing, the piercing machines of the aforementioned first to seventh embodiments suppress the occurrence of a temperature difference between the fore end portion and the rear end portion of a hollow shell after piercing-rolling or elongating rolling, and facilitate obtainment of a uniform micro-structure in the longitudinal direction. Further, the piercing machines of the aforementioned embodiments can, for example, in a case where piercing-rolling is performed at a temperature of around 1000° C., lower a hollow shell temperature to a temperature of around 800° C. by cooling the hollow shell by means of the inner surface cooling mechanism 340 for 10 seconds immediately after piercing-rolling.

Embodiments of the present invention have been described above. However, the foregoing embodiments are merely examples for implementing the present invention. Accordingly, the present invention is not limited to the above embodiments, and the above embodiments can be appropriately modified within a range which does not deviate from the gist of the present invention.

In the aforementioned embodiments, coolant is filled into a clearance between the mandrel bar 3 and the inner surface of the hollow shell 50 in the cooling zone 32 during piercing-rolling and during elongating rolling, by means of the inner surface cooling mechanism 340 and the inner surface damming mechanism 350. However, coolant need not necessarily be filled into the aforementioned clearance in the cooling zone 32. As long as the inner surface of the hollow shell 50 in the cooling zone 32 can be cooled by coolant, and coolant can be suppressed from flowing to the zone that is rearward of the cooling zone 32 by the inner surface damming mechanism 350, the effect of the present embodiments is obtained to a certain extent even if coolant is not filled into the aforementioned clearance in the cooling zone 32.

EXAMPLE 1

A pipe having an external diameter of 430 mm and a wall thickness of 30 mm was heated to 1000° C. After heating, the pipe was allowed to cool for three seconds. Thereafter, using the mandrel bar 3, the outer surface cooling mechanism 400 and the rearward damming mechanism 500 illustrated in FIG. 38, the inner surface and outer surface of the pipe were water-cooled for 10 seconds, and the required water amount densities on the outer surface side and the inner surface side of the pipe in a case where a wall thickness center temperature becomes 800° C. were determined by simulation.

Figure 51:
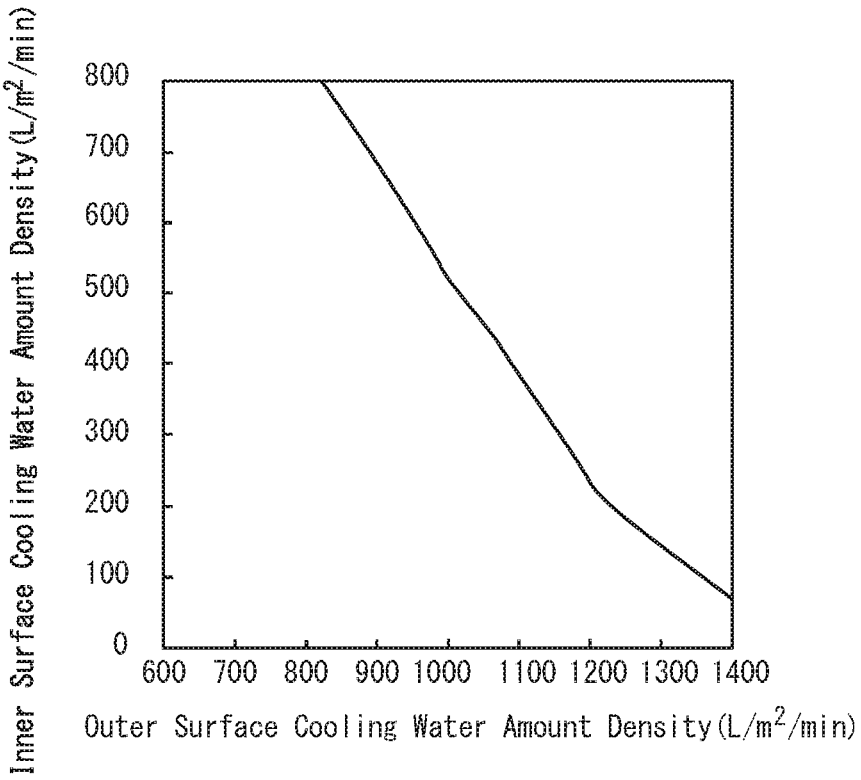
FIG. 51 is a view that illustrates the relation between the water amount density of outer surface cooling and the water amount density of inner surface cooling in Example 1.

The determined results are shown in FIG. 51. As shown in FIG. 51, it was found that desired cooling can be performed by determining the relation of the water amount densities between the outer surface side and inner surface side of the pipe in advance according to the steel type, and the external diameter and thickness of the pipe, and setting the water amount densities based on the determined result.

EXAMPLE 2

A pipe having an external diameter of 406 mm, a wall thickness of 30 mm and a length of 2 m was prepared. A thermocouple was embedded at the center position in the longitudinal direction of the pipe. The thermocouple was disposed at a wall thickness center position. The pipe was heated for two hours at 950° C. The inner surface of the heated pipe was cooled using the mandrel bar 3 illustrated in FIG. 4. At this time, the conveying speed of the pipe was set to 6 m/min. In this case, of the time period taken for the entire inner surface of the pipe to pass through the cooling zone 32, the time period from when the position (measurement position) at which the thermocouple was embedded entered the cooling zone 32 until the measurement position had passed through the cooling zone 32 was 10 seconds. While the pipe was being conveyed, cooling water was ejected from the cooling zone 32 by the inner surface cooling mechanism 340, and compressed air was ejected from the contact suppression zone 33 by the inner surface damming mechanism 350, and the heat transfer coefficient at the measurement position was measured.

Figure 52:
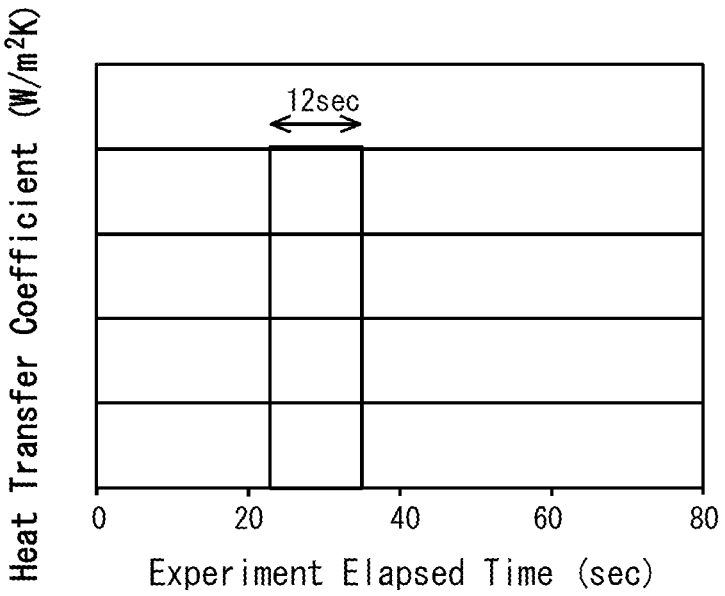
FIG. 52 is a view that illustrates the relation between experiment elapsed time and a heat transfer coefficient in Example 2.

The measurement results are shown in FIG. 52. Referring to FIG. 52, a time period in which the heat transfer coefficient rises means that the measurement position was cooled by the coolant in the time period in question. It is described above that the time period for cooling at the measurement position by the coolant was set to 10 seconds, and the measurement results showed that the measurement position was cooled for 12 seconds. That is, the cooling time period could be made approximately the same as the set time period. This means that the rearward damming mechanism 500 sufficiently suppressed contact of the coolant with an inner surface portion of the pipe that was further rearward than the cooling zone 32.

EXAMPLE 3

Figure 53:
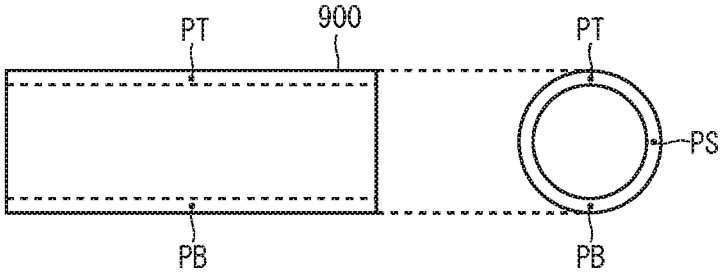
FIG. 53 is a multiple view drawing that shows a longitudinal sectional drawing along the axial direction of a pipe used in Example 3 as well as a transverse sectional view of the pipe that is perpendicular to the axial direction.

A pipe 900 having an external diameter of 406 mm, a wall thickness of 30 mm and a length of 2000 mm that is illustrated in FIG. 53 was prepared. In a cross section at the center position in the axial direction (longitudinal direction) of the pipe 900 that was perpendicular to the axial direction of the pipe 900, a thermocouple was embedded at a wall thickness center position (PT) at 0°, a wall thickness center position (PS) at 90° and a wall thickness center position (PB) at 180° in the clockwise direction, respectively, from the top of the pipe 900.

Figure 54:
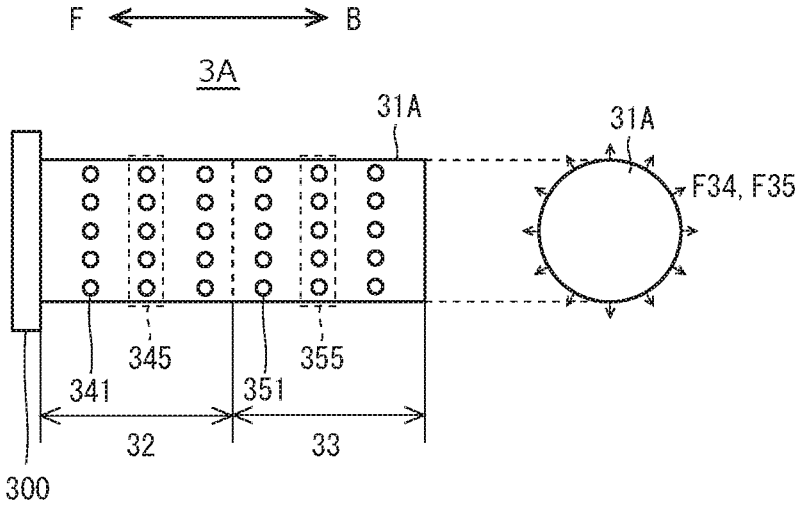
FIG. 54 is a multiple view drawing that shows a side view of a simulated mandrel bar used in Example 3 as well as a transverse sectional view of the simulated mandrel bar that is perpendicular to the axial direction.
Figure 55:
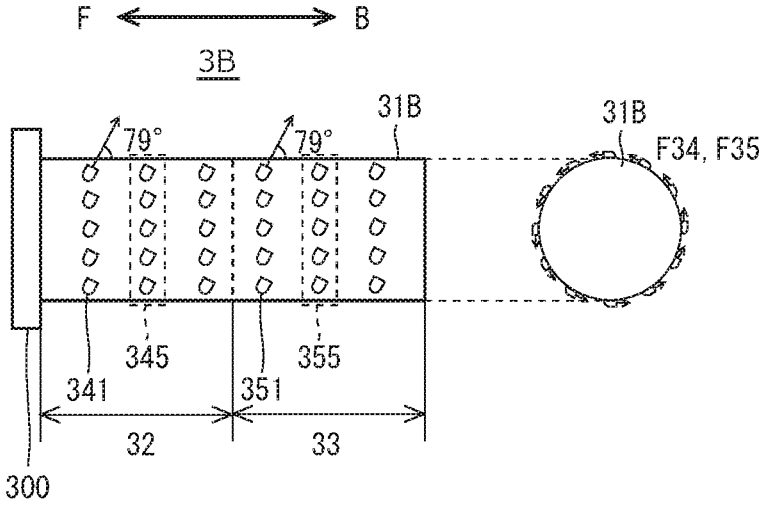
FIG. 55 is a multiple view drawing that shows a side view of a simulated mandrel bar used in the examples, which is different from the simulated mandrel bar in FIG. 54, and a transverse sectional view of the simulated mandrel bar that is perpendicular to the axial direction.

As illustrated in FIG. 54 and FIG. 55, a simulated mandrel bar 3A (FIG. 54) and a simulated mandrel bar 3B (FIG. 55) which each simulated the mandrel bar 3 were prepared. Referring to FIG. 54, the simulated mandrel bar 3A included a plurality of the annularly arranged coolant-ejection-hole groups 345 in the cooling zone 32 and included a plurality of the annularly arranged gas-ejection-hole groups 355 in the contact suppression zone 33 of a bar body 31A. Each of the annularly arranged coolant-ejection-hole groups 345 included a plurality of the coolant ejection holes 341 that were provided at a pitch of 30° in the circumferential direction. The ejection direction F34 of each of the coolant ejection holes 341 was the radial direction of the bar body 31A. Each of the annularly arranged gas-ejection-hole groups 355 included a plurality of the compressed gas ejection holes 351 that were provided at a pitch of 30° in the circumferential direction. The ejection direction F35 of each of the compressed gas ejection holes 351 was the radial direction of the bar body 31A. Note that, a discoid heat insulating material 300 simulating the plug 2 was attached to a fore end of the simulated mandrel bar 3A. The diameter of the heat insulating material 300 was equivalent to the inner diameter of the pipe 900.

Referring to FIG. 55, the simulated mandrel bar 3B included a plurality of the annularly arranged coolant-ejection-hole groups 345 in the cooling zone 32 and included a plurality of the annularly arranged gas-ejection-hole groups 355 in the contact suppression zone 33 of a bar body 31B. The annularly arranged coolant-ejection-hole groups 345 included a plurality of the coolant ejection holes 341 which were provided at a pitch of 30° in the circumferential direction. In the simulated mandrel bar 3B, each coolant ejection hole 341 was provided in a front end of a nozzle. An angle of the ejection direction F34 of each of the coolant ejection holes 341 with respect to the axial direction of the bar body 31B was 79°, and as illustrated in FIG. 55, when viewing the simulated mandrel bar 3B from the front to the rear in the axial direction, the ejection direction F34 was the counterclockwise direction. The annularly arranged gas-ejection-hole groups 355 included a plurality of the compressed gas ejection holes 351 that were provided at a pitch of 30° in the circumferential direction. In the simulated mandrel bar 3B, each compressed gas ejection hole 351 was provided in the front end of a nozzle. An angle of the ejection direction F35 of each of the compressed gas ejection holes 351 with respect to the axial direction of the bar body 31B was 79°, and as illustrated in FIG. 55, when viewing the simulated mandrel bar 3B from the front to the rear in the axial direction, the ejection direction F35 was the counterclockwise direction. Note that, the discoid heat insulating material 300 simulating the plug 2 was attached to a fore end of simulated mandrel bar 3B. The diameter of the heat insulating material 300 was equivalent to the inner diameter of the pipe 900.

Figure 56:
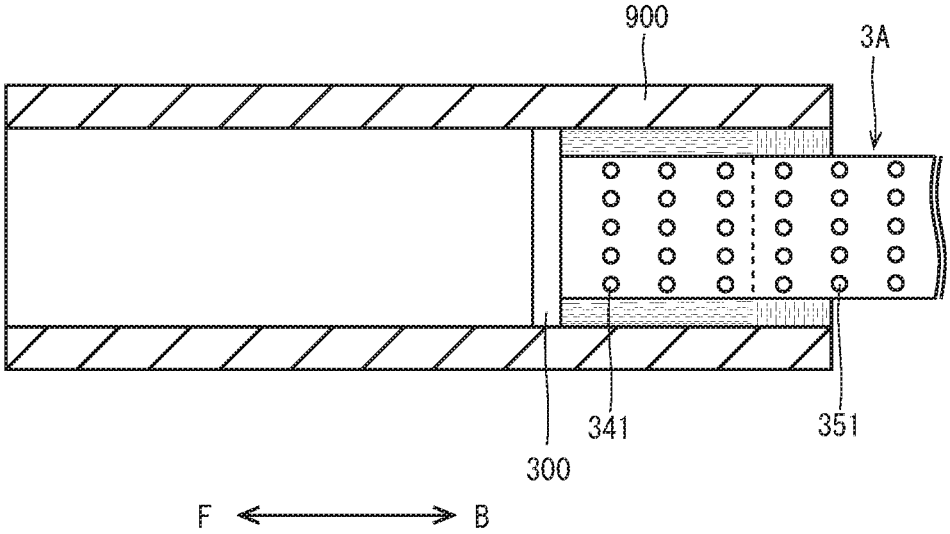
FIG. 56 is a schematic diagram for describing a testing method used in the examples.

The pipe in which the thermocouples were embedded was heated to 950° C. in a heating furnace. The pipe 900 was taken out from the heating furnace, and water cooling of the inner surface of the pipe 900 was performed using the simulated mandrel bar 3A. At such time, as illustrated in FIG. 56, the simulated mandrel bar 3A was fixed, and the pipe 900 was caused to pass by the simulated mandrel bar 3A at a conveying speed of 6 mpm. At such time, as illustrated in FIG. 56, the heat insulating material 300 simulating the plug 2 was arranged so as to hermetically seal the inside of the pipe 900. While the pipe 900 was passing by the simulated mandrel bar 3A, the temperature (° C.) at the PT position, the PS position and the PB position was measured by the thermocouples. Note that, the ejection amount (flow rate) of the coolant ejection holes 341 during cooling in the cooling zone 32 was set to 600 L/min, and coolant was filled between the inner surface of the pipe 900 and the bar body 31A in the cooling zone 32 during cooling. The ejection amount (flow rate) of compressed gas of the compressed gas ejection holes 351 in the contact suppression zone was 4000 L/min. The cooling time period (time period for which the pipe 900 passed by the cooling zone 32) was 12 seconds. After cooling of the overall length of the pipe 900 by the simulated mandrel bar 3A was completed, mean heat transfer coefficients ($W/m^2/k$) at the PT position, the PS position and the PB position were calculated. Among the three mean heat transfer coefficients that were obtained, a ratio of the maximum value of the mean heat transfer coefficient to the minimum value of the mean heat transfer coefficient was determined.

In addition, a water-cooling test that was the same as the water-cooling test performed using the simulated mandrel bar 3A was performed using the simulated mandrel bar 3B. Specifically, the pipe 900 in which the thermocouples were embedded was heated to 950° C. in a heating furnace. The pipe 900 was taken out from the heating furnace, and water cooling was started using the simulated mandrel bar 3B. At such time, similarly to the simulated mandrel bar 3A, the simulated mandrel bar 3B was fixed, and the pipe 900 was caused to pass by the simulated mandrel bar 3B at a conveying speed of 6 mpm. At such time, the heat insulating material 300 simulating the plug 2 was arranged so as to hermetically seal the inside of the pipe 900. While the pipe 900 was passing by the simulated mandrel bar 3B, the temperature (° C.) at the PT position, the PS position and the PB position was measured by the thermocouples. The ejection amount (flow rate) of the coolant ejection holes 341 during cooling in the cooling zone 32 was set to 600 L/min, and the ejection amount (flow rate) of compressed gas of the compressed gas ejection holes 351 in the contact suppression zone 33 was set to 8300 L/min. The cooling time period (time period for which the pipe 900 passed by the cooling zone 32) was 10 seconds. After cooling of the overall length of the pipe by the simulated mandrel bar 3B was completed, mean heat transfer coefficients ($W/m^2/k$) at the PT position, the PS position and the PB position were calculated. Among the three mean heat transfer coefficients that were obtained, a ratio of the maximum value of the mean heat transfer coefficient to the minimum value of the mean heat transfer coefficient was determined.

[Test Results]

Figure 57:
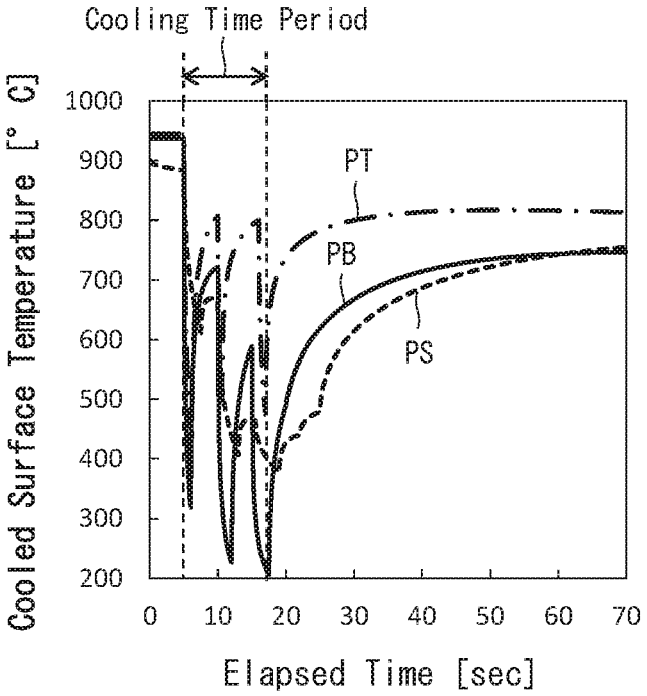
FIG. 57 is a view illustrating the relation between elapsed time (sec) and temperature (° C.) in a case where the inner surface of a pipe was cooled using the simulated mandrel bar shown in FIG. 54.
Figure 58:
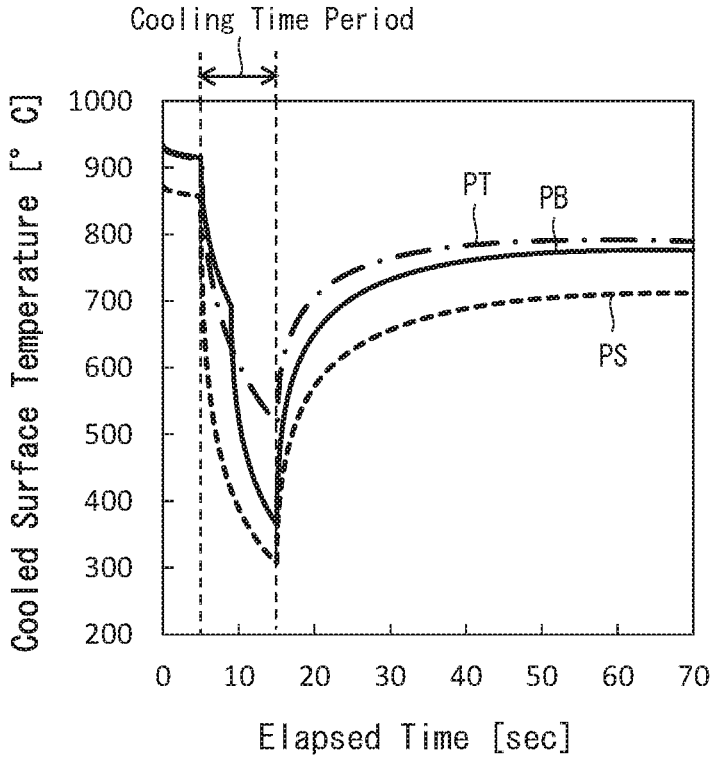
FIG. 58 is a view illustrating the relation between elapsed time (sec) and temperature (° C.) in a case where the inner surface of a pipe was cooled using the simulated mandrel bar shown in FIG. 55.

FIG. 57 is a view illustrating the relation between elapsed time (sec) and temperature (° C.) at the PT position, the PS position and the PB position when the simulated mandrel bar 3A was used. FIG. 58 is a view illustrating the relation between elapsed time (sec) and temperature (° C.) at the PT position, the PS position and the PB position when the simulated mandrel bar 3B was used.

Referring to FIG. 57 and FIG. 58, temperature variations at the PT position, the PS position and the PB position during the cooling period were less in the case of the simulated mandrel bar 3B that generated a swirl flow than in the case of the simulated mandrel bar 3A.

Further, in the case of the simulated mandrel bar 3A, the maximum value of the mean heat transfer coefficient at the PT position, the PS position and the PB position was 6000 $W/m^2/k$, the minimum value thereof was 1580 $W/m^2/k$, and the ratio for maximum value/minimum value of the mean heat transfer coefficient was 3.8. In contrast, in the case of the simulated mandrel bar 3B that generated a swirl flow, the maximum value of the mean heat transfer coefficient at the PT position, the PS position and the PB position was 4000 $W/m^2/k$, the minimum value was 2000 $W/m^2/k$, and the ratio for maximum value/minimum value of the mean heat transfer coefficient was 2.0. Thus, when the simulated mandrel bar 3B that generated a swirl flow was used, the inner surface of the pipe could be cooled more uniformly in the circumferential direction compared to the case where the simulated mandrel bar 3A was used.

REFERENCE SIGNS LIST

1 Skewed roll, 2 Plug, 3 Mandrel bar, 7 Coolant supply device, 8 Gas supply device, 10 Piercing machine, 20 Material, 31 Bar body, 32 Cooling zone, 33 Contact suppression zone, 50 Hollow shell, 340 Inner surface cooling mechanism, 350 Inner surface damming mechanism, 400 Outer surface cooling mechanism, 500 Rearward damming mechanism, 600 Frontward damming mechanism

The invention claimed is:

1. A piercing machine that performs piercing-rolling or elongating rolling of a material to produce a hollow shell, comprising:

a plurality of skewed rolls disposed around a pass line along which the material passes;

a plug disposed on the pass line between a plurality of the skewed rolls; and a mandrel bar body extending rearward of the plug along the pass line from a rear end of the plug, the mandrel bar body comprising:

an inner surface cooling mechanism providing a cooling zone at a fore end portion of the mandrel bar body, the inner surface cooling mechanism comprising:

a coolant channel formed inside the mandrel bar body allowing a coolant to pass therein; and a plurality of coolant ejection holes connected to the coolant channel and arrayed circumferentially about and axially rearwardly along the mandrel bar body, wherein, during piercing-rolling or during elongating rolling, the inner surface cooling mechanism ejects the coolant that is supplied from the coolant channel to outside of the bar body to cool an inner surface of the hollow shell that is advancing within the cooling zone; and an inner surface damming mechanism disposed adjacent to the cooling zone on a rearward side of the cooling zone providing a contact suppression zone rearwardly adjacent the cooling zone, the inner surface damming mechanism comprising:

a compressed gas channel formed inside the mandrel bar body through which compressed gas passes; and a plurality of compressed gas ejection holes connected to the compressed gas channel and arrayed circumferentially about and axially rearwardly along the mandrel bar body, wherein, during piercing-rolling or during elongating rolling, the inner surface damming mechanism ejects compressed gas supplied from the compressed gas channel to outside of the mandrel bar body to suppress contact of the coolant ejected to outside of the bar body with the inner surface of the hollow shell after the hollow shell leaves from the cooling zone.

2. The piercing machine according to claim 1, wherein:

the inner surface damming mechanism dams the coolant ejected to outside of the bar body, and accumulates the coolant between the bar body and the inner surface of the hollow shell within the cooling zone.

3. The piercing machine according to claim 1 wherein: the inner surface damming mechanism dams the coolant ejected to outside of the bar body, by means of the compressed gas ejected to outside of the bar body, and accumulates the coolant between the bar body and the inner surface of the hollow shell within the cooling zone.

4. The piercing machine according to claim 1, wherein:

the mandrel bar body further includes:

a drainage channel that is formed within the mandrel bar body and in which the coolant ejected to outside of the mandrel bar body flows, and one or more drainage holes that is disposed within the cooling zone in the mandrel bar body, and is connected to the drainage channel and recovers the coolant ejected to outside of the bar body.

5. The piercing machine according to claim 1, wherein:

the inner surface cooling mechanism causes the coolant in the cooling zone to swirl around the mandrel bar body by ejecting the coolant from the coolant ejection holes.

6. The piercing machine according to claim 1, wherein:

the inner surface damming mechanism causes the compressed gas in the contact suppression zone to swirl around the mandrel bar body by ejecting the compressed gas from the compressed gas ejection holes.

7. The piercing machine according to claim 6, wherein:

as seen from an advancing direction of the hollow shell, a swirling direction of the coolant ejected from a plurality of the coolant ejection holes is clockwise or counterclockwise, as seen from an advancing direction of the hollow shell, a swirling direction of the compressed gas ejected from a plurality of the compressed gas ejection holes is clockwise or counterclockwise, and the inner surface damming mechanism ejects the compressed gas so that the swirling direction of the compressed gas becomes the same as the swirling direction of the coolant.

8. The piercing machine according to claim 6, wherein:

the inner surface cooling mechanism includes a plurality of annularly arranged coolant-ejection-hole groups that are arrayed in the axial direction of the bar body in the cooling zone of the bar body, the annularly arranged coolant-ejection-hole group includes a plurality of the coolant ejection holes that are arrayed in the circumferential direction at a same position in the axial direction of the bar body, and in the inner surface cooling mechanism:

when a distance in the axial direction of the bar body that the swirl flow of the coolant advances until completing one rotation around the bar body is defined as "one swirl period distance", in the axial direction of the bar body, a distance between the annularly arranged coolant-ejection-hole groups that are adjacent is the same as the one swirl period distance.

9. The piercing machine according to claim 1, further comprising:

an outer surface cooling mechanism disposed around the mandrel bar, at a position that is rearward of the plug, wherein, with respect to the outer surface of the hollow shell that is advancing through the cooling zone, as seen from an advancing direction of the hollow shell, the outer surface cooling mechanism ejects a cooling fluid toward an upper part of the outer surface, a lower part of the outer surface, a left part of the outer surface and a right part of the outer surface to cool the hollow shell inside the cooling zone.

10. The piercing machine according to claim 9, wherein:

the outer surface cooling mechanism includes:

an outer surface cooling upper member disposed above the mandrel bar as seen from an advancing direction of the hollow shell, the outer surface cooling upper member including a plurality of cooling fluid upper-part ejection holes which eject the cooling fluid toward the upper part of the outer surface of the hollow shell in the cooling zone;

an outer surface cooling lower member disposed below the mandrel bar as seen from the advancing direction of the hollow shell, the outer surface cooling lower member including a plurality of cooling fluid lower-part ejection holes which eject the cooling fluid toward the lower part of the outer surface of the hollow shell in the cooling zone;

an outer surface cooling left member disposed leftward of the mandrel bar as seen from the advancing direction of the hollow shell, the outer surface cooling left member including a plurality of cooling fluid left-part ejection holes which eject the cooling fluid toward the left part of the outer surface of the hollow shell in the cooling zone; and an outer surface cooling right member disposed rightward of the mandrel bar as seen from the advancing direction of the hollow shell, the outer surface cooling right member including a plurality of cooling fluid right-part ejection holes which eject the cooling fluid toward the right part of the outer surface of the hollow shell in the cooling zone.

11. The piercing machine according to claim 9, further comprising:

a frontward damming mechanism that is disposed around the mandrel bar at a position that is rearward of the plug and is frontward of the outer surface cooling mechanism, wherein:

the frontward damming mechanism comprises a mechanism that, when the outer surface cooling mechanism is cooling the hollow shell in the cooling zone by ejecting the cooling fluid toward the upper part of the outer surface, the lower part of the outer surface, the left part of the outer surface and the right part of the outer surface of the hollow shell, dams the cooling fluid from flowing to the upper part of the outer surface, the lower part of the outer surface, the left part of the outer surface and the right part of the outer surface of the hollow shell before the hollow shell enters the cooling zone.

12. The piercing machine according to claim 11, wherein:

the frontward damming mechanism includes:

a frontward damming upper member including a plurality of frontward damming fluid upper-part ejection holes that is disposed above the mandrel bar as seen from the advancing direction of the hollow shell, and that ejects a frontward damming fluid toward the upper part of the outer surface of the hollow shell that is positioned in a vicinity of an entrance side of the cooling zone and dams the cooling fluid from flowing to the upper part of the outer surface of the hollow shell before the hollow shell enters the cooling zone;

a frontward damming left member including a plurality of frontward damming fluid left-part ejection holes that is disposed leftward of the mandrel bar as seen from the advancing direction of the hollow shell, and that ejects the frontward damming fluid toward the left part of the outer surface of the hollow shell that is positioned in a vicinity of the entrance side of the cooling zone and dams the cooling fluid from flowing to the left part of the outer surface of the hollow shell before the hollow shell enters the cooling zone; and a frontward damming right member including a plurality of frontward damming fluid right-part ejection holes that is disposed rightward of the mandrel bar as seen from the advancing direction of the hollow shell, and that ejects the frontward damming fluid toward the right part of the outer surface of the hollow shell that is positioned in a vicinity of the entrance side of the cooling zone and dams the cooling fluid from flowing to the right part of the outer surface of the hollow shell before the hollow shell enters the cooling zone.

13. The piercing machine according to claim 12, wherein:

the frontward damming upper member ejects the frontward damming fluid diagonally rearward toward the upper part of the outer surface of the hollow shell that is positioned in a vicinity of the entrance side of the cooling zone from a plurality of the frontward damming fluid upper-part ejection holes;

the frontward damming left member ejects the frontward damming fluid diagonally rearward toward the left part of the outer surface of the hollow shell that is positioned in a vicinity of the entrance side of the cooling zone from a plurality of the frontward damming fluid left-part ejection holes; and the frontward damming right member ejects the frontward damming fluid diagonally rearward toward the right part of the outer surface of the hollow shell that is positioned in a vicinity of the entrance side of the cooling zone from a plurality of the frontward damming fluid right-part ejection holes.

14. The piercing machine according to claim 12, wherein: the frontward damming mechanism further includes:

a frontward damming lower member including a plurality of frontward damming fluid lower-part ejection holes that is disposed below the mandrel bar as seen from the advancing direction of the hollow shell, and that ejects the frontward damming fluid toward the lower part of the outer surface of the hollow shell that is positioned in a vicinity of the entrance side of the cooling zone and dams the cooling fluid from flowing to the lower part of the outer surface of the hollow shell before the hollow shell enters the cooling zone.

15. The piercing machine according to claim 14, wherein:

the frontward damming lower member ejects the frontward damming fluid diagonally rearward toward the lower part of the outer surface of the hollow shell that is positioned in a vicinity of the entrance side of the cooling zone from a plurality of the frontward damming fluid lower-part ejection holes.

16. The piercing machine according to claim 9, further comprising:

a rearward damming mechanism that is disposed around the mandrel bar at a position that is rearward of the outer surface cooling mechanism, wherein:

the rearward damming mechanism comprises a mechanism that, when the outer surface cooling mechanism is cooling the hollow shell by ejecting the cooling fluid toward the upper part of the outer surface, the lower part of the outer surface, the left part of the outer surface and the right part of the outer surface of the hollow shell, dams the cooling fluid from flowing to the upper part of the outer surface, the lower part of the outer surface, the left part of the outer surface and the right part of the outer surface of the hollow shell after the hollow shell leaves from the cooling zone.

17. The piercing machine according to claim 16, wherein: the rearward damming mechanism includes:

a rearward damming upper member including a plurality of rearward damming fluid upper-part ejection holes that is disposed above the mandrel bar as seen from the advancing direction of the hollow shell, and that ejects a rearward damming fluid toward the upper part of the outer surface of the hollow shell that is positioned in a vicinity of a delivery side of the cooling zone and dams the cooling fluid from flowing to the upper part of the outer surface of the hollow shell after the hollow shell leaves from the cooling zone;

a rearward damming left member including a plurality of rearward damming fluid left-part ejection holes that is disposed leftward of the mandrel bar as seen from the advancing direction of the hollow shell, and that ejects the rearward damming fluid toward the left part of the outer surface of the hollow shell that is positioned in a vicinity of the delivery side of the cooling zone and dams the cooling fluid from flowing to the left part of the outer surface of the hollow shell after the hollow shell leaves from the cooling zone; and a rearward damming right member including a plurality of rearward damming fluid right-part ejection holes that is disposed rightward of the mandrel bar as seen from the advancing direction of the hollow shell, and that ejects the rearward damming fluid toward the right part of the outer surface of the hollow shell that is positioned in a vicinity of the delivery side of the cooling zone and dams the cooling fluid from flowing to the right part of the outer surface of the hollow shell after the hollow shell leaves from the cooling zone.

18. The piercing machine according to claim 17, wherein:

the rearward damming upper member ejects the rearward damming fluid diagonally frontward toward the upper part of the outer surface of the hollow shell that is positioned in a vicinity of the delivery side of the cooling zone from a plurality of the rearward damming fluid upper-part ejection holes;

the rearward damming left member ejects the rearward damming fluid diagonally frontward toward the left part of the outer surface of the hollow shell that is positioned in a vicinity of the delivery side of the cooling zone from a plurality of the rearward damming fluid left-part ejection holes; and the rearward damming right member ejects the rearward damming fluid diagonally frontward toward the right part of the outer surface of the hollow shell that is positioned in a vicinity of the delivery side of the cooling zone from a plurality of the rearward damming fluid right-part ejection holes.

19. The piercing machine according to claim 17, wherein: the rearward damming mechanism further includes:

a rearward damming lower member including a plurality of the rearward damming fluid lower-part ejection holes that is disposed below the mandrel bar as seen from the advancing direction of the hollow shell, and that ejects the rearward damming fluid toward the lower part of the outer surface of the hollow shell that is positioned in a vicinity of the delivery side of the cooling zone and dams the cooling fluid from flowing to the lower part of the outer surface of the hollow shell after the hollow shell leaves from the cooling zone.

20. The piercing machine according to claim 19, wherein:

the rearward damming lower member ejects the rearward damming fluid diagonally frontward toward the lower part of the outer surface of the hollow shell that is positioned in a vicinity of the delivery side of the cooling zone from a plurality of the rearward damming fluid lower-part ejection holes.

21. A method for producing a seamless metal pipe using the piercing machine according to claim 1, comprising:

a rolling process of subjecting the material to piercing-rolling or elongating rolling using the piercing machine to produce a hollow shell, and a process of, during the rolling process, ejecting the coolant to outside of the bar body by means of the inner surface cooling mechanism to cool the inner surface of the hollow shell within the cooling zone, and by means of the inner surface damming mechanism that is disposed adjacent to the cooling zone on a rearward side of the cooling zone, suppressing contact of the coolant ejected to outside of the bar body with the inner surface of the hollow shell after the hollow shell leaves from the cooling zone.

* * * * *